US006824962B2

(12) United States Patent
Oikawa

(10) Patent No.: US 6,824,962 B2
(45) Date of Patent: Nov. 30, 2004

(54) PHOTOTHERMOGRAPHIC MATERIAL

(75) Inventor: Tokuju Oikawa, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/058,028

(22) Filed: Jan. 29, 2002

(65) Prior Publication Data

US 2003/0068586 A1 Apr. 10, 2003

(30) Foreign Application Priority Data

Jan. 30, 2001 (JP) ..... 2001-021749
Jan. 30, 2001 (JP) ..... 2001-021750

(51) Int. Cl.[7] ..... G03C 5/16; G03C 1/498; G03C 1/08

(52) U.S. Cl. ..... 430/350; 430/598; 430/607; 430/610; 430/611; 430/619

(58) Field of Search ..... 430/531, 619, 430/598, 613, 610, 607, 611, 350, 603, 605

(56) References Cited

U.S. PATENT DOCUMENTS 5,858,637 A * 1/1999 Eshelman et al. ..... 430/569
5,912,112 A * 6/1999 Lok et al. ..... 430/603
5,945,270 A * 8/1999 Lok et al. ..... 430/605
5,962,210 A * 10/1999 Hahm et al. ..... 430/567
6,150,084 A * 11/2000 Ito et al. ..... 430/610
6,177,240 B1 * 1/2001 Yamada et al. ..... 430/619

FOREIGN PATENT DOCUMENTS

JP 11-149136 * 6/1999 ..... G03C/1/498
JP 11-194447 7/1999

* cited by examiner

*Primary Examiner*—Thorl Chea
(74) *Attorney, Agent, or Firm*—Birch, Stewart, Kolasch & Birch, LLP

(57) ABSTRACT

Disclosed is a photothermographic material containing at least a photosensitive silver halide, a non-photosensitive silver salt of an organic acid, a reducing agent for silver ions and a binder on one surface of a support, wherein the material contains a compound producing imagewise a chemical species that can form development initiation points on and in the vicinity of the non-photosensitive silver salt of an organic acid or the like and an organic gold compound and the photosensitive silver halide has a mean grain size of 0.12 μm or less. This photothermographic material shows high sensitivity, low fog, high Dmax (maximum density), little increase of fog during storage and low temperature and humidity dependency during development.

10 Claims, 2 Drawing Sheets

PHOTOTHERMOGRAPHIC MATERIAL

TECHNICAL FIELD

The present invention relates to a photothermographic material, in particular, a photothermographic material for scanners and image setters, which is suitable for photomechanical processes. More precisely, the present invention relates to a photothermographic material for photomechanical processes that can provide images showing low fog, high Dmax (maximum density) and little increase of fog during storage.

RELATED ART

A large number of photosensitive materials are known which have a photosensitive image-forming layer on a support and form images by exposing imagewise. Among such materials, as an example of a system that contributes to environmental protection or enables simplification of image formation means, there is a technique of forming an image by heat development.

In recent years, reduction of amount of waste processing solutions is strongly desired in the field of photomechanical processes from the standpoints of environmental protection and space savings. Therefore, techniques relating to photothermographic materials for use in photomechanical processes are required to be developed, which enables efficient exposure by a laser scanner or a laser image setter and formation of a clear black image having high resolution and sharpness. Such photothermographic materials can provide users with a simpler and non-polluting heat development processing system that eliminates the use of solution-type processing chemicals.

Methods for forming images by heat development are described in, for example, U.S. Pat. Nos. 3,152,904, 3,457,075 and D. Klosterboer, Imaging Processes and Materials, "Thermally Processed Silver Systems A", 8th ed., Chapter 9, page 279, compiled by J. Sturge, V. Walworth and A. Shepp, Neblette (1989). Such a photothermographic material contains a reducible non-photosensitive silver source (e.g., silver salt of an organic acid), a photocatalyst (e.g., silver halide) in a catalytically active amount, and a reducing agent for silver, which are usually dispersed in an organic binder matrix. The photosensitive material is stable at an ambient temperature, but when the material is heated at a high temperature (e.g., 80° C. or higher) after light exposure, silver is produced through an oxidation-reduction reaction between the reducible silver source (which functions as an oxidizing agent) and the reducing agent. The oxidation-reduction reaction is accelerated by catalytic action of a latent image generated upon exposure. The silver produced by the reaction of the reducible silver salt in the exposed region shows black color and this presents a contrast to the non-exposed region to form an image.

In many of conventionally known photothermographic materials, an image-forming layer is formed by coating a coating solution using an organic solvent such as toluene, methyl ethyl ketone (MEK) and methanol as a solvent. However, not only use of an organic solvent as a solvent adversely affect human bodies during the production process, but also it is disadvantageous in view of cost because it requires process steps for recovery of the solvent and so forth. Accordingly, methods of forming an image-forming layer by coating a coating solution using water as a solvent have been proposed. For example, Japanese Patent Laid-open Publication (Kokai, hereinafter referred to as JP-A) 49-52626, JP-A-53-116144 and so forth disclose image-forming layers utilizing gelatin as a binder, and JP-A-50-151138 discloses an image-forming layer utilizing polyvinyl alcohol as a binder. Furthermore, JP-A-60-61747 discloses an image-forming layer utilizing gelatin and polyvinyl alcohol in combination. As another example, JP-A-58-28737 discloses an image-forming layer utilizing a water-soluble polyvinyl acetal as a binder. If these binders are used, image-forming layers can be formed by using a coating solution comprising an aqueous solvent, and therefore considerable merits can be obtained with respect to environment and cost.

However, when a polymer such as polyvinyl alcohol or water-soluble polyacetal is used as a binder, silver tone of developed areas becomes brown or yellow, which quite differs from black color regarded as a preferred proper color, and in addition, there arises, for example, a problem that the blacking density in exposed areas is low and the density in unexposed areas is high. Thus, there can be obtained only those of which commercial value is seriously impaired. Further, there is a problem that fog is more likely to be caused and in particular, increase of fog is more significant during storage in a photosensitive material based on the aforementioned heat development system compared with the conventional chemical treatment type photosensitive materials. Furthermore, chemical sensitization with a gold sensitizer suffers from a drawback that it is extremely likely to cause fog, while it can provide high sensitivity. Therefore, there has been desired a technique for providing a photothermographic material that shows high sensitivity, can provide images showing low fog, high Dmax (maximum density) and little increase of fog during storage, and is advantageous for environment and cost by utilizing a binder usable in the aforementioned aqueous solvent type coating solution.

For use of photographic art films in the fields of newspaper printing, commercial printing and so forth, there have generally been desired systems that can provide stable images at any time. However, photothermographic materials showing such high-contrast photographic property as mentioned above, which is required for films for photomechanical processes, suffer from a problem that they show higher temperature and humidity dependency during development compared with conventional films to be treated with chemicals, and thus white line width or dots are likely to come to narrow or small at a high temperature or under high humidity, or density may decrease or white line width may become large at a low temperature or under low humidity. Therefore, as for photothermographic materials, it has been desired to provide a photothermographic material that shows low temperature and humidity dependency during development and thus is suitable for use in photomechanical processes.

The present invention was accomplished in view of the aforementioned various problems, and its first object is to provide a photothermographic material that shows high sensitivity, low fog, high Dmax (maximum density), little increase of fog during storage and low temperature and humidity dependency during development, as a photothermographic material for photomechanical processes, in particular, for scanners and image setters. The second object of the present invention is to provide a photothermographic material that can be produced by coating of aqueous system, which is advantageous for environment and cost.

SUMMARY OF THE INVENTION

The present invention provides a photothermographic material containing at least a photosensitive silver halide, a non-photosensitive silver salt of an organic acid, a reducing agent for silver ions and a binder on one surface of a support, wherein the material contains at least one compound satisfying at least one of (i) to (iv) and an organic gold compound and the photosensitive silver halide has a mean grain size of 0.12 μm or less:

(i) a compound producing imagewise a chemical species that can form development initiation points on and in the vicinity of the non-photosensitive silver salt of an organic acid (except for hydrazine derivatives);
(ii) a compound that provides increase of developed silver grain density to a level of 200–5000% when it is added in an amount of 0.01 mol/mol of silver (except for hydrazine derivatives);
(iii) a compound that provides increase of covering power to a level of 120–1000% when it is added in an amount of 0.01 mol/mol of silver (except for hydrazine derivatives);
(iv) a compound represented by any one of the following formulas (1) to (3):

Formula (1)

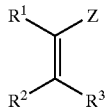

In the formula, $R^1$, $R^2$ and $R^3$ each independently represents a hydrogen atom or a substituent, Z represents an electron-withdrawing group, and $R^1$ and Z, $R^2$ and $R^3$, $R^1$ and $R^2$, or $R^3$ and Z may be combined with each other to form a ring structure.

Formula (2)

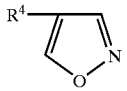

In the formula, $R^4$ represents a substituent.

Formula (3)

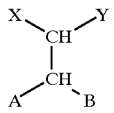

In the formula, X and Y each independently represent a hydrogen atom or a substituent, A and B each independently represents an alkoxy group, an alkylthio group, an alkylamino group, an aryloxy group, an arylthio group, an aniline group, a heterocyclyloxy group, a heterocyclylthio group or a heterocyclylamino group, and X and Y or A and B may be combined with each other to form a ring structure.

The organic gold compound used for the photothermographic material of the present invention preferably consists of at least one compound represented by any one of the following formulas (4) to (6).

$[Au(L)_2]^+X^-$ Formula (4)

In the formula, L represents a ligand, two of L may be identical to or different from each other, and at least one of L represents a mesolon ligand. $X^-$ represents an anion.

[L-Au-L]M Formula (5)

In the formula, L represents an organic mercapto ligand and M represents a cationic counter ion, provided that this complex has a symmetrical form.

$[(M\text{-}R^{sol})_n\text{-}A\text{-}S\text{—}Au\text{—}S\text{-}A\text{-}(R^{sol}\text{-}M)_n]M$ Formula (6)

In the formula, M represents a cationic counter ion, $R^{sol}$ represents a hydrophilic group, A represents a substituted or unsubstituted divalent organic bridging group, n represents any of 1–4, and when n is 2 or larger, n of ($R^{sol}$-M) may be identical to or different from each other or one another, provided that the compound has a symmetrical form.

The photosensitive silver halide used for the photothermographic material of the present invention preferably consists of at least one compound represented by the following formula (7).

Formula (7)

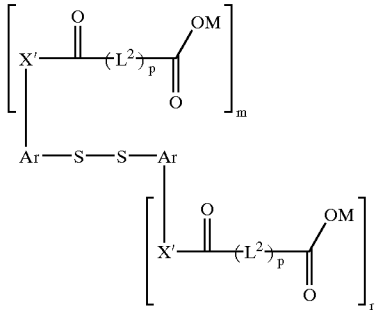

In the formula, X' each independently represents —O—, —NH— or —NR—, R represents an alkyl group, a fluoroalkyl group, an aryl group or a sulfonyl group, and m and r each represent 0, 1 or 2, provided that m and r do not simultaneously represent 0. M represents hydrogen or a cationic species, Ar represents an aromatic group, $L^2$ represents a bridging group, and p represents 0 or 1. In the formula, (m+r) of X', M, $L^2$ or p as well as two of Ar may be identical to or different from each other or one another.

The present invention also provide an image formation method comprising subjecting the aforementioned photothermographic material to light exposure for $10^{-6}$ second or less and heat development to form an image, an image formation method comprising subjecting the aforementioned photothermographic material to light exposure utilizing a multi-beam heat development apparatus provided with two or more laser heads and heat development to form an image, and an image formation method comprising subjecting the aforementioned photothermographic material to light exposure and heat development at a line speed of 140 cm/minute or more to form an image.

BEST MODE FOR CARRYING OUT THE INVENTION

Figure 1:
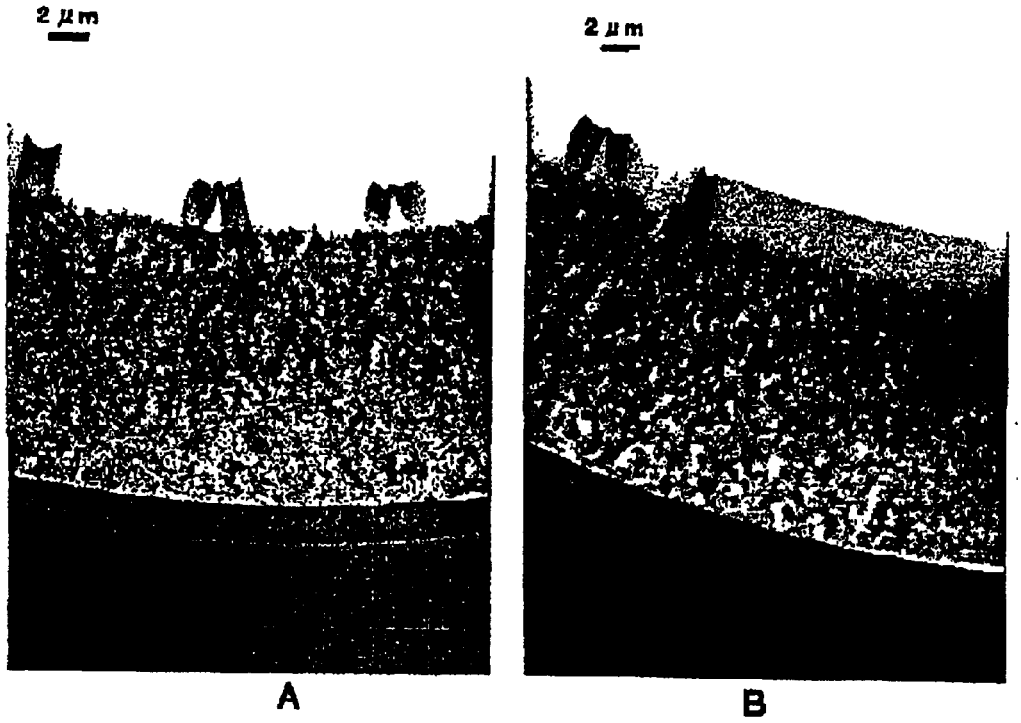
FIG. 1 shows electron micrographs for a case where a compound of the present invention existed in a photothermographic material (A) and a case where a compound of the present invention did not exist in a photothermographic material (B).

The photothermographic material of the present invention will be explained in detail hereafter. In the following description, ranges indicated with "-" mean ranges including the numerical values before and after "-" as the minimum and maximum values.

The photothermographic material of the present invention contains at least a non-photosensitive silver salt of an organic acid, a photosensitive silver halide, a reducing agent for silver ions and a binder on one surface of a support.

The non-photosensitive silver salt of an organic acid (simply referred to as "silver salt of an organic acid" hereinafter) that can be used for the photothermographic material of the present invention is a silver salt relatively stable against light, but forms a silver image when it is heated at 80° C. or higher in the presence of an exposed photocatalyst (e.g., a latent image of photosensitive silver halide) and a reducing agent. The silver salt of an organic acid may be any organic substance containing a source of reducible silver ions. Silver salts of an organic acid, in particular, silver salts of a long chained aliphatic carboxylic acid (they contains preferably 10–30, more preferably 15–28 carbon atoms) are preferred. Further, complexes of organic or inorganic acid silver salts of which ligands have a complex stability constant in the range of 4.0–10.0 are also preferred. The silver supplying substance can preferably constitute about 5–70 weight % of the image-forming layer. Preferred examples of the silver salts of an organic acid include silver salts of organic compounds having carboxyl group. Specifically, the silver salts of an organic acid may be silver salts of an aliphatic carboxylic acid and silver salts of an aromatic carboxylic acid, but not limited to these. Preferred examples of the silver salts of an aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate, mixtures thereof and so forth.

In the present invention, there is preferably used silver salt of an organic acid having a silver behenate content of 75 mole % or more, more preferably silver salt of an organic acid having a silver behenate content of 85 mole % or more, among the aforementioned silver salts of an organic acid and mixtures of silver salts of an organic acid. The silver behenate content used herein means a molar percent of silver behenate with respect to silver salt of an organic acid to be used. As silver salts of an organic acid other than silver behenate contained in the silver salts of organic acid used for the present invention, the silver salts of an organic acid exemplified above can preferably be used.

Silver salts of an organic acid that can be preferably used in the present invention can be prepared by allowing a solution or suspension of an alkali metal salt (e.g., Na salts, K salts, Li salts) of the aforementioned organic acids to react with silver nitrate. As the preparation method, the method described in JP-A-2000-292882, paragraphs 0019–0021 can be used.

In the present invention, a method of preparing a silver salt of an organic acid by adding an aqueous solution of silver nitrate and a solution of alkali metal salt of an organic acid to a sealable means for mixing liquids can preferably be used. Specifically, the method described in JP-A-2000-33907 can be used.

In the present invention, a dispersing agent soluble in water can be added to the aqueous solution of silver nitrate and the solution of alkali metal salt of an organic acid or reaction mixture during the preparation of the silver salt of an organic acid. Type and amount of the dispersing agent used in this case are specifically mentioned in JP-A-2000-305214, paragraph 0052.

The silver salt of an organic acid for use in the present invention is preferably prepared in the presence of a tertiary alcohol. The tertiary alcohol preferably has a total carbon number of 15 or less, more preferably 10 or less. Examples of preferred tertiary alcohols include tert-butanol. However, tertiary alcohol that can be used for the present invention is not limited to it.

The tertiary alcohol for use in the present invention may be added at any time during the preparation of the organic acid silver salt, but the tertiary alcohol is preferably used by adding at the time of preparation of the organic acid alkali metal salt to dissolve the organic alkali metal salt. The tertiary alcohol for use in the present invention may be added in an amount of from 0.01–10 in terms of the weight ratio to water used as a solvent for the preparation of the silver salt of an organic acid, but preferably added in an amount of from 0.03–1 in terms of weight ratio to water.

Although shape and size of the silver salt of an organic acid used for the present invention are not particularly limited, those mentioned in JP-A-2000-292882, paragraph 0024 can be preferably used. The shape of the organic acid silver salt can be determined from a transmission electron microscope image of organic silver salt dispersion. An example of the method for determining monodispesibility is a method comprising obtaining the standard deviation of a volume weight average diameter of the organic acid silver salt. The percentage of a value obtained by dividing the standard deviation by the volume weight average diameter (variation coefficient) is preferably 80% or less, more preferably 50% or less, particularly preferably 30% or less. As a measurement method, for example, the grain size can be determined by irradiating organic acid silver salt dispersed in a solution with a laser ray and determining an autocorrelation function for change of the fluctuation of the scattered light with time (volume weight average diameter). The average grain size determined by this method is preferably from 0.05–10.0 $\mu$m, more preferably from 0.1–5.0 $\mu$m, further preferably from 0.1–2.0 $\mu$m, in solid microparticle dispersion.

The silver salt of an organic acid that is used in the present invention is preferably desalted. The desalting method is not particularly limited and any known methods may be used. Known filtration methods such as centrifugal filtration, suction filtration, ultrafiltration and flocculation washing with water by coagulation may be preferably used. As the method of ultrafiltration, the method described in JP-A-2000-305214 can be used.

For obtaining an organic acid silver salt solid dispersion having a high S/N ratio and a small grain size and being free from coagulation, there is preferably used a dispersion method comprising steps of converting an aqueous dispersion that contains a silver salt of an organic acid as an image-forming medium and contains substantially no photosensitive silver salt into a high-speed flow, and then releasing the pressure. As such a dispersion method, the method mentioned in JP-A-2000-292882, paragraphs 0027–0038 can be used.

The grain size distribution of the silver salt of an organic acid in the solid grain dispersion of the silver salt of an organic acid used in the present invention preferably corresponds to monodispersion. Specifically, the percentage (variation coefficient) of the value obtained by dividing the standard deviation by the volume weight average diameter is preferably 80% or less, more preferably 50% or less, particularly preferably 30% or less.

The organic acid silver salt grain solid dispersion used for the present invention consists at least of a silver salt of an organic acid and water. While the ratio of the silver salt of an organic acid and water is not particularly limited, the ratio of the silver salt of an organic acid is preferably in the range of 5–50 weight %, particularly preferably 10–30 weight %, with respect to the total weight. While it is preferred that the aforementioned dispersing agent should be used, it is preferably used in a minimum amount within a range suitable for minimizing the grain size, and it is preferably used in an amount of 0.5–30 weight %, particularly preferably 1–15 weight %, with respect to the silver salt of an organic acid.

The silver salt of an organic acid for use in the present invention may be used in any desired amount. However, it is preferably used in an amount of from 0.1–5 $g/m^2$, more preferably from 1–3 $g/m^2$, in terms of silver.

In the present invention, metal ions selected from Ca, Mg, Zn and Ag are preferably added to the non-photosensitive silver salt of an organic acid. The metal ions selected from Ca, Mg, Zn and Ag are preferably added to the non-photosensitive silver salt of an organic acid in the form of a water-soluble metal salt, not a halide compound. Specifically, they are preferably added in the form of nitrate or sulfate. Addition of halide is not preferred, since it degrades image storability, i.e., so-called printing-out property, of the photothermographic material against light (indoor light, sun light etc.) after the development. Therefore, in the present invention, it is preferable to add the ions in the form of water-soluble metal salts, which are not halide compounds.

The metal ions selected from Ca, Mg, Zn and Ag, which are preferably used in the present invention, may be added any time after the formation of non-photosensitive organic acid silver salt grains and immediately before the coating operation, for example, immediately after the formation of grains, before dispersion, after dispersion, before and after the formation of coating solution and so forth. They are preferably added after dispersion, or before or after the formation of coating solution.

In the present invention, the metal ions selected from Ca, Mg, Zn and Ag are preferably added in an amount of $10^{-3}$ to $10^{-1}$ mole, particularly $5\times10^{-3}$ to $5\times10^{-2}$ mole, per one mole of non-photosensitive silver salt of an organic acid.

The photosensitive silver halide used for the present invention is not particularly limited as for the halogen composition, and silver chloride, silver chlorobromide, silver bromide, silver iodobromide, silver chloroiodobromide and so forth may be used. As for the preparation of grains of the photosensitive silver halide emulsion, the grains can be prepared by the method described in JP-A-11-119374, paragraphs 0127–0224. However, the method is not particularly limited to this method.

Examples of the form of silver halide grains include a cubic form, octahedral form, tetradecahedral form, tabular form, spherical form, rod-like form, potato-like form and so forth. In particular, cubic grains and tabular grains are preferred for the present invention. As for the characteristics of the grain form such as aspect ratio and surface index of the grains, they may be similar to those described in JP-A-11-119374, paragraph 0225. Further, the halide composition may have a uniform distribution in the grains, or the composition may change stepwise or continuously in the grains. Silver halide grains having a core/shell structure may also be preferably used. Core/shell grains having preferably a double to quintuple structure, more preferably a double to quadruple structure may be used. A technique for localizing silver bromide on the surface of silver chloride or silver chlorobromide grains may also be preferably used.

The grain size of the silver halide grains of the photosensitive silver halide used in the present invention is not particularly limited. However, a smaller grain size is more preferred in order to suppress cloudiness after the image formation, and specifically, the grain size is preferably 0.12 $\mu$m or less, more preferably 0.01–0.1 $\mu$m.

As for the grain size distribution of the silver halide grains that can be used in the present invention, the grains show monodispersion degree of 30% or less, preferably 1–20%, more preferably 5–15%. The monodispersion degree used herein is defined as a percentage (%) of a value obtained by dividing standard deviation of grain size with average grain size (variation coefficient). The grain size of the silver halide grains is represented as a ridge length for cubic grains, or a diameter as circle of projected area for the other grains (octahedral grains, tetradecahedral grains, tabular grains and so forth) for convenience.

The photosensitive silver halide grains that can be used in the present invention preferably contain a metal of Group VII or Group VIII in the periodic table of elements or a complex of such a metal. The metal or the center metal of the complex of a metal of Group VII or Group VIII of the periodic table is preferably rhodium, rhenium, ruthenium, osmium or iridium. Particularly preferred metal complexes are $(NH_4)_3Rh(H_2O)Cl_5$, $K_2Ru(NO)Cl_5$, $K_3IrCl_6$ and $K_4Fe(CN)_6$. The metal complexes may be used each alone, or two or more complexes of the same or different metals may also be used in combination. The content is preferably from $1\times10^{-9}$ to $1\times10^{-3}$ mole, more preferably $1\times10^{-8}$ to $1\times10^{-4}$ mole, per mole of silver. As for specific structures of metal complexes, metal complexes of the structures described in JP-A-7-225449 and so forth can be used. Types and addition methods of these heavy metals and complexes thereof are described in JP-A-11-119374, paragraphs 0227–0240.

The photosensitive silver halide grains may be desalted by washing methods with water known in the art, such as the noodle washing and flocculation. However, the grain may not be desalted in the present invention.

Silver halide emulsions used in the present invention may be added with thiosulfonic acid compounds by the method described in EP-A-293917A.

As gelatin used with the photosensitive silver halide used in the present invention, low molecular weight gelatin is preferably used in order to maintain good dispersion state of the silver halide emulsion in a coating solution containing a silver salt of an organic acid. The low molecular weight gelatin has a molecular weight of preferably 500–60,000, more preferably 1,000–40,000. While such low molecular weight gelatin may be added during the formation of grains or dispersion operation after the desalting treatment, it is preferably added during dispersion operation after the desalting treatment. It is also possible to use ordinary gelatin (molecular weight of about 100,000) during the grain formation and use low molecular gelatin during dispersion operation after the desalting treatment.

While the concentration of dispersion medium may be 0.05–20 weight %, it is preferably in the range of 5–15 weight % in view of handling. As for type of gelatin, alkali-treated gelatin is usually used. Besides that, however, acid-treated gelatin, modified gelatin such as phthalated gelatin and so forth can also be used.

In the photosensitive material used for the present invention, one kind of photosensitive silver halide emulsion may be used or two or more different emulsions (for example, those having different average grain sizes, different halogen compositions, different crystal habits or those subjected to chemical sensitization under different conditions) may be used in combination.

The amount of the photosensitive silver halide per mole of the silver salt of an organic acid is preferably from 0.01–0.5 mole, more preferably from 0.02–0.3 mole, still more preferably from 0.03–0.25 mole. Methods and conditions for mixing photosensitive silver halide and silver salt of an organic acid, which are prepared separately, are not particularly limited so long as the effect of the present invention can be attained satisfactorily. Examples thereof include, for example, a method of mixing silver halide grains and silver salt of an organic acid after completion of respective preparations by using a high-speed stirring machine, ball mill, sand mill, colloid mill, vibrating mill, homogenizer or the like, or a method of preparing a silver salt of an organic acid with mixing a photosensitive silver halide obtained separately at any time during the preparation of the silver salt of an organic acid. For the mixing of them, mixing of two or more kinds of aqueous dispersions of the silver salt of an organic acid and two or more kinds of aqueous dispersions of the photosensitive silver salt is preferably used for controlling photographic properties.

As a sensitizing dye that can be used for the present invention, there can be advantageously selected those sensitizing dyes that can spectrally sensitize silver halide grains within a desired wavelength range after they are adsorbed by the silver halide grains and have spectral sensitivity suitable for spectral characteristics of the light source to be used for exposure. For example, as dyes that spectrally sensitize in a wavelength range of 550 nm to 750 nm, there can be mentioned the compounds of formula (II) described in JP-A-10-186572, and more specifically, dyes of II-6, II-7, II-14, II-15, II-18, II-23 and II-25 mentioned in the same can be exemplified as preferred dyes. As dyes that spectrally sensitize in a wavelength range of 750 nm to 1400 nm, there can be mentioned the compounds of formula (a) described in JP-A-11-119374, and more specifically, dyes of (25), (26), (30) (32), (36), (37), (41), (49) and (54) mentioned in the same can be exemplified as preferred dyes. Further, as dyes forming J-band, those disclosed in U.S. Pat. Nos. 5,510,236, 3,871,887 (Example 5), JP-A-2-96131 and JP-A-59-48753 can be exemplified as preferred dyes. These sensitizing dyes can be used each alone, or two or more of them can be used in combination.

These sensitizing dyes can be added by the method described in JP-A-11-119374, paragraph 0106. However, the method is not particularly limited to this method.

While the amount of the sensitizing dye used in the present invention may be selected to be a desired amount depending on the performance including sensitivity and fog, it is preferably used in an amount of $10^{-6}$ to 1 mole, more preferably $10^{-4}$ to $10^{-1}$ mole, per mole of silver halide in the photosensitive layer.

In the present invention, a supersensitizer can be used in order to improve spectral sensitization efficiency. Examples of the supersensitizer used for the present invention include the compounds disclosed in EP-A-587338A, U.S. Pat. Nos. 3,877,943 and 4,873,184, and compounds selected from heteroaromatic or aliphatic mercapto compounds, heteroaromatic disulfide compounds, stilbenes, hydrazines, triazines and so forth.

Particularly preferred supersensitizers are heteroaromatic mercapto compounds and heteroaromatic disulfide compounds disclosed in JP-A-5-341432, the compounds represented by the formulas (a) and (II) mentioned in JP-A-4-182639, stilbene compounds represented by the formula (a) mentioned in JP-A-10-111543 and the compounds represented by the formula (a) mentioned in JP-A-11-109547. Specifically, there can be mentioned the compounds of M-1 to M-24 mentioned in JP-A-5-341432, the compounds of d-1) to d-14) mentioned in JP-A-4-182639, the compounds of SS-01 to SS-07 mentioned in JP-A-10-111543 and the compounds of 31, 32, 37, 38, 41–45 and 51–53 mentioned in JP-A-11-109547.

These supersensitizers can be added to the emulsion layer preferably in an amount of $10^{-4}$ to 1 mole, more preferably in an amount of 0.001–0.3 mole per mole of silver halide.

The photothermographic material of the present invention is partly characterized by containing at least one organic gold compound. While time of adding the organic gold compound is not particularly limited during the production process of the photothermographic material, it is preferably added during the chemical sensitization.

Compounds represented by the following formula (4) are preferably used as the organic gold compound for the photothermographic material of the present invention.

$$[Au(L)_2]^{+X^-} \qquad \text{Formula (4)}$$

In the aforementioned formula (4) L represents a ligand, two of L may be identical to or different from each other, and at least one of L represents a mesoion ligand. $X^-$ represents an anion such as halogen ion and $BF^{4-}$. However, $X^-$ is not limited to a monovalent anion.

While these compounds can be dissolved in various solvents including water and organic solvents (e.g., acetone, methanol) preferred compounds are water-soluble compounds. The term "water-soluble" used in the present specification means that an organic gold compound is dissolved at a concentration of at least $10^{-5}$ mol/L under the standard pressure at a temperature of 20° C.

In the aforementioned formula (4), the mesoion ligand represented by L forms a coordinate bond with the gold(I) ion to form an organic gold compound that is water-soluble and enables chemical sensitization of a silver halide photographic composition. As the aforementioned mesoion ligand, a ligand represented by the following formula is preferred.

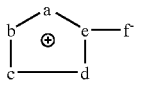

In the formula, the circle including the symbol of + in the heterocyclic ring symbolizes six delocalized π electrons that are combined with partial positive charges on the heterocyclic ring.

In the formula, a, b, c, d and e represent substituted or unsubstituted atoms required to complete the mesoion ligand, for example, carbon and nitrogen atoms required to complete a mesoion triazolium or tetrazolium 5-membered heterocyclic ring. The constitutional components of the heterocyclic ring (a, b, c, d and e) can be selected from a $CR^5$ group, $NR^{5'}$ group, a nitrogen atom and a chalcogen atom. The symbol of minus represents additional two electrons on the exocyclic group f coupled with the six π electrons on the heterocyclic ring. There exists delocalization over a wide range, and the represented charges account for only a small part of charges. The exocyclic group f is preferably any one selected from S, Se and $R^{5''}$. $R^5$ represents a hydrogen atom, a substituted or unsubstituted alkyl group, aryl group or heterocyclic group. $R^{5'}$ represents a hydrogen atom, a substituted or unsubstituted alkyl group, aryl group or heterocyclic group. $R^{5''}$ represents a substituted or unsubstituted alkyl group, aryl group or heterocyclic group. Further, $R^5$, $R^{5'}$ and $R^{5''}$ may bond together to constitute another ring.

As the aforementioned mesoion ligand, those described by Ollis and Ramsden in Advances in Heterocyclic Chemistry, vol. 19, Academic Press, London (1976) can also be used. The mesoion ligand represented by the aforementioned formula can coordinate gold(I) via the exocyclic group f. In view of the stability of the organic gold compound, it is preferred that the exocyclic group f should not be O (oxygen atom).

Although the aforementioned formula representing the mesoion ligand includes the circle representing six delocalized π electrons of the heterocyclic ring moiety, it does not mean aromaticity.

Compounds represented by the following formula (4a) are included in the compounds represented by the aforementioned formula (4).

Formula (4a)

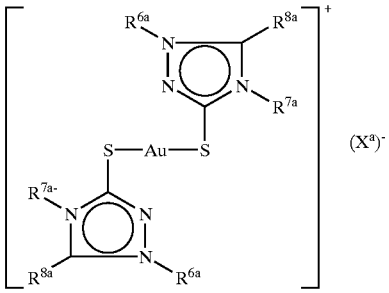

In the formula, $R^{6a}$, $R^{7a}$ and $R^{8a}$ each independently represent a substituted or unsubstituted alkyl group, a substituted or unsubstituted alkenyl group, an amino group or a substituted or unsubstituted aryl group. $(X^a)^-$ represents a halogen ion or $BF^{4-}$. Preferred compounds are shown in the table mentioned below.

TABLE 1

| Comp'd | $R^{6a}$ | $R^{7a}$ | $R^{8a}$ | $(X^a)^-$ |
|---|---|---|---|---|
| I-1 | $CH_3$ | $CH_3$ | $CH_3$ | $BF_4^-$ |
| I-2 | $CH_3$ | $CH_3$ | $CH_3$ | $I^-$ |
| I-3 | $CH_3$ | $CH_3$ | $CH_3$ | $Br^-$ |
| I-4 | $CH_3$ | $CH_3$ | $CH_3$ | $Cl^-$ |
| I-5 | $CH_3$ | $CH_2CH{=}CH_2$ | $CH_3$ | $BF_4^-$ |
| I-6 | $CH_3$ | $CH_2CHOCH_3$ | $CH_3$ | $BF_4^-$ |
| I-7 | $CH_3$ | $NH_2$ | $CH_3$ | $BF_4^-$ |
| I-8 | $CH_3$ | $C_4H_9$ | $CH_3$ | $BF_4^-$ |
| I-9 | $CH_3$ | $C_6H_{11}$ | $CH_3$ | $BF_4^-$ |
| I-10 | $CH_3$ | $C_6H_5$ | $CH_3$ | $BF_4^-$ |

Further, the compounds represented-by the aforementioned formula (4) include compounds represented by the following formula (4b).

Formula (4b)

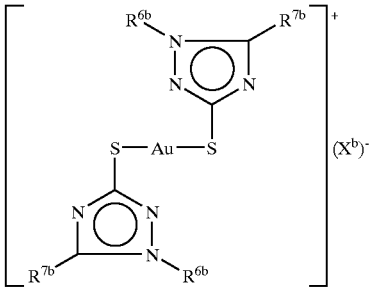

$R^{6b}$, $R^{7b}$ and $(X^b)^-$ have the same meanings as the aforementioned $R^{6a}$, $R^{7a}$ and $(X^a)^-$, respectively. Preferred compounds are shown in the table mentioned below.

TABLE 2

| Comp'd | $R^{6b}$ | $R^{7b}$ | $(X^b)^-$ |
|---|---|---|---|
| I-11 | $C_6H_5$ | $C_6H_5$ | $BF_4^-$ |

The compounds represented by the aforementioned formula (4) include compounds represented by the following formula (4c).

Formula (4c)

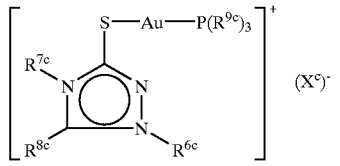

In the formula, $R^{6c}$, $R^{7c}$, $R^{8c}$ and $R^{9c}$ each independently represent a substituted or unsubstituted alkyl group, a substituted or unsubstituted alkenyl group, an amino group or a substituted or unsubstituted aryl group. $(X^c)^-$ represents a halogen or $BF^{4-}$. Preferred compounds are shown in the table mentioned below.

TABLE 3

| Comp'd | $R^{6c}$ | $R^{7c}$ | $R^{8c}$ | $R^{9c}$ | $(X^c)^-$ |
|---|---|---|---|---|---|
| I-12 | $CH_3$ | $CH_3$ | $CH_3$ | $CH_3$ | $Cl^-$ |
| I-13 | $CH_3$ | $CH_3$ | $CH_3$ | $CH_3$ | $BF_4^-$ |
| I-14 | $CH_3$ | $CH_2CH = CH_2$ | $CH_3$ | $CH_3$ | $BF_4^-$ |

Mesoion compounds used as starting materials for producing the organic gold compounds containing the aforementioned mesoion ligand can be produced by the method disclosed in U.S. Pat. No. 4,378,424 (1983) of Altrand, Dedio and McSweeney or any one of the methods described in the review of Ollis and Ramsden and the references cited therein. Synthesis of the organic gold compounds can be performed by various techniques known in this technical field. For example, a method comprising reacting a gold(I) precursor compound and a suitable amount of a mesoion compound is preferred. In the subsequent reaction, which is generally performed at room temperature (about 20° C.) or a temperature slightly higher than room temperature for several minutes, a ligand of the gold (I) precursor compound is replaced with a mesoion ligand having higher affinity for gold (I) Then, the product can be separated and purified by crystallographic techniques.

Various substituents on the mesoion ligand influence solubility of the organic gold compound as the end product. The most desirable organic gold compounds are those that are soluble in water and can be produced in water. Further, an aqueous emulsion can also be sensitized by using one soluble in an organic solvent such as acetone, and an emulsion can also be sensitized by using a non-aqueous medium. Such gold compounds are described in more detail in U.S. Pat. No. 5,049,485.

It is also preferable to use an organic mercapto gold (I) complex represented by the following formula (5) or (6) as the organic gold compound for the photothermographic material of the present invention.

$$[L\text{-}Au\text{-}L]M \qquad \text{Formula (5)}$$

This complex has a symmetrical form, i.e., two of L are identical to each other. In the formula, L represents an organic mercapto ligand. L is an organic mercapto ligand suitable for use in a silver halide photographic element, and it has antifogging property, stability or sensitization property. Many of such ligands are known in this technical field, and all of them are marketed or can be produced by the method described in Research Disclosure, 274 (1984). Preferred examples of L include thiol ligands having a hydrophilic substituent such as mercaptoazoles, and examples thereof are disclosed in U.S. Pat. Nos. 3,266,897, 4,607,004, 3,266,897, 4,920,043, 4,912,026, 5,011,768 and British Patent No. 1,275,701.

In the formula, M represents a cationic counter ion. M is preferably an alkali metal ion (e.g., potassium ion, sodium ion or cesium ion) or an ammonium cation (e.g., tetrabutyl or tetraethylammonium cation).

$$[(M\text{-}R^{sol})_n\text{-}A\text{-}S\text{—}Au\text{—}S\text{-}A\text{-}(R^{sol}\text{-}M)_n]M \qquad \text{Formula (6)}$$

In the formula, $R^{sol}$ represents a hydrophilic group. As the hydrophilic group $R^{sol}$, —$OSO_3$—, —$SO_3$—, —$SO_2$—, —$PO_3$— or —COO— is preferred. n represents any one of 1–4, and when n is 2 or larger, n of ($R^{sol}$-M) may be identical to or different from each other or one another, provided that the complex has a symmetrical form.

M represents a cationic counter ion. M is preferably an alkali metal ion (e.g., potassium ion, sodium ion or cesium ion) or an ammonium cation (e.g., tetrabutyl or tetraethylammonium cation).

In the formula, A represents a substituted or unsubstituted divalent organic group. A is preferably an aliphatic (cyclic type or non-cyclic type), aromatic or heterocyclic divalent group. A may further have a substituent.

When A is an aliphatic group, A is preferably substituted or unsubstituted aliphatic group having 1–20 carbon atoms, more preferably 1–8 carbon atoms. Preferred examples of the group include an alkylene group (e.g., ethylene group, methylene group, propylene group, butylene group, pentylene group, hexylene group, octylene group, 2-ethylhexylene group, decylene group, dodecylene group, hexadecylene group, octadecylene group, cyclohexylene group, isopropylene group and tert-butylene group).

When A is an aromatic group, A is preferably an aromatic group having 6–20 carbon atoms, more preferably an aromatic group having 6–10 carbon atoms, particularly preferably a phenylene group or naphthylene group. When A is a heterocyclic group, A is preferably a substituted or unsubstituted divalent 3- to 15-membered ring containing at least one atom selected from nitrogen, oxygen, sulfur, selenium and tellurium in the ring nucleus, more preferably a 5- or 6-membered ring containing at least one (particularly preferably 2 or more) nitrogen atom. Examples of the heterocyclic group include divalent groups derived from pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazol, tetrazole, oxadiazole or thiadiazole ring. A preferred heterocyclic group is one derived from tetrazole.

Unless otherwise indicated, substituents that can exist on the aforementioned compounds include any substituted or unsubstituted groups that do not degrade characteristics required for photographic practicality. When the term "group" is used for referring to a substituent containing a substitutable hydrogen, it is intended that it should include not only the unsubstituted form of the substituent, but also a substituted form of the substituent having any one (or two or more) of the groups mentioned herein. Such groups are preferably bonded to a residue of the compound via an atom of carbon, silicon, oxygen, nitrogen, phosphorus or sulfur.

Examples of suitable substituents of A include, for example a halogen such as chlorine, bromine or fluorine; nitro; hydroxyl; cyano; carboxyl; or a group that may be further substituted, for example, an alkyl group including a straight or branched alkyl (e.g., methyl group, trifluoromethyl group, ethyl group, tert-butyl group, 3-(2,4-di-tert-amylphenoxy)-propyl group and tetradecyl group); an alkenyl group such as ethylene group and 2-butene group; an alkoxy group such as methoxy group, ethoxy group, propoxy group, butoxy group, 2-methoxyethoxy group, sec-butoxy group, hexyloxy group, 2-ethylhexyloxy group, tetradecyloxy group, 2-(2,4-di-tert-pentylphenoxy)ethoxy group and 2-dodecyloxyethoxy group; an aryl group such as phenyl group, 4-tert-butylphenyl group, 2,4,6-trimethylphenyl group and naphthyl group; an aryloxy group such as phenoxy group, 2-methylphenoxy group, a- or β-naphthyloxy group and 4-tolyloxy group; a carbonamido group such as acetamido group, benzamido group, butylamido group, tetradecanamido group, a-(2,4-di-tert-pentylphenoxy) acetamido group, a-(2,4-di-tert-pentylphenoxy)butylamido group, a-(3-pentadecylphenoxy)-hexanamido group, a-(4-hydroxy-3-tert-butylphenoxy)-tetradecanamido group, 2-oxo-pyrrolidin-1-yl group, 2-oxo-5-tetradecylpyrrolin-1-yl group, N-methyltetradecanamido group, N-succinimido group, N-phthalimido group, 2,5-dioxo-1-oxazolidinyl group, 3-dodecyl-2,5-dioxo-1-imidazolyl group, N-acetyl-N-dodecylamino group, ethoxy-carbonylamino group, phenoxycarbonylamino group, benzyloxycarbonylamino group, hexadecyloxycarbonylamino group, 2,4-di-tert-butylphenoxycarbonylamino group, phenylcarbonylamino group, 2,5-(di-tert-pentylphenyl)carbonylamino group, p-dodecylphenylcarbonylamino group, p-toluylcarbonylamino group, N-methylureido group, N,N-dimethylureido group, N-methyl-N-dodecylureido group, N-hexadecylureido group, N,N-dioctadecylureido group, N,N-dioctyl-N'-ethylureido group, N-phenylureido group, N,N-diphenylureido group, N-phenyl-N-p-toluylureido group, N-(m-hexadecylphenyl)ureido group, N,N-(2,5-di-tert-pentylphenyl)-N'-ethylureido group and tert-butylcarbonamide; a sulfonamido group such as methylsulfonamido group, benzenesulfonamido group, p-toluylsulfonamido group, p-dodecylbenzenesulfonamido group, N-methyltetradecylsulfonamido group, N,N-dipropylsulfamoylamino group and hexadecylsulfonamido group; a sulfamoyl group such as N-methylsulfamoyl group, N-ethylsulfamoyl group, N,N-dipropylsulfamoyl group, N-hexadecylsulfamoyl group, N,N-dimethylsulfamoyl group, N-[3-(dodecyloxy)propyl]sulfamoyl group, N-[4-(2,4-di-tert-pentylphenoxy)butyl]sulfamoyl group, N-methyl-N-tetradecylsulfamoyl group and N-dodecylsulfamoyl group; a carbamoyl group such as N-methylcarbamoyl group, N,N-dibutylcarbamoyl group, N-octadecylcarbamoyl group, N-[4-(2,4-di-tert-pentylphenoxy)butyl]carbamoyl group, N-methyl-N-tetradecylcarbamoyl group and N,N-dioctylcarbamoyl group; an acyl group such as acetyl group, (2,4-di-tert-amylphenoxy) acetyl group, phenoxycarbonyl group, p-dodecyloxyphenoxycarbonyl group, methoxycarbonyl group, butoxycarbonyl group, tetradecyloxycarbonyl group, ethoxycarbonyl group, benzyloxycarbonyl group, 3-pentadecyl-oxycarbonyl group and dodecyloxycarbonyl group; a sulfonyl group such as methoxysulfonyl group, octyloxysulfonyl group, tetradecyloxysulfonyl group, 2-ethylhexyloxysulfonyl group, phenoxysulfonyl group, 2,4-di-tert-pentylphenoxysulfonyl group, methylsulfonyl group, octylsulfonyl group, 2-ethylhexylsulfonyl group, dodecylsulfonyl group, hexadecylsulfonyl group, phenylsulfonyl group, 4-nonylphenylsulfonyl group and p-toluylsulfonyl group; a sulfonyloxy group such as dodecylsulfonyloxy group and hexadecylsulfonyloxy group; a sulfinyl group such as methylsulfinyl group, octylsulfinyl group, 2-ethylhexylsulfinyl group, dodecylsulfinyl group, hexadecylsulfinyl group, phenylsulfinyl group, 4-nonylphenylsulfinyl group and p-toluylsulfinyl group; a thio group such as ethylthio group, octylthio group, benzylthio group, tetradecylthio group, 2-(2,4-di-tert-pentylphenoxy)ethylthio group, phenylthio group, 2-butoxy-5-tert-octylphenylthio group, and p-toluylthio group; an acyloxy group such as acetyloxy group, benzoyloxy group, octadecanoyloxy group, p-dodecylamidobenzoyloxy group, N-phenylcarbamoyloxy group, N-ethylcarbamoyloxy group and cyclohexylcarbonyloxy group; an amine group such as phenylanilino group, 2-chloroanilino group, diethylamine group and dodecylamine group; an imino group such as 1-(N-phenylimido) ethyl group, N-succinimido group and 3-benzylhydantoinyl group; a phosphate group such as dimethylphosphate group and ethylbutylphosphate group; a phosphite group such as diethylphosphite group and dihexylphosphite group; a heterocyclic group, heterocyclyloxy group or heterocyclylthio group having a 3- to 7-membered heterocyclic ring constituted by carbon atoms and at least one hetero atom selected from the group consisting of oxygen, nitrogen and sulfur, which may be substituted, such as 2-furyl group, 2-thienyl group, 2-benzoimidazolyloxy group and 2-benzothiazolyl group; a quaternary ammonium group such as triethylammonium group; and a silyloxy group such as trimethylsilyloxy group. A particularly preferred substituent of A is benzamido group.

The aforementioned groups and the substituents thereof have generally 48 carbon atoms at most, typically 1–36 carbon atoms, usually less than 24 carbon atoms. However, depending on a specific substituent to be selected, they may have a further larger number of carbon atoms.

When A is substituted, $(R^{sol}\text{-}M)_n$ may be bonded to the substituent.

One class of preferred examples of $A\text{-}(R^{sol}\text{-}M)_n$ (n is 1 in this case) is represented by the following formula.

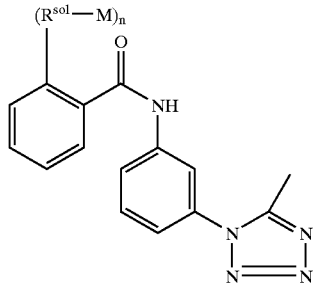

The followings are included in specific examples of the organic mercapto gold (I) complex represented by the compounds of the formulas (5) and (6). However, the gold (I) complexes that can be used for the present invention are not limited to these. In the following structural formulas, "Ac" represents acetyl group.

(A)

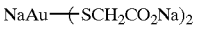

(B)

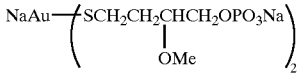

(C)

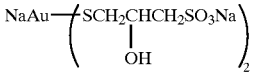

(D)

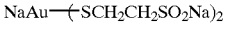

(E)

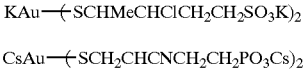

(F)

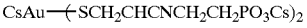

(G)

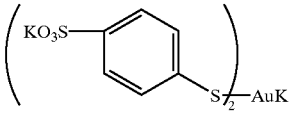

(H)

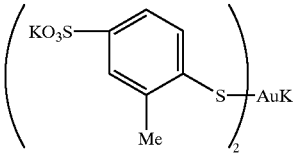

(I)

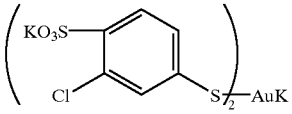

(J)

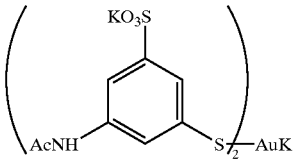

(K)

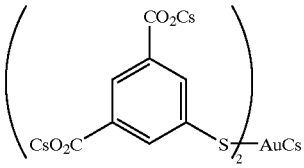

-continued (L)

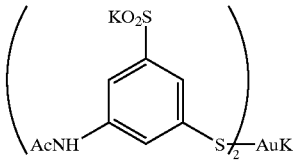

(M)

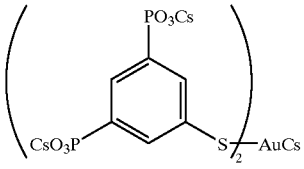

(N)

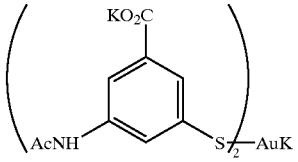

(O)

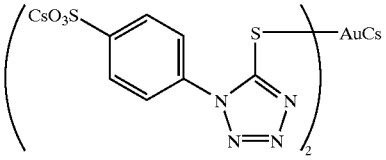

(P)

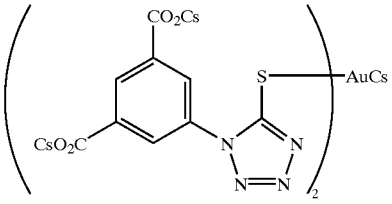

(Q)

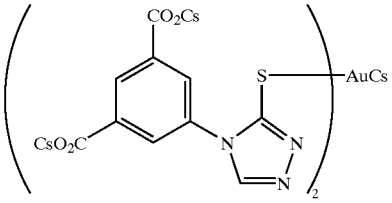

(R)

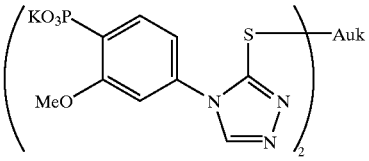

(S)

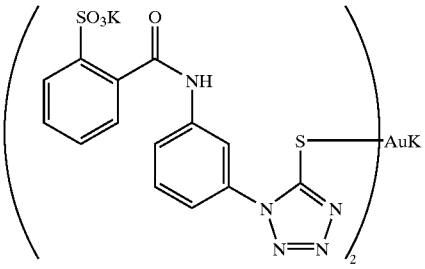

-continued (T)

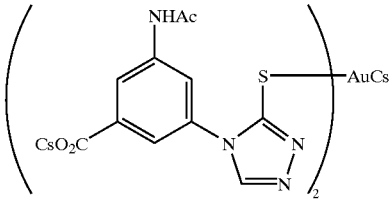

(U)

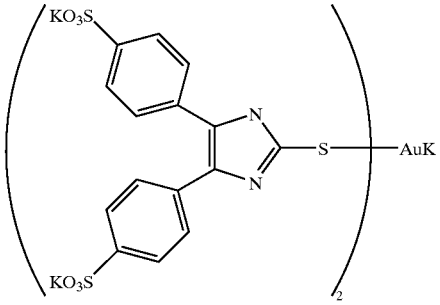

(V)

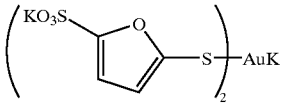

(X)

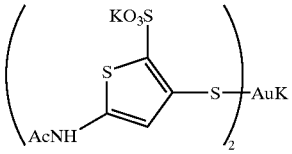

As the aforementioned organic mercapto gold (I) complex, Exemplary Compound (S), potassium bis(1-[3-(2-sulfonatobenzamido)phenyl]-5-mercaptotetrazole potassium salt) aurate (I) pentahydrate, is particularly preferred.

One of the advantages of the complex of the present invention is its solubility in water. It has solubility of preferably 2 g/L, more preferably 5 g/L, most preferably 10 g/L, at 22° C. Particularly preferred compounds have the solubility exceeding 20 g/L.

The aforementioned organic mercapto gold (I) complex is produced by allowing a gold (I) complex to react with an organic mercapto ligand and isolating the obtained organic mercapto gold (I) complex from a reaction mixture. Since a preferred gold (I) complex used for this method has an oxidation-reduction potential more positive than that of the desired organic mercapto gold(I) complex, substitution of the ligand becomes easier. Such compounds are known to those skilled in the art. Examples of useful gold (I) complexes include $AuCl^{2-}$, $AuBr^{2-}$, $Au(MeS—CH_2—CH_2—CHNH_2COOH)^{2+}$, $Au(CNS)^{2-}$, AuI and $Au(NH_3)^{2+}$, and AuI is particularly preferred.

Since the gold (I) complex may become somewhat unstable, it is preferable to produce the gold (I) complex immediately before use by allowing a gold (III) compound to react with a theoretical amount of a reducing agent. As the gold (III) compound, an arbitrary compound that can be reduced to form a stable gold(I) complex can be used. Many of such compounds are marketed. Preferred examples of the compounds include $KAuBr_4$, $KAuCl_4$ and $HAuCl_4$. The reducing agent may be, in particular, tetrahydrothiophene, 2,2'-thiodiethanol, thiourea, N,N'-tetramethylthiourea, alkyl sulfides (e.g., dimethyl sulfide, diethyl sulfide, diisopropyl sulfide), thiomorpholin-3-one, sulfite, hydrogen sulfite, uridine, uracil, hydrogenated alkalis or iodides (Uson, R.; Laguna, A.; Laguna, M., Inorg. Synth., 1989, 26, 85–91; Al-Saady, A. K.; McAuliffe, C. A.; Parish, R. V.; Sandbank, J. A., Inorg. Synth., 1985, 23, 191–194; Ericson, A.; Elding, L. I.; Elmroth, S. K. C.; J. Chem. Soc., Dalton Trans., 1997, 7, 1159–1164; Elding, L. I.; Olsson, L. F., Inorg. Chem., 1982, 21, 779–784; Annibale, G.; Canovese, L., Cattalini, L.; Natile, G. J., Chem. Soc., Dalton Trans., 1980, 7, 1017–1021). In certain cases, the reduction can be performed in the presence of a stabilizer such as potassium chloride (Miller, J. B.; Burmeister, J. L., Synth. React. Inorg. Met.-Org. Chem., 1985, 15, 223–233). In certain cases, it is preferable to isolate the obtained gold (I) compound (i.e., undesired side reaction is avoided). For example, in case of AuI, it is desirable to remove excess iodine in order to avoid the harmful sensitometry effect. Depending on the stability of the obtained gold (I) compound, isolation may not be practical.

While the reaction of the gold (I) complex and the organic mercapto ligand is preferably performed in an aqueous system, it is not essential as shown in the examples. In general, it is sufficient only to mix or stir the reactants for a short period of time preferably at a temperature slightly higher than room temperature, and any other operations are not required. The gold (I) compound is treated with at least 2 equivalents of water-soluble organic mercapto ligand (preferably a water-soluble salt of the ligand). In order to obtain a symmetrical organic mercapto gold (I) complex, one kind of organic mercapto ligand is used. The organic mercaptide ligand is preferably represented by the following formula.

$$(M\text{-}R^{sol})_n\text{-}A\text{-}S\text{-}M$$

In the formula, M, $R^{sol}$, A and n have the same meanings as M, $R^{sol}$ A and n mentioned in the aforementioned formula (6) respectively. A preferred organic mercaptide ligand is 1-[3-(2-sulfonatobenzamido)phenyl]-5-mercaptotetrazole potassium salt.

This reaction can be performed in an extremely wide temperature range, preferably from room temperature to 100° C., more preferably 30–50° C. Generally, the reaction can be performed at a natural pH of the reaction system, and pH adjustment is not required. A neutral pH of about 4–7.5 is preferred, and pH of about 6 is most preferred. In many cases, the reaction of the gold (I) complex and the organic mercapto ligand proceeds during only several minutes at a temperature of 30° C. However, it depends on the reactants. When an unstable gold (I) complex is used, in particular, the system can be stabilized by adding a stabilization electrolyte such as $Cl^-$ or $Br^-$.

The obtained gold (I) product can be isolated by treating a reaction mixture by using a suitable method, for example, by treating it with several equivalents of an alkali halide, or adding a water-miscible non-solvent. A preferred isolation method generally requires cooling of the reaction solution after introducing the alkali halide. The product is isolated by suction filtration and treated with cooled aqueous alcoholic washing solution comprising butanol, isopropanol, ethanol or the like. This procedure is simple and does not require complicated operation nor two or more times of recrystallization procedures.

In the present invention, it is preferable to use a compound represented by the following formula (7) during the chemical sensitization of the photosensitive silver halide. That is, it is preferred that the photosensitive silver halide used for the present invention should contain a compound represented by a formula (7).

Formula (7)

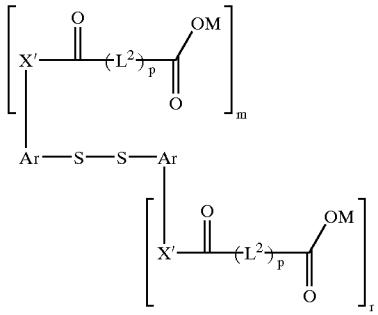

In the formula, X' independently represents —O—, —NH— or —NR—, and R represents an alkyl group, a fluoroalkyl group, an aryl group or a sulfonyl group, and m and r each independently represent 0, 1 or 2, provided that m and r do not simultaneously represent 0. M represents —H or a cationic chemical species, Ar represents an aromatic group, $L^2$ represents a bridging group, and p represents 0 or 1. In the aforementioned formula, (m+r) of X', M, $L^2$ or p as well as two of Ar may be identical to or different from each other or one another.

Ar represents a morocyclic aromatic group or an aromatic group having a condensed ring, and it has preferably 6–10 carbon atoms, more preferably 6 carbon atoms. Preferred examples of the aromatic group include a naphthyl group and a phenyl group. While Ar may be further substituted or unsubstituted, it is preferably substituted. Preferred examples of the substituent include an alkyl group (e.g., methyl group, ethyl group, hexyl group), a fluoroalkyl group (e.g., trifluoromethyl group), an alkoxy group (e.g., methoxy group, ethoxy group, octyloxy group), an aryl group (e.g., phenyl group, naphthyl group, tolyl group), hydroxyl group, a halogen atom, an aryloxy group (e.g., phenoxyl group), an alkylthio group (e.g., methylthio group, butylthio group), an arylthio group (e.g., phenylthio group), an acyl group (e.g., acetyl group, propionyl group, butyryl group, valeryl group), a sulfonyl group (e.g., methylsulfonyl group, phenylsulfonyl group), an acylamino group, a sulfonylamino group, an acyloxy group (e.g., acetoxy group, benzoxy group), carboxyl group, cyano group, sulfo group and an amino group. Preferred are a simple alkyl group and a simple acylamino group.

X' represents —O—, —NH— or —NR—. The most preferred X' is —NH—. When X' is —NR—, R is a substituent that does not inhibit the intended function of the disulfide compound in a photographic element, but maintains water-solubility of the compound. Preferred examples of the substituent include an alkyl group (e.g., methyl, ethyl, hexyl), a fluoroalkyl group (e.g., trifluoromethyl), an aryl group (e.g., phenyl, naphthyl, tolyl) and a sulfonyl group (e.g., methylsulfonyl, phenylsulfonyl). Preferred are a simple alkyl group and a simple fluoroalkyl group.

r and m independently represent 0, 1 or 2. Preferably, both of m and r represent 1. X' may be bonded to the aromatic group Aratanyposition with respect to the sulfur. The molecule preferably has a symmetrical form, and X' is preferably at a para- or ortho-position with respect to the sulfur in the aromatic group Ar.

$L^2$ represents a bridging group p represents 0 or 1. $L^2$ is preferably an unsubstituted alkylene group, and it is usually $—(CH_2)_n—$ (n is preferably in the range of 0–11, more preferably in the range of 1–3). Other examples of $L^2$ are shown below.

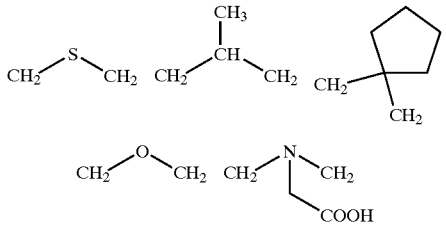

M represents a hydrogen atom or a cationic chemical species (in case that the ionized form contains a carboxyl group). Examples of the cationic chemical species include metal cations and organic cations. Examples of the organic cations include an ammonium ion (e.g., ammonium, tetramethylammonium, tetrabutylammonium), a phosphonium ion (e.g., tetraphenylphosphonium) and a guanidyl group. M is preferably a hydrogen atom or an alkali metal cation, and it is most preferably a sodium or potassium ion.

Examples of the disulfide compound represented by the aforementioned formula (7) (Exemplary Compounds II-A to II-Z) are shown below. Compounds II-A to II-H are preferred, and Compounds II-D and II-E are most preferred.

II-A

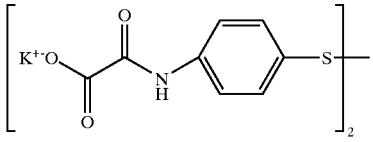

II-B

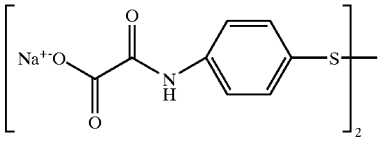

II-C

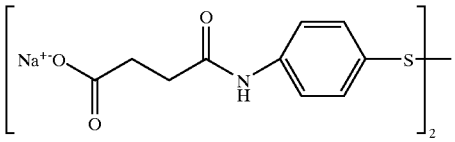

II-D

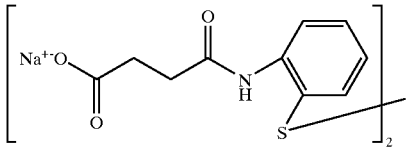

II-E

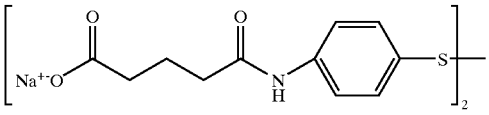

II-F

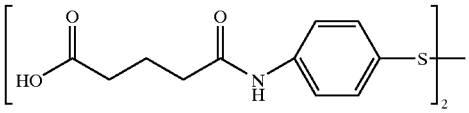

-continued

II-G

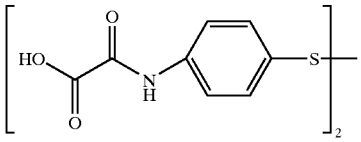

II-H

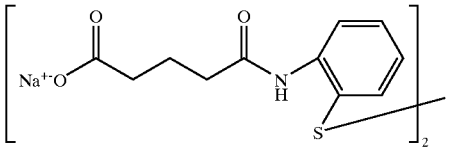

II-I

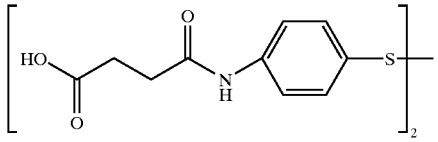

II-J

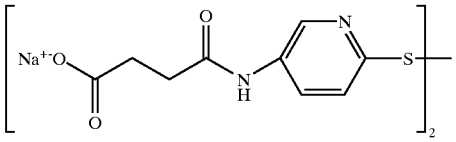

II-K

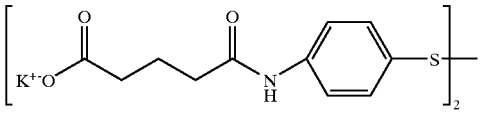

II-L

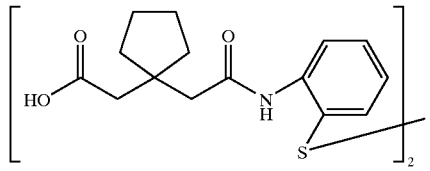

II-M

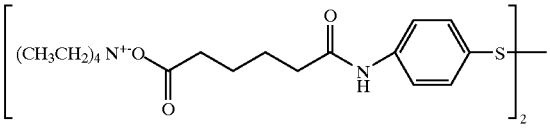

II-N

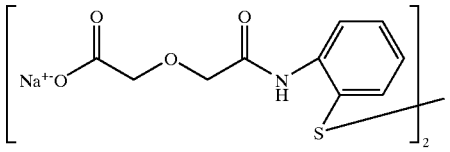

II-O

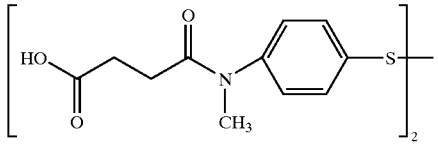

II-P

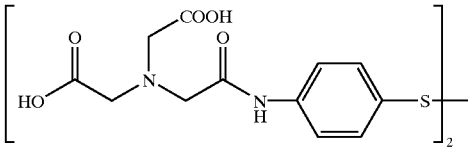

-continued

II-Q

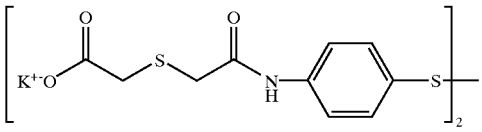

II-R

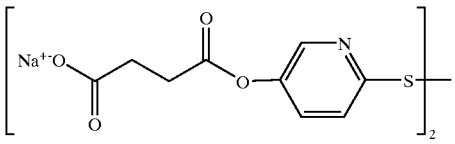

II-S

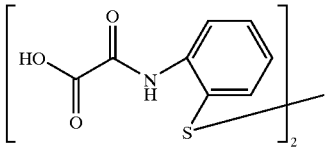

II-T

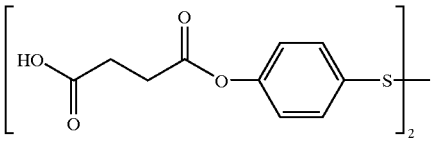

II-U

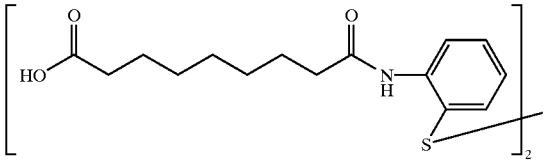

II-V

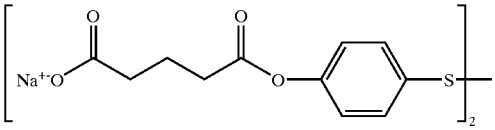

II-W

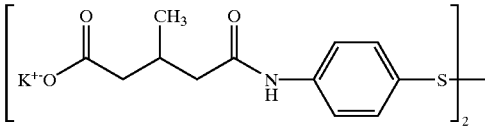

II-X

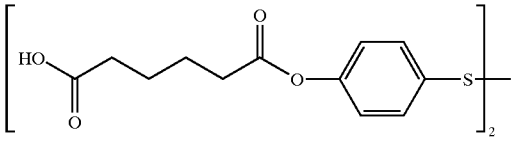

II-Y

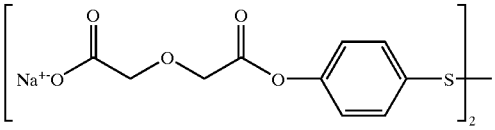

-continued

II-Z

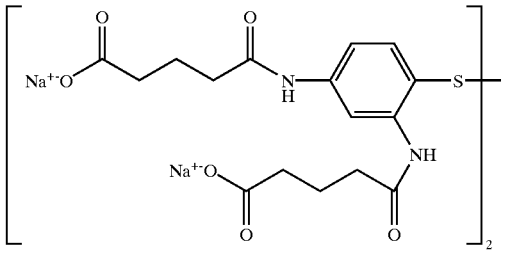

The disulfide compounds represented by the aforementioned formula (7) can be easily prepared by using readily available starting materials. Most of the aforementioned disulfide compounds can be obtained by allowing aminophenyl disulfide or hydroxyphenyl disulfide with a suitable cyclic acid anhydride and then converting the free diacid into its anionic form by using a certain substance such as sodium hydrogencarbonate. Other soluble disulfides can also be obtained by allowing aminophenyl disulfide or hydroxyphenyl disulfide to react with a monochloride of dicarboxylic acid monoester and then hydrolyzing the ester into a carboxylic acid. The aforementioned disulfide compounds are discussed in U.S. Pat. No. 5,418,127.

The photosensitive silver halide emulsions used for the present invention may be sensitized by also using chemical sensitization other than those mentioned above. For the chemical sensitization other than those mentioned above, the methods described in JP-A-11-119374, paragraphs 0242–0250 and U.S. Pat. No. 4,810,626 are preferably used.

Hereafter, (i) the compound producing imagewise a chemical species that can form development initiation points on and in the vicinity of the non-photosensitive silver salt of an organic acid, (ii) the compound that provides increase of developed silver grain density to a level of 200–5000% when it is added in an amount of 0.01 mol/mol of silver and (iii) the compound that provides increase of covering power to a level of 120–1000% when it is added in an amount of 0.01 mol/mol of silver will be explained. A compound that corresponds to any one of the compounds (i) to (iii) (except for hydrazine derivatives) is referred to as a "compound of the present invention" in the present specification.

First, (i) the compound producing imagewise a chemical species that can form development initiation points on and in the vicinity of the non-photosensitive silver salt of an organic acid will be explained. When the compound of (i) does not exist in a photosensitive material, physical development advances only on the silver halide formed by a latent image through light exposure. When the compound of (i) exists in a photosensitive material, a chemical species produced in connection with the physical development occurring on the silver halide formed by the latent image through light exposure, for example, an oxidized developing agent, and the compound of (i) react to form a chemical species that can form development initiation points on and in the vicinity of the non-photosensitive silver salt of an organic acid. This chemical species forms development initiation points on and in the vicinity of the non-photosensitive silver salt of an organic acid such as silver behenate, and physical development starts from there. That is, when the compound of (i) exists in a photosensitive material, physical development advances on the silver halide formed by the latent image through light exposure and in the vicinity of the non-photosensitive organic silver salt where development initiation points have been formed imagewise.

FIG. 1 shows results of electron micrography of a section of 2 $\mu$m sliced from a photothermographic material after development for a case where a compound of (i) existed in a photothermographic material in an amount of 0.01 mol/mol of silver (A) and a case where the compound did not exist in a photothermographic material (B). The photographed photothermographic material was the photothermographic material described in Japanese Patent Application No. 2000-393931, Example 1, Experiment No. 1 (it was the same as the photothermographic material described in Japanese Patent Application No. 2001-390779, Example 1, Experiment No. 1), and the development was performed as described in Example 1 of the same. From the results shown in FIG. 1, it is evident that the number of developed silver grains was markedly increased by adding the compound of the present invention.

Next, (ii) the compound that provides increase of developed silver grain density to a level of 200–5000% when it is added in an amount of 0.01 mol/mol of silver will be explained. Increased degree of the developed silver grain density can be obtained by photographing samples in which all silver ions in the photosensitive materials are reduced in the same manner as the photography of which results are shown in FIG. 1, counting numbers of developed silver grains per unit area and comparing the densities for the samples. When the compound of the present invention exists in a photosensitive material, the developed silver grain density increases to a level of 200–5000% compared with a case where the compound does not exist in a photosensitive material. More preferred compounds provide a developed silver grain density increasing ratio of 500–3000%.

Next, (iii) the compound that provides increase of covering power to a level of 120–1000% when it is added in an amount of 0.01 mol/mol of silver will be explained. The term "covering power" used in the present specification refers to a value obtained by dividing visible density with developed silver amount (g/m$^2$) for a sample in which all silver ions in the photosensitive material are reduced. The increase of covering power provided by the compound of the present invention is obtained by formation of a large number of smaller developed silver grains as seen from comparison of FIGS. 1(A) and (B). More preferred compounds provide a covering power increasing ratio of 150–500%.

The compound of the present invention is a compound other than hydrazine derivatives. If a hydrazine derivative is used as the aforementioned compounds of (i) to (iii), storability of the photothermographic material before development may be degraded or fog may be increased.

Specific examples of (i) the compound producing imagewise a chemical species that can form development initiation points on and in the vicinity of the non-photosensitive silver salt of an organic acid, (ii) the compound that provides increase of developed silver grain density to a level of 200–5000% when it is added and (iii) the compound that provides increase of covering power to a level of 120–1000% when it is added will be explained below.

Specific examples of the compound of the present invention include the substituted alkene derivatives, substituted isoxazole derivatives and particular acetal compounds represented by the formulas (1) to (3) mentioned in JP-A-2000-284399, and the cyclic compounds represented by the formula (A) or (B) mentioned in the same, specifically Compounds 1–72 mentioned in Chem. 8 to Chem. 12 of the same.

The compounds represented by the formula (1) mentioned in JP-A-11-149136 can be more preferably used as the compound of the present invention. Specific examples of the compounds represented by the formula (1) are shown below.

TABLE 4

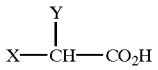

| X | Y: $CH_3$ | Ph | OH | $OCH_3$ | $Si(CH_3)_3$ |
|---|---|---|---|---|---|
| 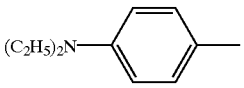 | 1a | 1b | 1c | 1d | 1e |
| 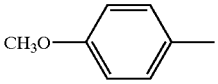 | 2a | 2b | 2c | 2d | 2e |
| 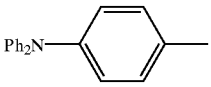 | 3a | 3b | 3c | 3d | 3e |
| 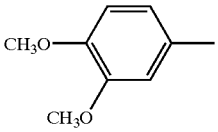 | 4a | 4b | 4c | 4d | 4e |
| 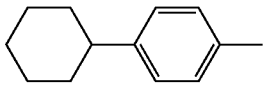 | 5a | 5b | 5c | 5d | 5e |
| 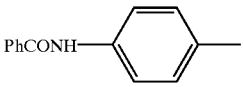 | 6a | 6b | 6c | 6d | 6e |
| 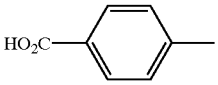 | 7a | 7b | 7c | 7d | 7e |
| 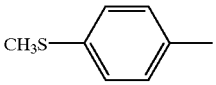 | 8a | 8b | 8c | 8d | 8e |
| 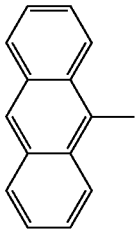 | 9a | 9b | 9c | 9d | 9e |

TABLE 5
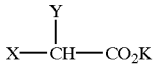
| X | Y: $CH_3$ | OH | Ph | H | $CH_2CO_2H$ |
|---|---|---|---|---|---|
| 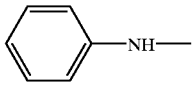 | 10a | 10b | 10c | 10d | 10e |
| 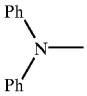 | 11a | 11b | 11c | 11d | 11e |
| $(C_2H_2)_2N$— | 12a | 12b | 12c | 12d | 12e |
| 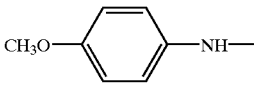 | 13a | 13b | 13c | 13d | 13e |
| 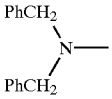 | 14a | 14b | 14c | 14d | 14e |
| 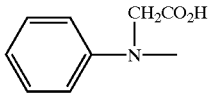 | 15a | 15b | 15c | 15d | 15e |
| 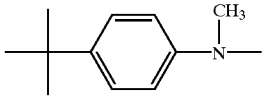 | 16a | 16b | 16c | 16d | 16e |
| 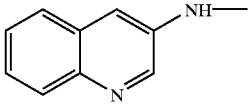 | 17a | 17b | 17c | 17d | 17e |
| 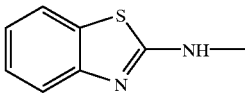 | 18a | 18b | 18c | 18d | 18e |
TABLE 6
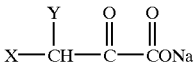
| X | Y: H | $CH_3$ | Ph | $OCH_3$ | $N(CH_3)_2$ |
|---|---|---|---|---|---|
| 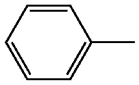 | 19a | 19b | 19c | 19d | 19e |
| 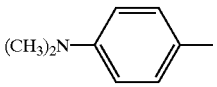 | 20a | 20b | 20c | 20d | 20e |
TABLE 6-continued
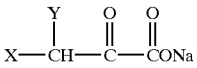
| X | Y: H | $CH_3$ | Ph | $OCH_3$ | $N(CH_3)_2$ |
|---|---|---|---|---|---|
| 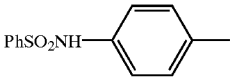 | 21a | 21b | 21c | 21d | 21e |
| 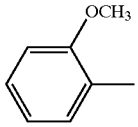 | 22a | 22b | 22c | 22d | 22e |
| 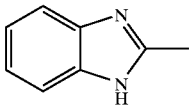 | 23a | 23b | 23c | 23d | 23e |
| 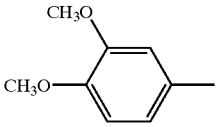 | 24a | 24b | 24c | 24d | 24e |
| 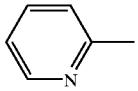 | 25a | 25b | 25c | 25d | 25e |
| 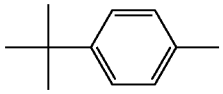 | 26a | 26b | 26c | 26d | 26e |
| 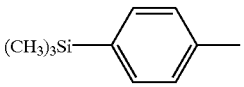 | 27a | 27b | 27c | 27d | 27e |
TABLE 7
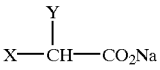
uz,14/32
| X | $CH_3$ | Ph | OH | $Si(CH_3)_3$ | $OCH_2$ |
|---|---|---|---|---|---|
| 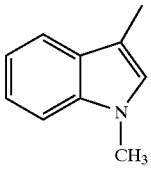 | 28a | 28b | 28c | 28d | 28e |
| 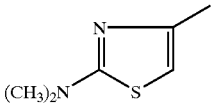 | 29a | 29b | 29c | 29d | 29e |

TABLE 7-continued
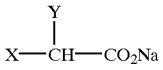
uz,14/32
| X | $CH_3$ | Ph | OH | $Si(CH_3)_3$ | $OCH_2$ |
|---|---|---|---|---|---|
| 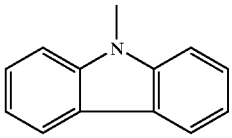 | 30a | 30b | 30c | 30d | 30e |
| 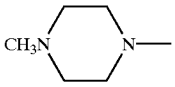 | 31a | 31b | 31c | 31d | 31e |
| 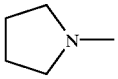 | 32a | 32b | 32c | 32d | 32e |
| 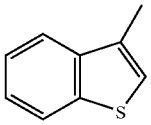 | 33a | 33b | 33c | 33d | 33e |
| 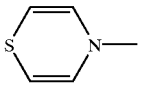 | 34a | 34b | 34c | 34d | 34e |
| 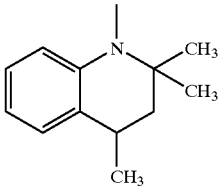 | 35a | 35b | 35c | 35d | 35e |
| 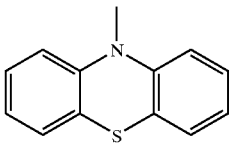 | 36a | 36b | 36c | 36d | 36e |
TABLE 8
37
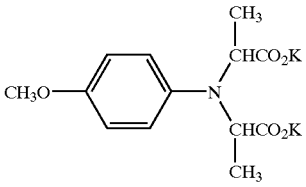
38
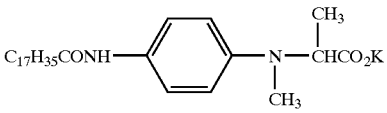
TABLE 8-continued
39
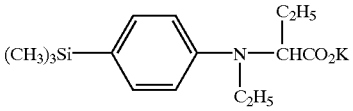
40
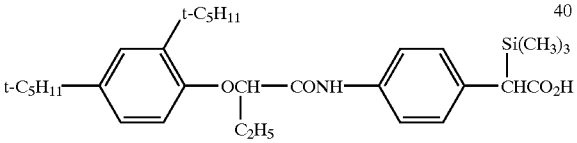
41
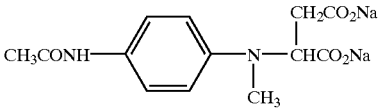
42
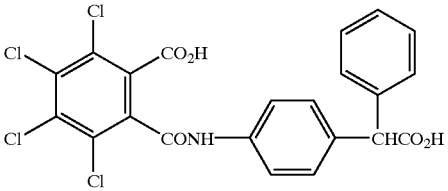
43
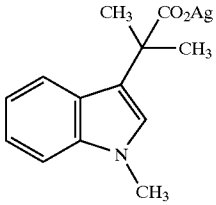
44
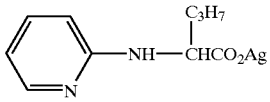
45
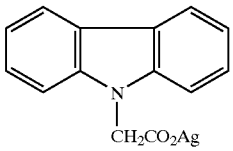
TABLE 9
46
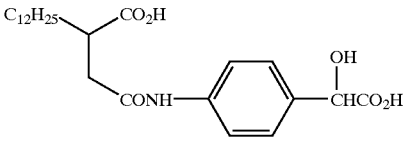
47
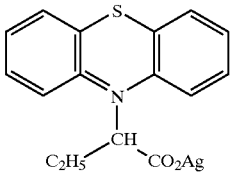

TABLE 9-continued
48
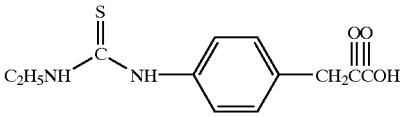
49
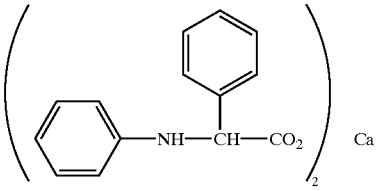
50
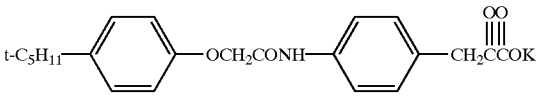
51
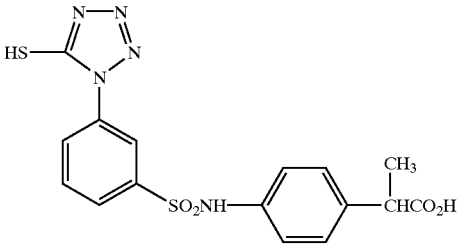
52
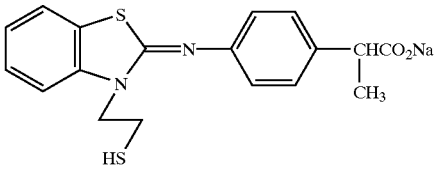
53
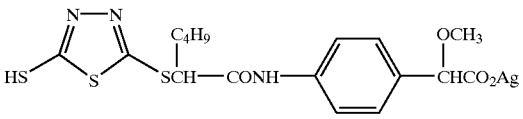
54
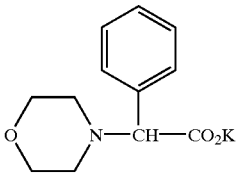
TABLE 10
55
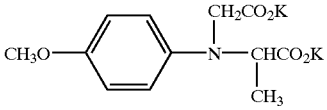
56
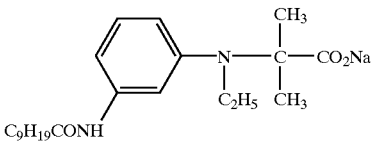
TABLE 10-continued
57
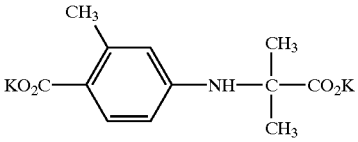
58
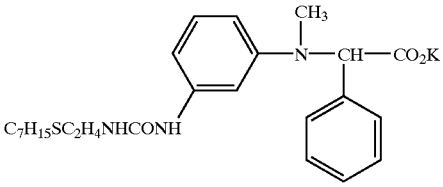
59
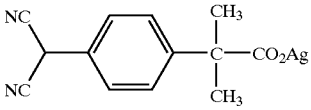
60
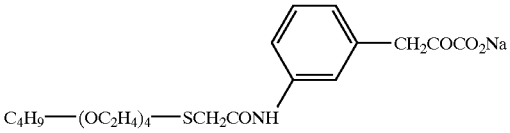
61
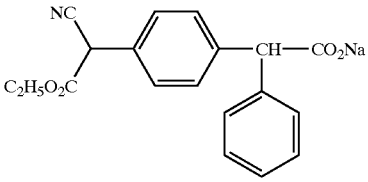
62
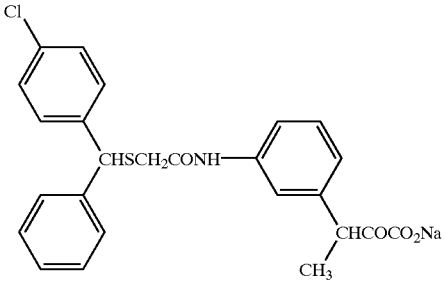
TABLE 11
63
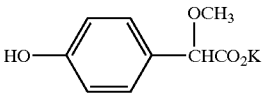
64
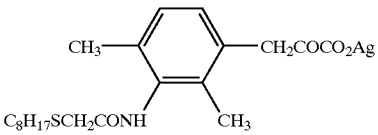
65
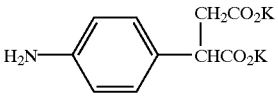

TABLE 11-continued
| | |
|---|---|
| 66 | 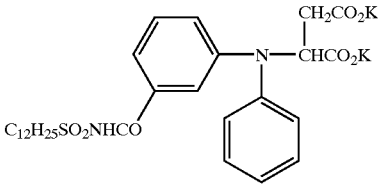 |
| 67 | 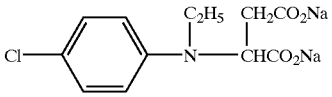 |
| 68 | 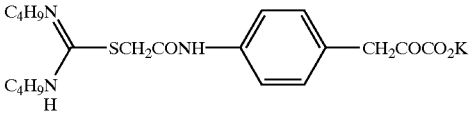 |
| 69 | 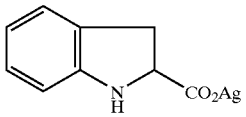 |
TABLE 11-continued
| | |
|---|---|
| 70 | 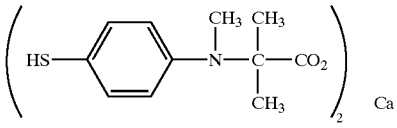 |
| 71 | 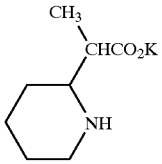 |
| 72 | 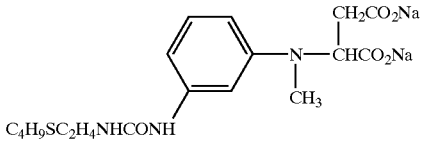 |
TABLE 12
| | |
|---|---|
| 73 | 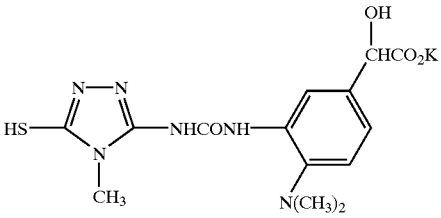 |
| 74 | 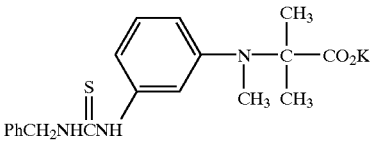 |
| 75 | 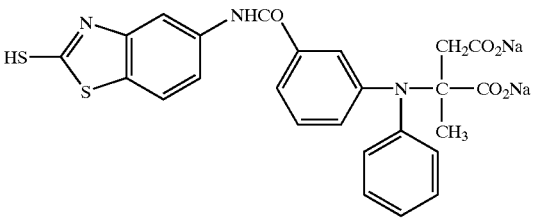 |
| 76 | 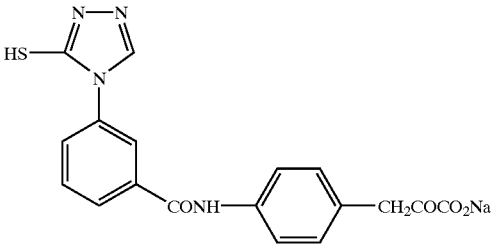 |

TABLE 12-continued
| | |
|---|---|
| 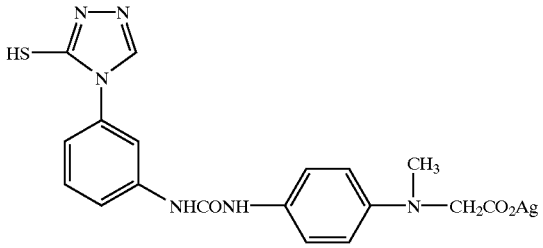 | 77 |
| 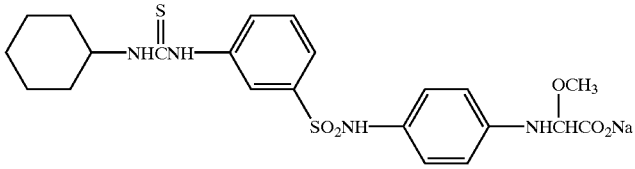 | 78 |
| 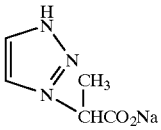 | 79 |
TABLE 13
| | |
|---|---|
| 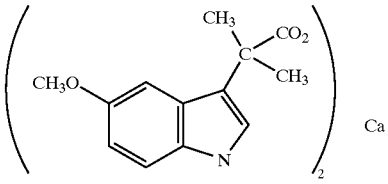 | 80 |
| 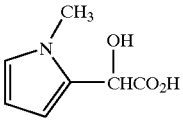 | 81 |
| 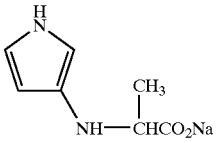 | 82 |
| 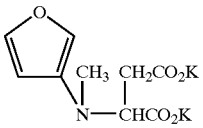 | 83 |
| 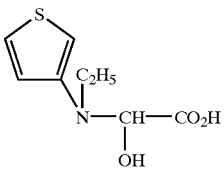 | 84 |
TABLE 13-continued
| | |
|---|---|
| 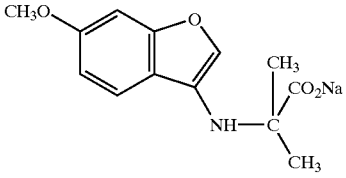 | 85 |
| 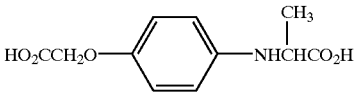 | 86 |
| 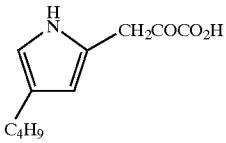 | 87 |
| 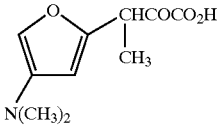 | 88 |
TABLE 14
| | |
|---|---|
| 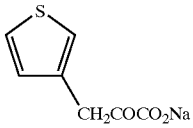 | 89 |

TABLE 14-continued
90
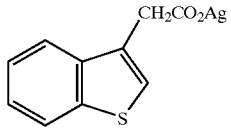
91
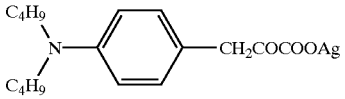
92
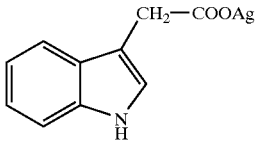
93
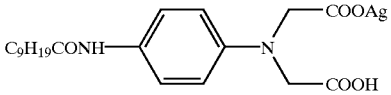
94
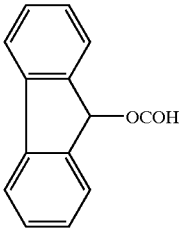
95
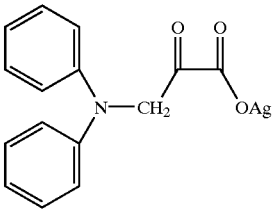
96
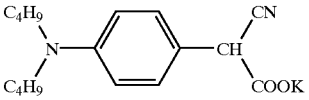
TABLE 15
97
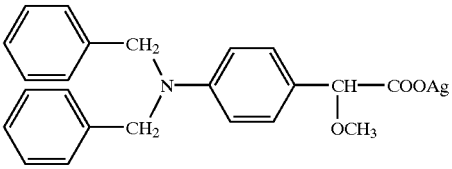
98
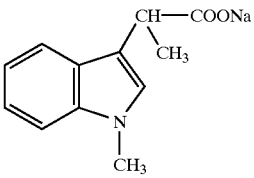
TABLE 15-continued
99
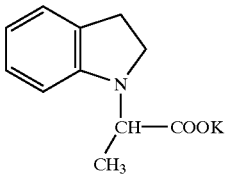
100
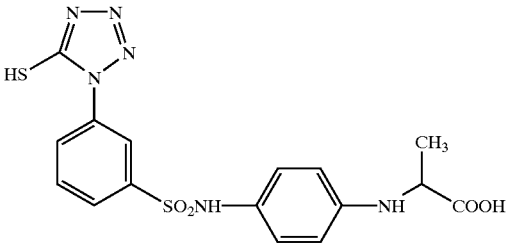
101
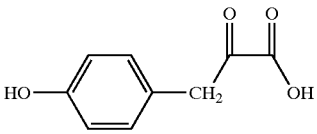
102
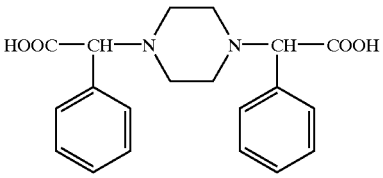
103
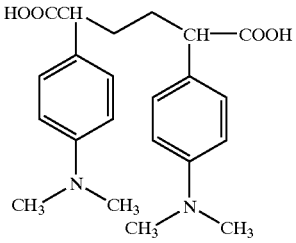
Further, the formic acid precursors described in Japanese Patent Application No. 2000-313207 can also be preferably used. Specific examples of those compounds are mentioned below.
(P-1)
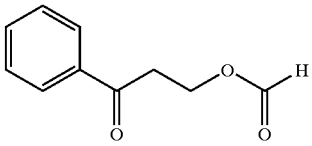

-continued (P-2)

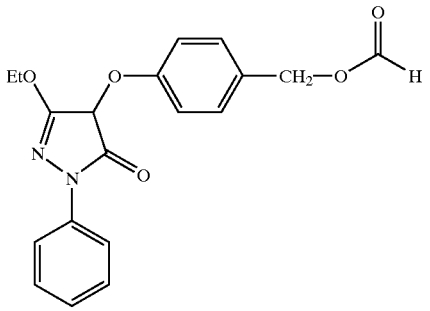

(P-3)

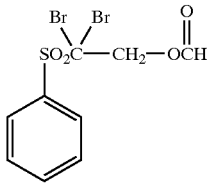

(P-4)

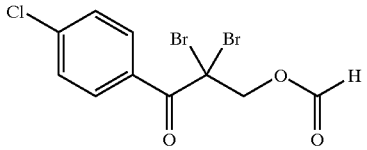

(P-5)

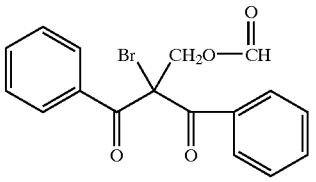

(P-7)

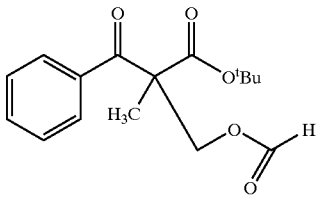

(P-8)

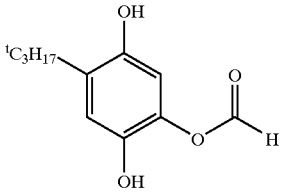

(P-9)

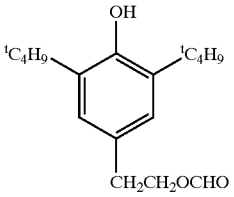

-continued (P-10)

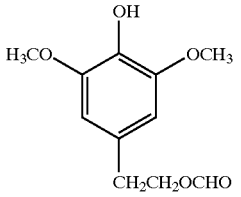

(P-11)

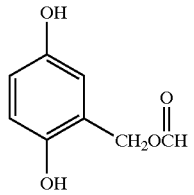

As the compound of the present invention, the compounds represented by the formula (1), (2) or (3) are preferably used.

Formulas (1), (2) and (3)

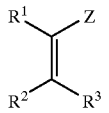

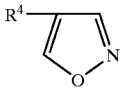

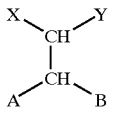

In the aforementioned formula (1), $R^1$, $R^2$ and $R^3$ each independently represent a hydrogen atom or a substituent, and Z represents an electron-withdrawing group. In the formula (1), $R^1$ and Z, $R^2$ and $R^3$, $R^1$ and $R^2$, or $R^3$ and Z may be combined with each other to form a ring structure. In the formula (2), $R^4$ represents a substituent. In the formula (3), X and Y each independently represent a hydrogen atom or a substituent, and A and B each independently represent an alkoxy group, an alkylthio group, an alkylamino group, an aryloxy group, an arylthio group, an anilino group, a heterocyclyloxy group, a heterocyclylthio group or a heterocyclylamino group. In the formula (3), X and Y or A and B may be combined with each other to form a ring structure.

When $R^1$, $R^2$ or $R^3$ represents a substituent in the formula (I), examples of the substituent include, for example, a halogen atom (including fluorine atom, chlorine atom, bromide atom and iodine atom), an alkyl group (including an aralkyl group, a cycloalkyl group and active methine group), an alkenyl group, an alkynyl group, an aryl group, a heterocyclic group (including N-substituted nitrogen-containing heterocyclic group), a quaternized nitrogen-containing heterocyclic group (e.g., pyridinio group), an acyl group, an alkoxycarbonyl group, an aryloxycarbonyl group, a carbamoyl group, a carboxy group or a salt thereof, an imino group, an imino group substituted at N atom, a thiocarbonyl group, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group containing an ethyleneoxy group or propyleneoxy group repeating unit), an aryloxy group, a heterocyclyloxy group, an acyloxy group, an (alkoxy or aryloxy)carbonyloxy group, a carbamoyloxy group, a sulfonyloxy group, an amino group, an (alkyl, aryl or heterocyclyl) amino group, an acylamino group, a sulfonamido group, a ureido group, a thioureido group, an isothioureido group, an imido group, an (alkoxy or aryloxy) carbonylamino group, a sulfamoylamino group, a semicarbazido group, a thiosemicarbazido group, a hydrazino group, a quaternary ammonio group, an oxamoylamino group, an (alkyl or aryl)sulfonylureido group, an acylureido group, an acylsulfamoylamino group, a nitro group, a mercapto group, an (alkyl, aryl or heterocyclyl)thio group, an acylthio group, an (alkyl or aryl)sulfonyl group, an (alkyl or aryl) sulfinyl group, a sulfo group or a salt thereof, a sulfamoyl group, anacylsulfamoyl group,a sulfonylsulfamoyl group or a salt thereof, a phosphoryl group, a group containing phosphoramide or phosphoric acid ester structure, a silyl group, a stannyl group and so forth.

These substituents each may further be substituted by any of the above-described substituents.

The electron-withdrawing group represented by Z in the formula (1) is a substituent that can have a Hammett's substituent constant σp of a positive value, and specific examples thereof include a cyano group, an alkoxycarbonyl group, an aryloxycarbonyl group, a carbamoyl group, an imino group, an imino group substituted at N atom, a thiocarbonyl group, a sulfamoyl group, an alkylsulfonyl group, an arylsulfonyl group, a nitro group, a halogen atom, a perfluoroalkyl group, a perfluoroalkanamido group, a sulfonamido group, an acyl group, a formyl group, a phosphoryl group, a carboxyl group, a sulfo group (or a salt thereof), a heterocyclic group, an alkenyl group, an alkynyl group, an acyloxy group, an acylthio group, a sulfonyloxy group and an aryl group substituted with any one of the above-described electron-withdrawing groups. The heterocyclic group is an aromatic or non-aromatic saturated or unsaturated heterocyclic group, and examples thereof include a pyridyl group, a quinolyl group, a pyrazinyl group, a benzotriazolyl group, an imidazolyl group, a benzimidazolyl group, a hydantoin-1-yl group, an urazol-1-yl group, a succinimido group and a phthalimido group. The electron-withdrawing group represented by Z in the formula (1) may further have one or more arbitrary substituents.

The electron-withdrawing group represented by Z in the formula (1) may preferably be a group having a total carbon atom number of 0–30 such as a cyano group, an alkoxycarbonyl group, an aryloxycarbonyl group, a carbamoyl group, a thiocarbonyl group, an imino group, an imino group substituted at N atom, a sulfamoyl group, an alkylsulfonyl group, an arylsulfonyl group, a nitro group, a perfluoroalkyl group, an acyl group, a formyl group, a phosphoryl group, an acyloxy group, an acylthio group or a phenyl group substituted with one or more arbitrary electron-withdrawing groups, more preferably a cyano group, an alkoxycarbonyl group, a carbamoyl group, a thiocarbamoyl group, an imino group, an imino group substituted at N atom, a sulfamoyl group, an alkylsulfonyl group, an arylsulfonyl group, an acyl group, a formyl group, a phosphoryl group, a trifluoromethyl group, or a phenyl group substituted with one or more arbitrary electron-withdrawing groups, particularly preferably a cyano group, an alkoxycarbonyl group, a carbamoyl group, an imino group, an imino group substituted at N atom, an alkylsulfonyl group, an arylsulfonyl group, an acyl group or formyl group.

The substituent represented by $R^1$ in the formula (1) may preferably be a group having a total carbon atom number of 0–30, and specific examples of the group include the same groups as those explained as the electron-withdrawing group represented by Z in the aforementioned formula (1), as well as an alkyl group, an alkenyl group, an alkoxy group, an aryloxy group, a heterocyclyloxy group, an alkylthio group, an arylthio group, a heterocyclylthio group, an amino group, an alkylamino group, an arylamino group, a heterocyclylamino group, a ureido group, an acylamino group, a silyl group and a substituted or unsubstituted aryl group, more preferably the same groups as those explained as the electron-withdrawing group represented by Z in the aforementioned formula (1), a substituted or unsubstituted aryl group, an alkenyl group, an alkylthio group, an arylthio group, an alkoxy group, a silyl group and an acylamino group, further preferably an electron-withdrawing group, an aryl group, an alkenyl group and an acylamino group. When R represents an electron-withdrawing group, the preferred scope thereof is the same as the preferred scope of the electron-withdrawing group represented by Z.

The substituents represented by $R^2$ and $R^3$ in the formula (1) may preferably be the same group as those explained as the electron-withdrawing group represented by Z in the aforementioned formula (1), an alkyl group, a hydroxyl group (or a salt thereof) a mercapto group (or a salt thereof), an alkoxy group, an aryloxy group, a heterocyclyloxy group, an alkylthio group, an arylthio group, a heterocyclylthio group, an amino group, an alkylamino group, an anilino group, a heterocyclylamino group, an acylamino group, a substituted or unsubstituted phenyl group or the like. It is more preferred that one of $R^2$ and $R^3$ is a hydrogen atom and the other is a substituent. In this case, the substituent may preferably be an alkyl group, a hydroxyl group (or a salt thereof), mercapto group (or a salt thereof), an alkoxy group, an aryloxy group, a heterocyclyloxy group, an alkylthio group, an arylthio group, a heterocyclylthio group, an amino group, an alkylamino group, an anilino group, a heterocyclylamino group, an acylamino group (particularly, a perfluoroalkanamido group), a sulfonamido group, a substituted or unsubstituted phenyl group, a heterocyclic group or the like, more preferably a hydroxyl group (or a salt thereof), a mercapto group (or a salt thereof), analkoxy group, an aryloxy group, a heterocyclyloxy group, an alkylthio group, an arylthio group, a heterocyclylthio group, an amino group or a heterocyclic group, particularly preferably a hydroxyl group (or a salt thereof), an alkoxy group or a heterocyclic group.

In the formula (1), it is also preferred that Z together with $R^1$ or $R^2$ together with $R^3$ form a ring structure. The ring structure formed in this case is a non-aromatic carbon ring or a non-aromatic heterocyclic ring, preferably a 5- to 7-membered ring structure having a total carbon atom number of 1–40, more preferably 3–35, including those of substituents thereon.

The compound represented by the formula (1) is more preferably a compound wherein Z represents a cyano group, a formyl group, an acyl group, an alkoxycarbonyl group, an imino group or a carbamoyl group, $R^1$ represents an electron-withdrawing group, and one of R and $R^3$ represents a hydrogen atom and the other represents a hydroxyl group (or a salt thereof), a mercapto group (or a salt thereof), an alkoxy group, an aryloxy group, a heterocyclyloxy group, an alkylthio group, an arylthio group, a heterocyclylthio group, an amino group or a heterocyclic group.

A class of more preferable compounds represented by the formula (1) is constituted by those wherein Z and $R^1$ combine with each other to form a non-aromatic 5- to 7-membered ring structure, and one of R and R represents a hydrogen atom and the other represents a hydroxyl group (or a salt thereof), a mercapto group (or a salt thereof), an alkoxy group, an aryloxy group, a heterocyclyloxy group, an alkylthio group, an arylthio group, a heterocyclylthio group, an amino group or a heterocyclic group.

Specific examples of the 5- to 7-membered non-aromatic cyclic structure formed by Z and $R^1$ are, for example, indane-1,3-dione ring, pyrrolidine-2,4-dione ring, pyrazolidine-3,5-dione ring, oxazolidine-2,4-dione ring, 5-pyrazolone ring, imidazolidine-2,4-dione ring, thiazolidine-2,4-dione ring, oxolane-2,4-dione ring, thiolane-2,4-dione ring, 1,3-dioxane-4,6-dione ring, cyclohexane-1,3-dione ring, 1,2,3,4-tetrahydroquinoline-2,4-dione ring, cyclopentane-1,3-dione ring, isoxazolidine-3,5-dione ring, barbituric acid ring, 2,3-dihydrobenzofuran-3-one ring, pyrazolotriazole ring (for example, 7H-pyrazolo[1,5-b]-[1,2,4]triazole, 7H-pyrazolo[5,1-c][1,2,4]triazole, 7H-pyrazolo[1,5-a]benzimidazole etc.), pyrrolotriazole ring (for example, 5H-pyrrolo[1,2-b][1,2,4]triazole, 5H-pyrrolo[2,1-c][1,2,4]-triazole etc.), 2-cyclopentene-1,4-dione ring, 2,3-dihydro-benzothiophen-3-one-1,1-dioxide ring, chroman-2,4-dione ring, 2-oxazolin-5-one ring, 2-imidazolin-5-one ring, 2-thiazolin-5-one ring, 1-pyrrolin-4-one ring, 5-oxothiazolidin-2-one ring, 4-oxothiazolidin-2-one ring, 1,3-dithiolane ring, thiazolidine ring, 1,3-dithietane ring, 1,3-dioxolane ring and so forth. Among these, preferred are indane-1,3-dione ring, pyrrolidine-2,4-dione ring, pyrazolidine-3,5-dione ring, 5-pyrazolone ring, barbituric acid ring, 2-oxazolin-5-one ring and so forth.

Examples of the substituent represented by $R^4$ in the formula (2) include those explained as the substituent represented by $R^1$, $R^2$ or $R^3$ in the formula (1).

The substituent represented by $R^4$ in the formula (2) may preferably be an electron-withdrawing group or an aryl group. Where $R^4$ represents an electron-withdrawing group, the electron-withdrawing group may preferably be a group having a total carbon atom number of from 0–30, such as a cyano group, a nitro group, an acyl group, a formyl group, an alkoxycarbonyl group, an aryloxycarbonyl group, an alkylsulfonyl group, an arylsulfonyl group, a carbamoyl group, a sulfamoyl group, a perfluoroalkyl group, a phosphoryl group, an imino group, a sulfonamido group, or a heterocyclic group, more preferably a cyano group, an acyl group, a formyl group, an alkoxycarbonyl group, a carbamoyl group, a sulfamoyl group, an alkylsulfonyl group, an arylsulfonyl group, a sulfonamido group or a heterocyclic group.

Where $R^4$ represents an aryl group, the aryl group may preferably be a substituted or unsubstituted phenyl group having a total carbon atom number of from 6–30. Examples of the substituent include those described as the substituent represented by $R^1$, $R^2$ or $R^3$ in the formula (1). An electron-withdrawing group is preferred.

Examples of the substituent represented by X or Y in the formula (3) include those described as the substituent represented by $R^1$, $R^2$ or $R^3$ in the formula (1). The substituent represented by X or Y may preferably be a substituent having a total carbon number of 1–50, more preferably 1–35, for example, a cyano group, an alkoxycarbonyl group, an aryloxycarbonyl group, a carbamoyl group, an imino group, an imino group substituted at N atom, a thiocarbonyl group, a sulfamoyl group, an alkylsulfonyl group, an arylsulfonyl group, nitro group, a perfluoroalkyl group, an acyl group, a formyl group, a phosphoryl group, an acylamino group, an acyloxy group, an acylthio group, a heterocyclic group, an alkylthio group, an alkoxy group, an aryl group or the like, more preferably a cyano group, a nitro group, an alkoxycarbonyl group, a carbamoyl group, an acyl group, a formyl group, an acylthio group, an acylamino group, a thiocarbonyl group, a sulfamoyl group, an alkylsulfonyl group, an arylsulfonyl group, an imino group, an imino group substituted at N atom, a phosphoryl group, a trifluoromethyl group, a heterocyclic group, a substituted phenyl group or the like, particularly preferably a cyano group, an alkoxycarbonyl group, a carbamoyl group, an alkylsulfonyl group, an arylsulfonyl group, an acyl group, an acylthio group, an acylamino group, a thiocarbonyl group, a formyl group, an imino group, an imino group substituted at N atom, a heterocyclic group, a phenyl group substituted with an arbitrary electron-withdrawing group or the like.

X and Y may also preferably combine with each other to form a non-aromatic carbon ring or a non-aromatic heterocyclic ring. The ring structure formed in this case is preferably a 5- to 7-membered ring. Specific examples of the ring structure formed by X and Y are similar to those exemplified for the non-aromatic 5- to 7-membered ring that can be formed by Z and $R^1$ bonded together in the formula (1), and the preferred scope thereof is also similar to that of the ring structure formed by Z and $R^1$. Those rings may further have a substituent, and the total carbon atom number thereof is preferably 1–40, more preferably 1–35.

The substituents represented by A and B in the formula (3) may further have one or more substituents, and they are preferably groups having a total carbon atom number 1–40, more preferably 1–30. In the formula (3), A and B more preferably combine with each other to form a ring structure. The ring structure formed in this case is preferably a 5- to 7-membered non-aromatic heterocyclic ring having a total carbon atom number of 1–40, more preferably 3–30. Examples of the structure formed by the linking of A and B (-A-B-) include $—O—(CH_2)_2—O—$, $—O—(CH_2)_3—O—$, $—S—(CH_2)_2—S—$, $—S—(CH_2)_3—S—$, —S—Ph—S—, $—N(CH_3)—(CH_2)_2—O—$, $—O—(CH_2)_3—S—$, $—N(CH_3)—Ph—S—$, $—N(Ph)—(CH_2)_2—S—$ and so forth.

In the present specification, "Ph" represents a phenyl group.

The compounds represented by the formulas (1) to (3) may be introduced with an adsorptive group capable of adsorbing to silver halide. They may also be introduced with a ballast group or a polymer commonly used in the field of immobile photographic additives such as a coupler, and they may also contain a cationic group (specifically, a group containing a quaternary ammonio group, a nitrogen-containing heterocyclic group containing a quaternized nitrogen atom, or the like), a group containing an ethyleneoxy group or a propyleneoxy group as a repeating unit, an (alkyl, aryl or heterocyclyl)thio group, or a dissociative group capable of dissociation with a base (e.g., a carboxyl group, a sulfo group, an acylsulfamoyl group, a carbamoylsulfamoyl group etc.). Examples of compounds having such groups include those compounds described in JP-A-63-29751, U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, JP-A-63-234246, JP-A-2-285344, JP-A-1-100530, JP-A-7-234471, JP-A-5-333466, JP-A-6-19032, JP-A-6-19031, JP-A-5-45761, U.S. Pat. Nos. 4,994,365 and 4,988,604, JP-A-7-259240, JP-A-7-5610, JP-A-7-244348, German Patent No. 4,006,032 and so forth.

Specific examples of the compounds represented by the formulas (1) to (3) will be shown below (Exemplary Compounds A-1 to A-118). However, compounds that can be used for the present invention are not limited to the following compounds. In the following structural formulas, "Am" represents an amyl group.

A-1
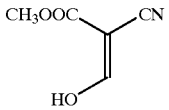
A-2
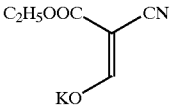
A-3
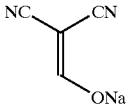
A-4
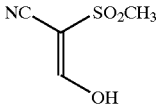
A-5
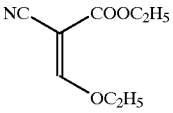
A-6
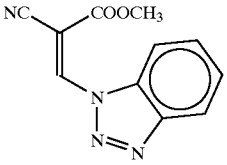
A-7
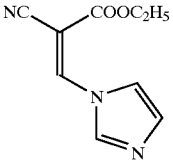
A-8
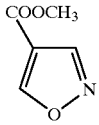
A-9
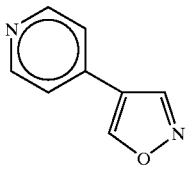
A-10
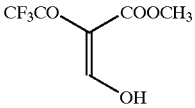
A-11
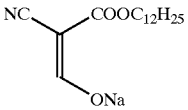
-continued
A-12
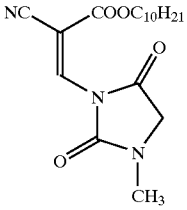
A-13
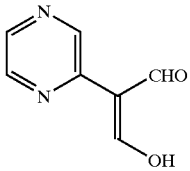
A-14
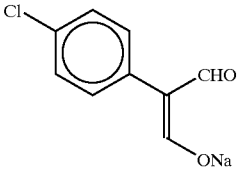
A-15
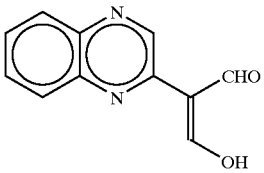
A-16
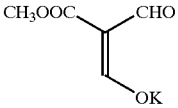
A-17
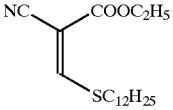
A-18
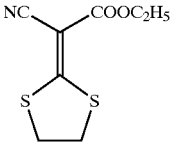
A-19
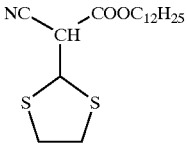
A-20
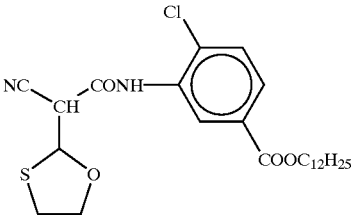

-continued
A-21
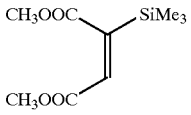
A-22
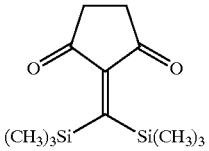
A-23
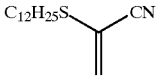
A-24
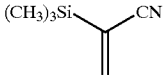
A-25
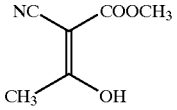
A-26
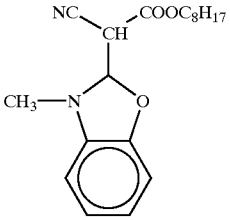
A-27
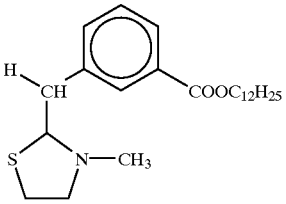
A-28
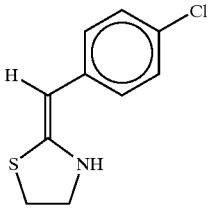
A-29
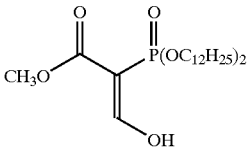
A-30
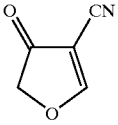
-continued
A-31
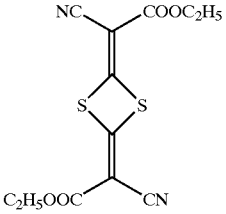
A-32
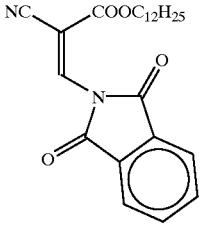
A-33
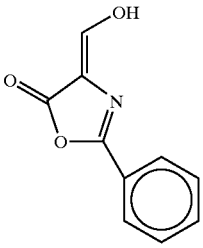
A-34
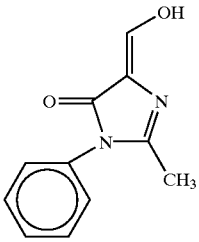
A-35
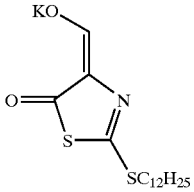
A-36
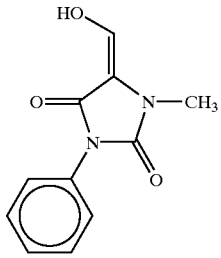
A-37
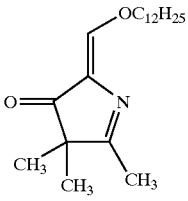

-continued
A-38
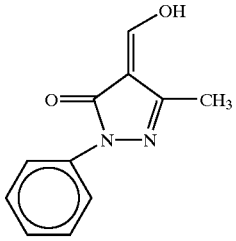
A-39
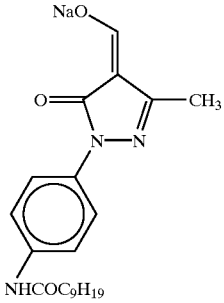
A-40
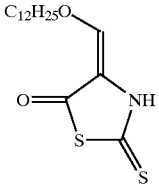
A-41
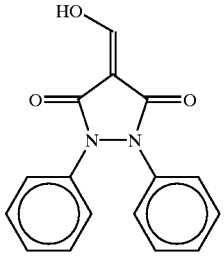
A-42
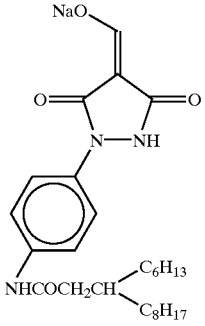
-continued
A-43
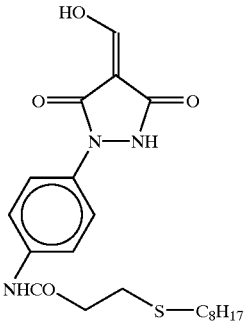
A-44
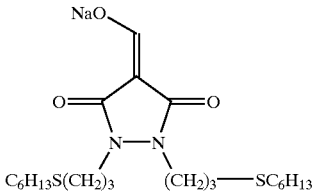
A-45
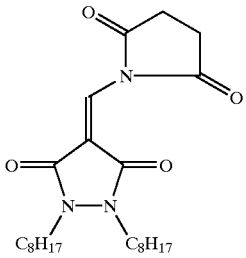
A-46
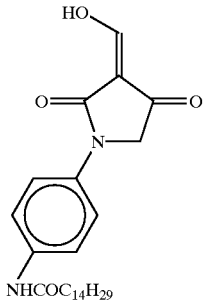
A-47
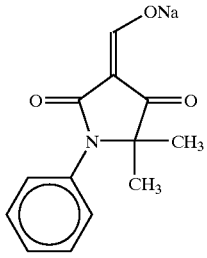

-continued
A-48
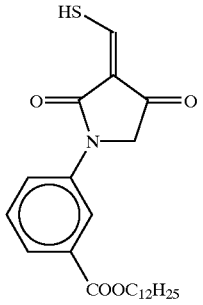
A-49
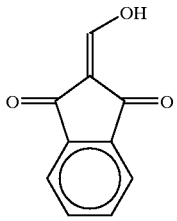
A-50
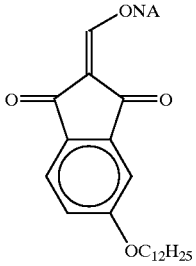
A-51
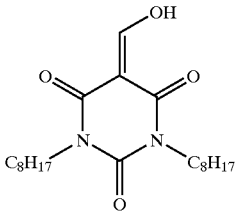
A-52
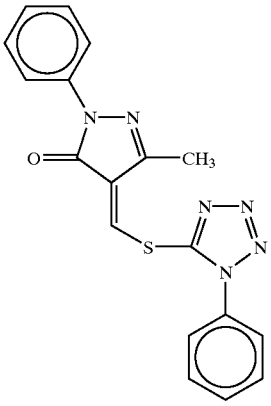
A-53
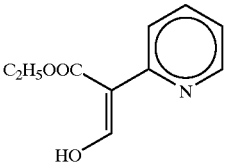
-continued
A-54
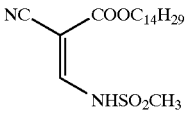
A-55
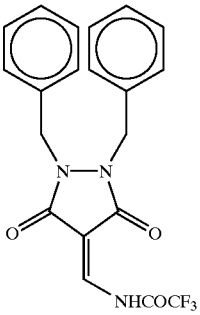
A-56
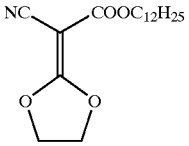
A-57
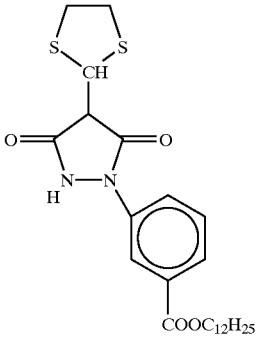
A-58
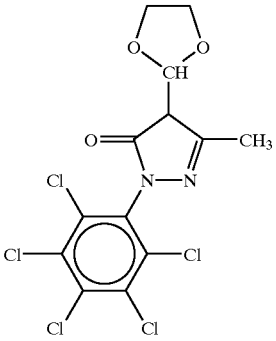

-continued
A-59
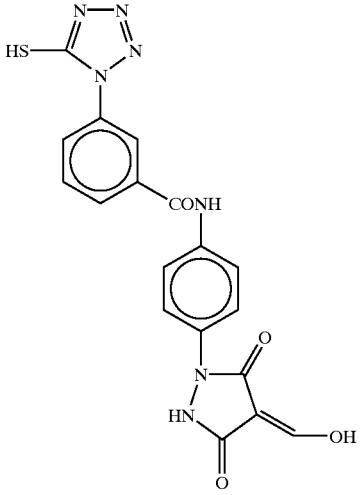
A-60
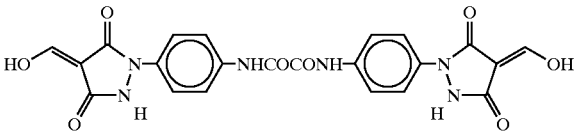
A-61
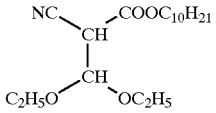
A-62
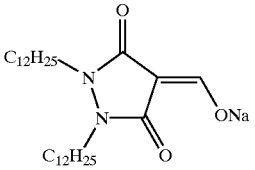
A-63
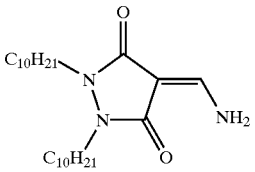
A-64
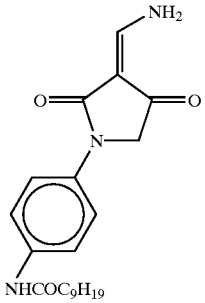
A-65
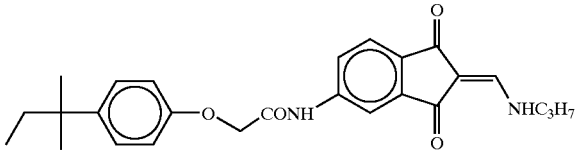
-continued
A-66
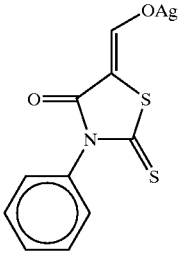
A-67
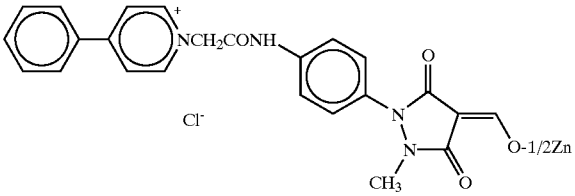
A-68
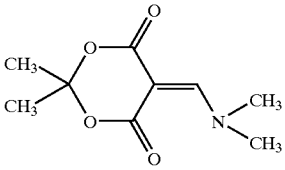
A-69
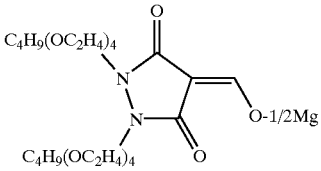
A-70
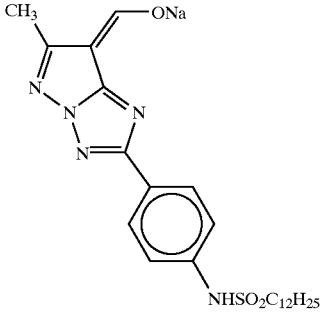
A-71
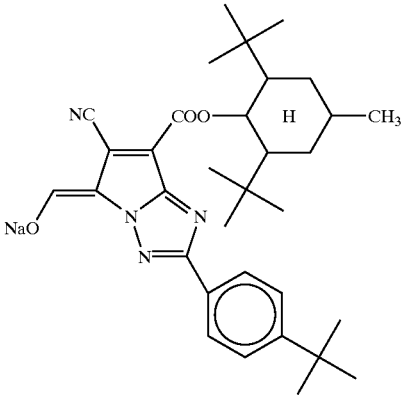

-continued
A-72
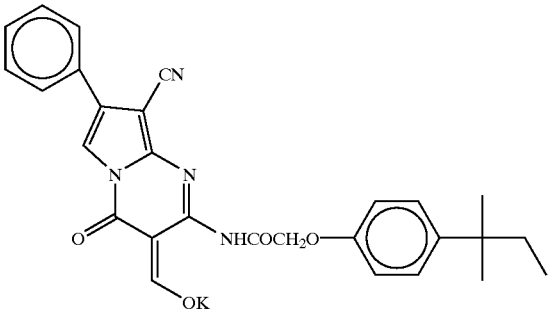
A-73
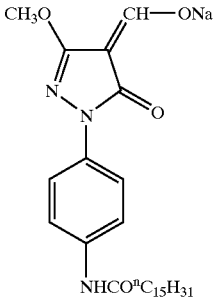
A-74
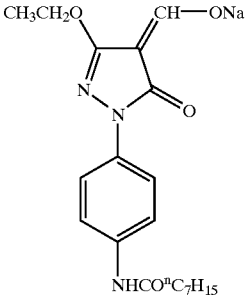
A-75
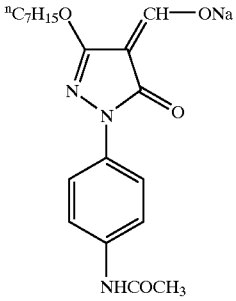
A-76
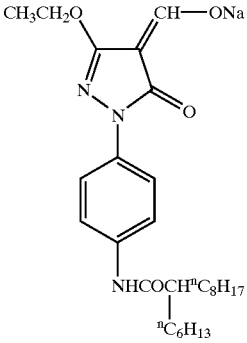
-continued
A-77
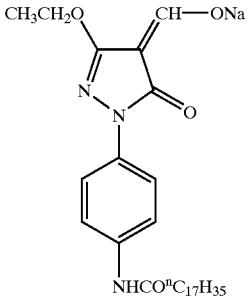
A-78
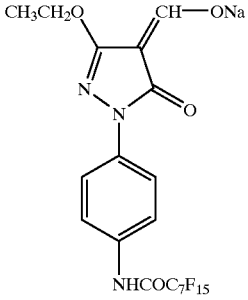
A-79
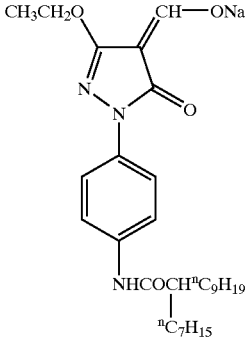
A-80
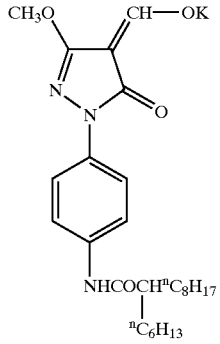
A-81
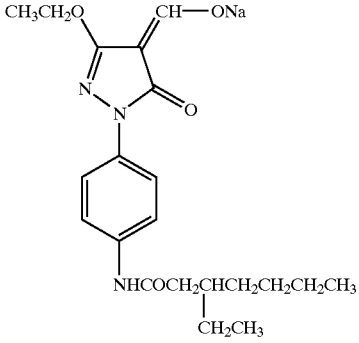

-continued
A-82
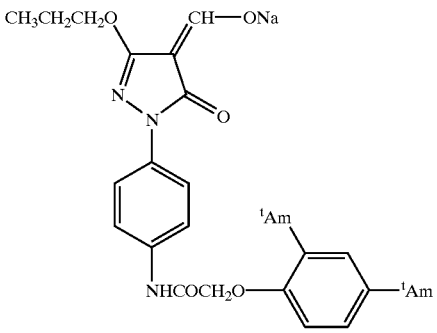
A-83
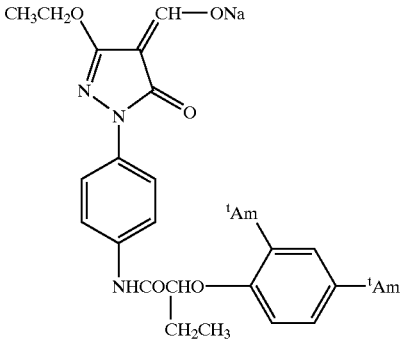
A-84
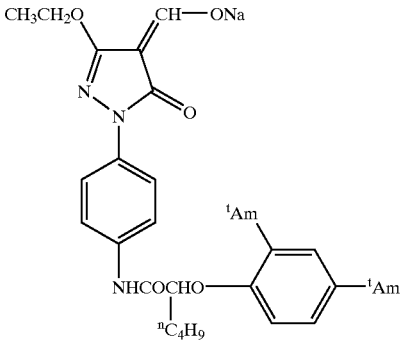
A-85
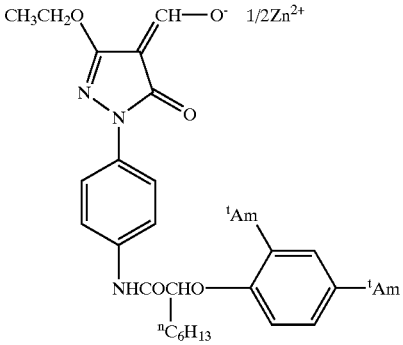
-continued
A-86
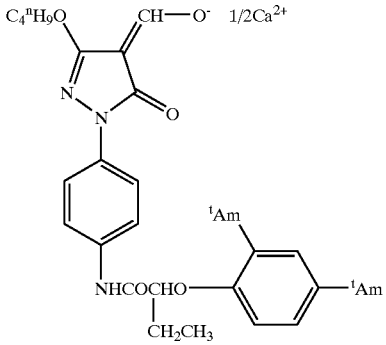
A-87
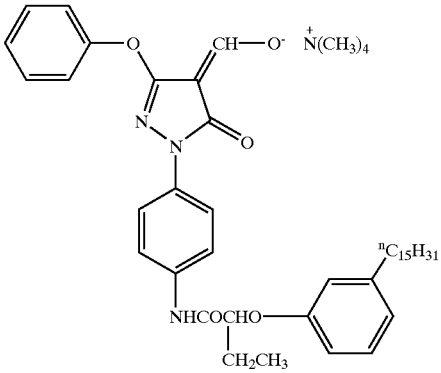
A-88
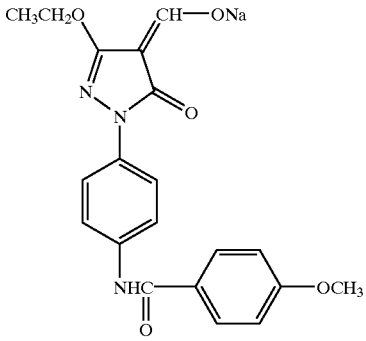
A-89
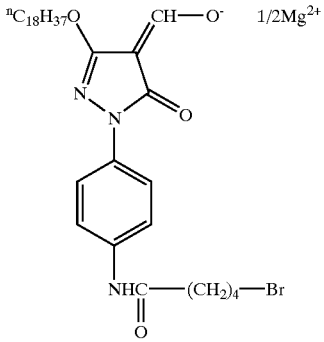

-continued
A-90
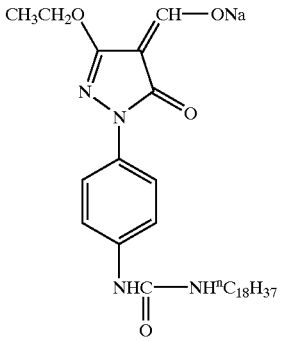
A-91
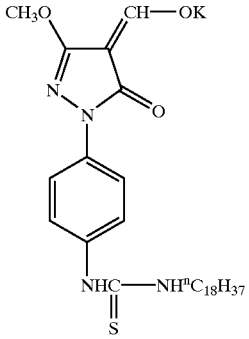
A-92
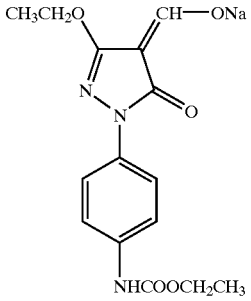
A-93
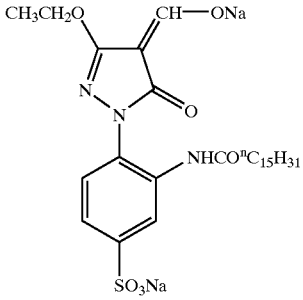
A-94
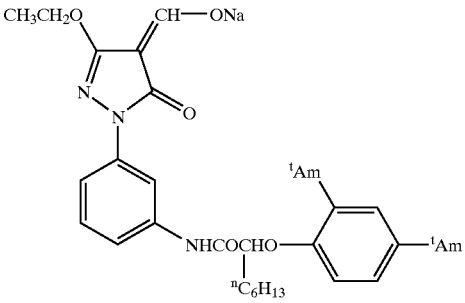
-continued
A-95
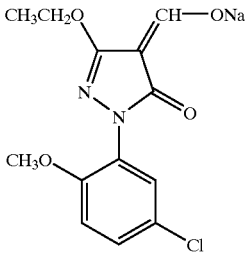
A-96
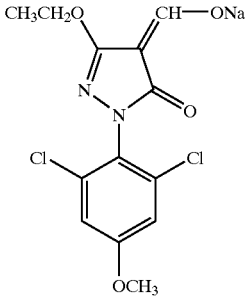
A-97
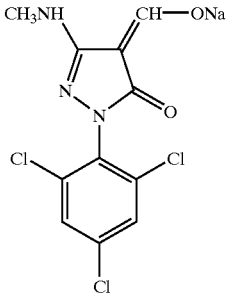
A-98
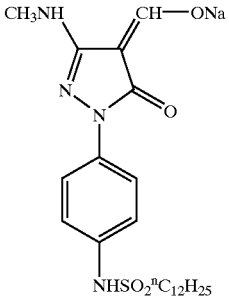
A-99
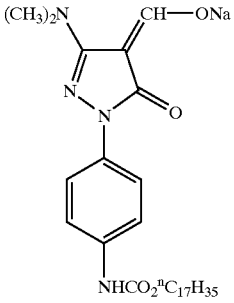

-continued
A-100
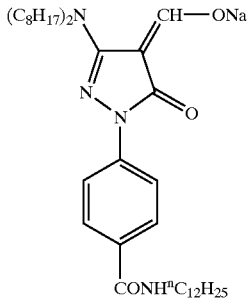
A-101
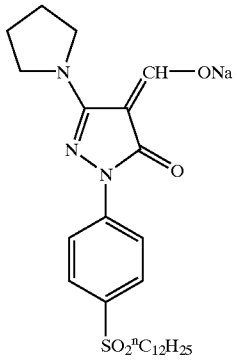
A-102
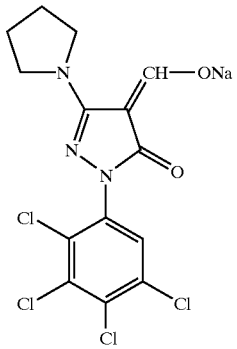
A-103
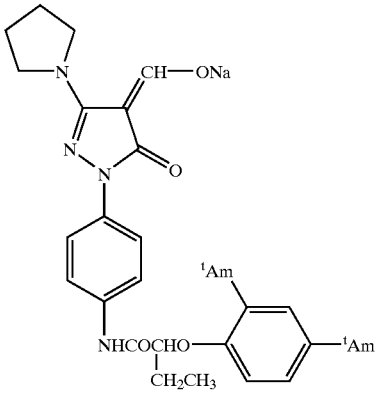
-continued
A-104
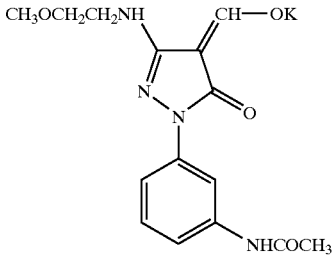
A-105
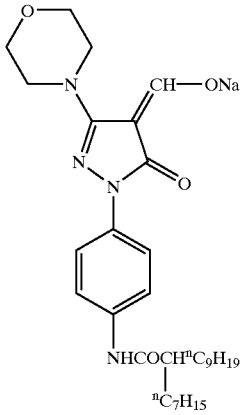
A-106
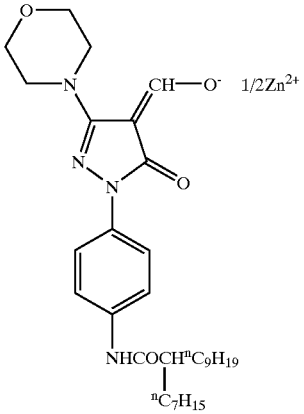
A-107
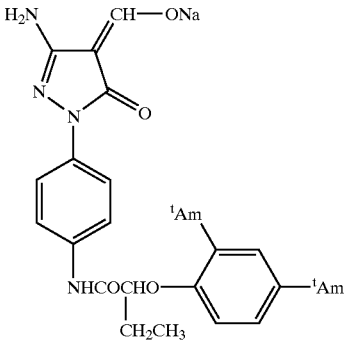

-continued

A-108

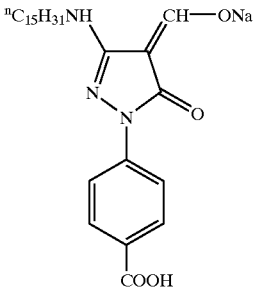

A-109

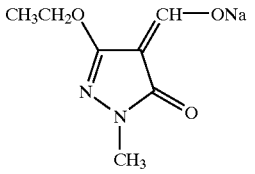

A-110

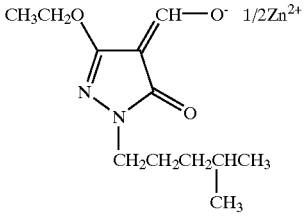

A-111

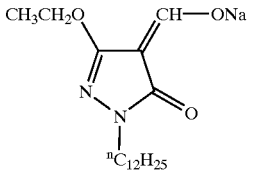

A-112

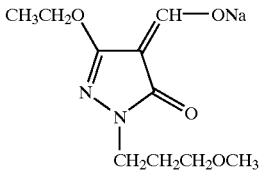

A-113

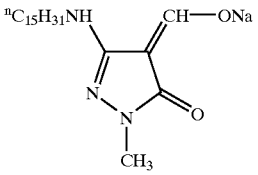

A-114

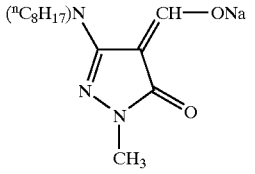

-continued

A-115

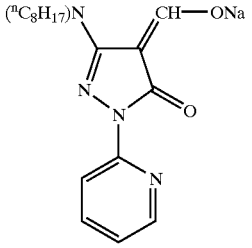

A-116

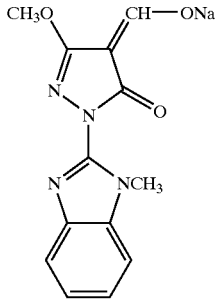

A-117

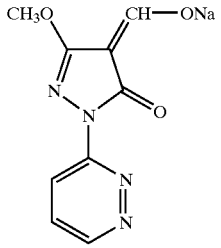

A-118

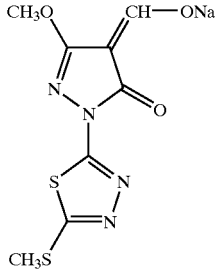

The compounds represented by formulas (1) to (3) can be easily synthesized according to known methods. For example, the compounds may be synthesized by referring to the methods described in U.S. Pat. Nos. 5,545,515, 5,635,339 and 5,654,130, International Patent Publication WO97/34196 or JP-A-11-231459, JP-A-11-133546 and JP-A-11-95365.

The compounds represented by the formulas (1) to (3) may be used each alone or in combination of two or more kinds of the compounds. In addition to these compounds mentioned above, any of the compounds described in U.S. Pat. Nos. 5,545,515, 5,635,339, 5,654,130, 5,705,324, 5,686,228, JP-A-10-161270, JP-A-11-119372, JP-A-11-231459, JP-A-11-133546, JP-A-11-119373, JP-A-11-109546, JP-A-11-95365, JP-A-11-95366 and JP-A-11-149136 may also be used in combination.

In the present invention, various hydrazine derivatives described in JP-A-10-161270 may also be used in combination.

The compounds of the present invention may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

The compounds may also be used as an emulsified dispersion mechanically prepared according to an already well known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the compounds of the present invention may be used after dispersion of a powder of the compounds in a suitable solvent such as water by using a ball mill, a colloid mill or the like, or by means of ultrasonic wave according to a known method for solid dispersion.

The compounds of the present invention may be used each alone one in a combination of two or more of them. The compounds of the present invention may be added to any layers on the image-forming layer side. However, the compounds may preferably be added to the image-forming layer or a layer adjacent thereto.

The amount of the compounds of the present invention is preferably from $1\times10^{-6}$ to 1 mole, more preferably from $1\times10^{-5}$ to $5\times10^{-1}$ mole, most preferably from $2\times10^{-5}$ to $2\times10^{-1}$ mole, per mole of silver.

Further, any of the compounds described in U.S. Pat. Nos. 5,545,515, 5,635,339, 5,654,130, WO97/34196, 5,686,228, JP-A-11-119372, JP-A-11-133546, JP-A-11-119373, JP-A-11-109546, JP-A-11-95365, JP-A-11-95366 and JP-A-11-149136 may also be used in combination with the compounds of the present invention.

In the present invention, a contrast accelerator may be used in combination with the above-described compounds for the formation of an ultrahigh contrast image. For example, amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1 to CN-13; hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14 and so forth may be used.

In the photothermographic material the present invention, an acid formed by hydration of diphosphorus pentoxide or a salt thereof is preferably used together with the nucleating agent. Examples of the acid formed by hydration of diphosphorus pentoxide or a salt thereof include metaphosphoric acid (salt), pyrophosphoric acid (salt), orthophosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof that can be preferably used in the present invention is added to the image-forming layer or a binder layer adjacent thereto in order to obtain the desired effect with a small amount of the acid or a salt thereof.

The acid formed by hydration of diphosphorus pentoxide or a salt thereof may be used in a desired amount (coated amount per $m^2$ of the photothermographic material) depending on the desired performance including sensitivity and fog. However, it can preferably be used in an amount of 0.1–500 $mg/m^2$, more preferably 0.5–100 $mg/m^2$.

The photothermographic material of the present invention contains a reducing agent for silver ions (silver salt of an organic acid). The reducing agent for silver ions may be any substance that reduces silver ions to metal silver, preferably such an organic substance. Conventional photographic developers such as phenidone, hydroquinone and catechol are useful, but a hindered phenol reducing agent is preferred. The reducing agent is preferably contained in an amount of from 5–50 mole %, more preferably from 10–40 mole %, per mole of silver on the side having the image-forming layer. The reducing agent may be added to any layer on the side having an image-forming layer. In the case of adding the reducing agent to a layer other than the image-forming layer, the reducing agent is preferably used in a slightly large amount of from 10–50 mole % per mole of silver. The reducing agent may also be a so-called precursor that is derived to effectively function only at the time of development.

For photothermographic materials using silver salt of an organic acid, reducing agents of a wide range can be used. There can be used, for example, the reducing agents disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,679,426, 3,751,252, 3,751,255, 3,761,270, 3,782,949, 3,839,048, 3,928,686 and 5,464,738, German Patent No. 2,321,328, EP-A-692732A and so forth. Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with ascorbic acid such as a combination of 2,2-bis(hydroxymethyl)propionyl-β-phenylhydrazine with ascorbic acid; combinations of polyhydroxybenzene with hydroxylamine, reductone and/or hydrazine such as a combination of hydroquinone with bis (ethoxyethyl) hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2'-dihydroxy-1,1'-binaphthyl, 6,6'-dibromo-2,2'-dihydroxy-1,1'-binaphthyl and bis (2-hydroxy-1-naphthyl) methane; combinations of a bis-β-naphthol with a 1,3-dihydroxybenzene derivative (e.g., 2,4-dihydroxybenzophenone, 2',4'-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-dione and so forth; chromans such as 2,2-dimethyl-7-t-butyl-6-hydroxychroman; 1,4-dihydropyridines such as 2,6-dimethoxy-3,5-dicarboethoxy-1,4-dihydropyridine;

bisphenols such as bis (2-hydroxy-3-tert-butyl-5-methylphenyl) methane, 2,2-bis(4-hydroxy-3-methylphenyl)propane, 4,4-ethylidene-bis(2-tert-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; chromanols such as tocopherol and so forth. Particularly preferred reducing agents are bisphenols and chromanols.

The reducing agent may be added in any form of an aqueous solution, solution in an organic solvent, powder, solid microparticle dispersion, emulsion dispersion or the like. The solid microparticle dispersion is performed by using a known pulverizing means (e.g., ball mill, vibrating ball mill, sand mill, colloid mill, jet mill, roller mill). At the time of solid microparticle dispersion, a dispersion aid may also be used.

When an additive known as a "coloring agent" capable of improving the image is added, the optical density increases in some cases. The coloring agent may also be advantageous in forming a black silver image depending on the case. The coloring agent is preferably contained in a layer on the side having the image-forming layer in an amount of from 0.1–50 mole %, more preferably from 0.5–20 mole %, per mole of silver. The coloring agent may be a so-called precursor that is derived to effectively function only at the time of development.

For the photothermographic material using a silver salt of an organic acid, coloring agents of a wide range can be used. For example, there can be used coloring agents disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, Japanese Patent Publication (Kokoku, hereinafter referred to as JP-B) 49-10727, JP-B-54-20333, U.S. Pat. Nos. 3,080,254, 3,446,648, 3,782,941, 4,123,282 and 4,510,236, British Patent No. 1,380,795, Belgian Patent No. 841910 and so forth. Specific examples of the coloring agent include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl)naphthalene-2,3-dicarboxyimide; blocked pyrazoles, isothiuronium derivatives and a certain kind of photobleaching agents such as N,N'-hexamethylenebis(1-carbamoyl-3,5-dimethylpyrazole), 1,8-(3,6-diazaoctane)bis (isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride); phthalazine, phthalazine derivatives (e.g., 4-(1-naphthyl)phthalazine, 6-chlorophthalazine, 5,7-dimethoxyphthalazine, 6-isobutylphthalazine, 6-tert-butylphthalazine, 5,7-dimethylphthalazine, 2,3-dihydrophthalazine) and metal salts thereof; combinations of a phthalazine or derivative thereof and a phthalic acid derivative (e.g., phthalic acid, 4-methylphthalic acid, 4-nitrophthalic acid, tetrachlorophthalic acid anhydride); quinazolinedione, benzoxazine and naphthoxazine derivatives; rhodium complexes which function not only as a coloring agent but also as a halide ion source for the formation of silver halide at the site, such as ammonium hexachlororhodate(III), rhodium bromide, rhodium nitrate and potassium hexachlororhodate (III); inorganic peroxides and persulfates such as ammonium disulfide peroxide and hydrogen peroxide; benzoxazine-2,4-diones such as 1,3-benzoxazine-2,4-dione, 8-methyl-1,3-benzoxazine-2,4-dione and 6-nitro-1,3-benzoxazine-2,4-dione; pyrimidines and asymmetric triazines such as 2,4-dihydroxpyrimidine and 2-hydroxy-4-aminopyrimidine; azauracil and tetraazapentalene derivatives such as 3,6-dimercapto-1,4-diphenyl-1H,4H-2,3a,5, 6a-tetraazapentalene and 1,4-di(o-chlorophenyl)-3,6-dimercapto-1H,4H-2,3a,5,6a-tetraazapentalene and so forth.

In the present invention, the phthalazine derivatives represented by the formula (F) mentioned in JP-A-2000-35631 are preferably used as the coloring agent. Specifically, A-1 to A-10 mentioned in the same are preferably used.

The coloring agent may be added in any form of a solution, powder, solid microparticle dispersion or the like. The solid microparticle dispersion is performed by using a known pulverization means (e.g., ball mill, vibrating ball mill, sand mill, colloid mill, jet mill, roller mill). At the time of solid microparticle dispersion, a dispersion aid may also be used.

In the photothermographic material of the present invention, it is not preferred that volatile bases such as ammonia exist in the films, since they are likely to be evaporated and evaporated during not only coating process and heat development, but also storage. The content of $NH_4^+$ is preferably 0.06 mmol or less, more preferably 0.03 mmol or less, in terms of the coated amount per 1 $m^2$ of the support. The amount of $NH_4^+$ in films was quantified by using an ion chromatography measurement apparatus Type 8000 (according to electric conduction degree method), produced by TOSOH CORP., which was provided with a TSKgel IC-Cation as a separation column and TSK guard column IC-C as a guard column, which were produced by TOSOH CORP. As an eluent, 2 mM nitric acid aqueous solution was used at a flow rate of 1.2 mL/min. The column thermostat temperature was 40° C.

Extraction of $NH_4^+$ from a photosensitive material was attained by immersing the photosensitive material having a size of 1×3.5 cm into 5 mL of extraction solution consisting of a mixture of acetic acid and ion-exchanged water (1:148) for 2 hours and filtering the solution through a 0.45-$\mu$m filter, and the measurement was performed for the obtained filtrate.

For controlling the film surface pH, an organic acid such as phthalic acid derivatives or a nonvolatile acid such as sulfuric acid, and a volatile base such as ammonia are preferably used.

The photothermographic material of the present invention preferably has a film surface pH of 6.0 or less, more preferably 5.5 or less before heat development. While it is not particularly limited as for the lower limit, it is normally around 3 or higher.

A method for measuring the film surface pH is described in JP-A-2000-284399, paragraph 0123.

In the photothermographic material of the present invention, the silver halide emulsion and/or the silver salt of an organic acid can be further prevented from the production of additional fog or stabilized against the reduction in sensitivity during the stock storage by an antifoggant, a stabilizer or a stabilizer precursor. Examples of suitable antifoggant, stabilizer and stabilizer precursor that can be used individually or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechols described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, phosphorus compounds described in U.S. Pat. No. 4,411,985 and so forth.

The photothermographic material of the present invention may contain a benzoic acid compound for the purpose of achieving high sensitivity or preventing fog. The benzoic acid compound for use in the present invention may be any benzoic acid derivative, but preferred examples thereof include the compounds described in U.S. Pat. Nos. 4,784,939 and 4,152,160 and JP-A-9-329863, JP-A-9-329864 and JP-A-9-281637. The benzoic acid compound for use in the present invention may be added to any layer of the photothermographic material, but it is preferably added to a layer on the image-forming layer side with respect to the support, more preferably a layer containing a silver salt of an organic acid. The benzoic acid compound may be added at any step during the preparation of the coating solution. In the case of adding the benzoic acid compound to a layer containing a silver salt of an organic acid, it may be added at any step from the preparation of the silver salt of an organic acid to the preparation of the coating solution, but it is preferably added in the period after the preparation of the silver salt of an organic acid and immediately before the coating. The benzoic acid compound may be added in any form such as powder, solution, and microparticle dispersion, or may be added as a solution containing a mixture of the benzoic acid compound with other additives such as a sensitizing dye, reducing agent and coloring agent. The benzoic acid compound may be added in any amount. However, the amount thereof is preferably from $1\times10^{-6}$ to 2 mole, more preferably from $1\times10^{-3}$ to 0.5 mole, per mole of silver.

Although not essential for practicing the present invention, it is advantageous in some cases to add a mercury (II) salt as an antifoggant to the image-forming layer. Preferred mercury(II) salts for this purpose are mercury acetate and mercury bromide. The addition amount of mercury for use in the present invention is preferably from $1\times10^{-9}$ to $1\times10^{-3}$ mole, more preferably from $1\times10^{-8}$ to $1\times10^{-4}$ mole, per mole of coated silver.

The antifoggant that is particularly preferably used in the present invention is an organic halide, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737.

The hydrophilic organic halides represented by the formula (P) mentioned in JP-A-2000-284399 can be preferably used as the antifoggant. Specifically, the compounds (P-1) to (P-118) mentioned in the same are preferably used.

The amount of the organic halides is preferably $1\times10^{-5}$ mole to 2 mole/mole Ag, more preferably $5\times10^{-5}$ mole to 1 mole/mole Ag, further preferably $1\times10^{-4}$ mole to $5\times10^{-1}$ mole/mole Ag, in terms of molar amount per mole of Ag (mole/mole Ag). The organic halides may be used each alone, or two or more of them may be used in combination.

Further, the salicylic acid derivatives represented by the formula (Z) mentioned in JP-A-2000-284399 can be preferably used as the antifoggant. Specifically, the compounds (A-1) to (A-60) mentioned in the same are preferably used. The amount of the salicylic acid represented by the formula (Z) is preferably $1\times10^{-5}$ mole to $5\times10^{-1}$ mole/mole Ag, more preferably $5\times10^{-5}$ mole to $1\times10^{-1}$ mole/mole Ag, further preferably $1\times10^{-4}$ mole to $5\times10^{-2}$ mole/mole Ag, in terms of molar amount per mole of Ag (mole/mole Ag). The salicylic acid derivatives may be used each alone, or two or more of them may be used in combination.

As antifoggants preferably used in the present invention, formalin scavengers are effective. Examples thereof include the compounds represented by the formula (S) and the exemplary compounds thereof (S-1) to (S-24) mentioned in JP-A-2000-221634.

The antifoggants used for the present invention may be used after being dissolved in an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, they may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, they may be used by dispersing powder of them in a suitable solvent such as water using a ball mill, colloid mill, sand grinder mill, MANTON GAULIN, microfluidizer, or by means of ultrasonic wave according to a known method for solid dispersion.

While the antifoggants used in the present invention may be added to any layer on the image-forming layer side with respect to the support, that is, the image-forming layer or another layer on that side, they are preferably added to the image-forming layer or a layer adjacent thereto. The image-forming layer is a layer containing a reducible silver salt (silver salt of an organic acid), preferably such a image-forming layer further containing a photosensitive silver halide.

The photothermographic material of the present invention may contain a mercapto compound, disulfide compound or thione compound so as to control the development by inhibiting or accelerating the development or improve the storage stability before or after the development.

In the case of using a mercapto compound in the present invention, any structure may be used but those represented by Ar—SM or Ar—S—S—Ar are preferred, wherein M is a hydrogen atom or an alkali metal atom, and Ar is an aromatic ring or condensed aromatic ring containing one or more nitrogen, sulfur, oxygen, selenium or tellurium atoms. The heteroaromatic ring is preferably selected from benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group of substituents consisting of a halogen (e.g., Br, Cl), hydroxy, amino, carboxy, alkyl (e.g., alkyl having one or more carbon atoms, preferably from 1–4 carbon atoms), alkoxy (e.g., alkoxy having one or more carbon atoms, preferably from 1–4 carbon atoms) and aryl (which may have a substituent). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-{3-(5-mercaptotetrazolyl)phenyl}urea, 2-mercapto-4-phenyloxazole and so forth. However, the present invention is not limited to these.

The amount of the mercapto compound is preferably from 0.0001–1.0 mole, more preferably from 0.001–0.3 mole, per mole of silver in the image-forming layer.

The photothermographic material of the present invention has an image-forming layer containing a silver salt of an organic acid, a reducing agent and a photosensitive silver halide on a support, and at least one protective layer is preferably provided on the image-forming layer. Further, the photothermographic material of the present invention preferably has at least one back layer on the side of the support opposite to the side of the image-forming layer (back surface), and polymer latex is used as binder of the image-forming layer, protective layer and back layer. The use of polymer latex for these layers enables coating with an aqueous system utilizing a solvent (dispersion medium) containing water as a main component. Not only this is advantageous for environment and cost, but also it makes it possible to provide photothermographic materials that generate no wrinkle upon heat development. Further, by using a support subjected to a predetermined heat treatment, there are provided photothermographic materials exhibiting little dimensional change in sizes before and after the heat development.

As the main binder for the image-forming layer side, polymer latex providing good photographic performance and enabling coating with an aqueous system is preferably used.

It is preferable to use the polymer latex explained below as the binder used for the present invention.

Among image-forming layers containing a photosensitive silver halide, at least one layer is preferably an image-forming layer utilizing polymer latex to be explained below in an amount of 50 weight % or more with respect to the total amount of binder. The polymer latex may be used not only in the image-forming layer, but also in the protective layer, back layer or the like. When the photothermographic material of the present invention is used for, in particular, printing use in which dimensional change causes problems, the polymer latex is preferably used also in a protective layer and a back layer. The term "polymer latex" used herein means a dispersion comprising hydrophobic water-insoluble polymer dispersed in a water-soluble dispersion medium as fine particles. The dispersed state may be one in which polymer is emulsified in a dispersion medium, one in which polymer underwent emulsion polymerization, micelle dispersion, one in which polymer molecules having a hydrophilic portion are dispersed in molecular state or the like. The polymer latex used in the present invention is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. The dispersed particles preferably have an average particle size of about 1–50000 nm, more preferably about 5–1000 nm. The particle size distribution of the dispersed particles is not particularly limited, and the particles may have either wide particle size distribution or monodispersed particle size distribution.

The polymer latex used in the present invention may be ordinary polymer latex having a uniform structure latex or latex of the so-called core/shell type. In case of cdre/shell type latex, use of different glass transition temperatures of the core and shell may be preferred.

Preferred range of the glass transition temperature (Tg) of the polymer latex preferably used as the binder in the present invention varies for the protective layer, back layer and image-forming layer. As for the image-forming layer, the glass transition temperature is preferably 30–40° C. for accelerating diffusion of photographic elements during the heat development. Polymer latex used for the protective layer or back layer preferably has a glass transition temperature of 25–70° C., because these layers are brought into contact with various apparatuses.

The polymer latex used in the present invention preferably shows a minimum film forming temperature (MFT) of about −30–90° C., more preferably about 0–70° C. A film-forming aid may be added in order to control the minimum film forming temperature. The film-forming aid is also referred to as a plasticizer, and consists of an organic compound (usually an organic solvent) that lowers the minimum film forming temperature of the polymer latex. It is explained in, for example, the aforementioned Soichi Muroi, "Gosei Latex no Kagaku (Chemistry of Synthetic Latex)", Kobunshi Kanko Kai (1970).

Examples of polymer species used for the polymer latex used in the present invention include acrylic resins, polyvinyl acetate resins, polyester resins, polyurethane resins, rubber resins, polyvinyl chloride resins, polyvinylidene chloride resins and polyolefin resins, copolymers of monomers constituting these resins and so forth. The polymers may be linear, branched or crosslinked. They may be so-called homopolymers in which a single kind of monomers are polymerized, or copolymers in which two or more different kinds of monomers are polymerized. The copolymers may be random copolymers or block copolymers. The polymers may have a number average molecular weight of 5,000 to 1,000,000, preferably from 10,000 to 100,000. Polymers having a too small molecular weight may unfavorably suffer from insufficient mechanical strength of the image-forming layer, and those having a too large molecular weight may unfavorably suffer from bad film forming property.

Specific examples of the polymer latex used as the binder of the image-forming layer of the photothermographic material of the present invention include latex of methyl methacrylate/ethyl acrylate/methacrylic acid copolymer, latex of methyl methacrylate/butadiene/itaconic acid copolymer, latex of ethyl acrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/meth-acrylic acid copolymer, latex of methyl methacrylate/vinyl chloride/acrylic acid copolymer, latex of vinylidene chloride/ethyl acrylate/acrylonitrile/methacrylic acid copolymer and so forth. More specifically, there can be mentioned latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate (95 weight %)/methacrylic acid (5 weight %) copolymer and so forth. Such polymers are also commercially available and examples thereof include acrylic resins such as CEBIAN A-4635, 46583, 4601 (all produced by Dicel Kagaku Kogyo Co., Ltd), Nipol LX811, 814, 821, 820, 857 (all produced by Nippon Zeon Co., Ltd.), VONCORT R3340, R3360, R3370, 4280 (all produced by Dai-Nippon Ink & Chemicals, Inc.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber resins such as LACSTAR 7310K, 3307B, 4700H, 7132C (all produced by Dai-Nippon Ink & Chemicals, Inc.), Nipol LX410, 430, 435, 438C (all produced by Nippon Zeon Co., Ltd.); polyvinyl chloride resins such as G351, G576 (both produced by Nippon Zeon Co., Ltd.); polyvinylidene chloride resins such as L502, L513 (both produced by Asahi Chemical Industry Co., Ltd.), ARON D7020, D504, D5071 (all produced by Mitsui Toatsu Co., Ltd.); and olefin resins such as CHEMIPEARL S120 and SA100 (both produced by Mitsui Petrochemical Industries, Ltd.) and so forth. These polymers may be used individually or, if desired, as a blend of two or more of them.

The image-forming layer preferably contains 50 weight % or more, more preferably 70 weight % or more, of the aforementioned polymer latex based on the total binder.

If desired, the image-forming layer may contain a hydrophilic polymer in an amount of 50 weight % or less of the total binder, such as gelatin, polyvinyl alcohol, methyl cellulose, hydroxypropyl cellulose, carboxymethyl cellulose and hydroxypropylmethyl cellulose. The amount of the hydrophilic polymer is preferably 30 weight % or less, more preferably 15 weight % or less, of the total binder in the image-forming layer.

The image-forming layer is preferably formed by coating an aqueous coating solution and then drying the coating solution. The term "aqueous" as used herein means that water content of the solvent (dispersion medium) in the coating solution is 60 weight % or more. In the coating solution, the component other than water may be a water-miscible organic solvent such as methyl alcohol, ethyl alcohol, isopropyl alcohol, methyl cellosolve, ethyl cellosolve, dimethylformamide and ethyl acetate. Specific examples of the solvent composition include water/methanol=90/10, water/methanol=70/30, water/ethanol=90/10, water/isopropanol=90/10, water/dimethylformamide=95/5, water/methanol/dimethylformamide=80/15/5, and water/methanol/dimethylformamide=90/5/5 (the numerals indicate weight %).

The total amount of the binder in the image-forming layer is preferably from 0.2–30 g/m$^2$, more preferably from 1–15 g/m$^2$. The image-forming layer may contain a crosslinking agent for crosslinking, surfactant for improving coatability and so forth.

Further, a combination of polymer latexes having different I/O values is also preferably used as the binder of the protective layer. The I/O values are obtained by dividing an inorganicity value with an organicity value, both of which values are based on the organic conceptual diagram described in JP-A-2000-267226, paragraphs 0025–0029.

In the present invention, a plasticizer (e.g., benzyl alcohol, 2,2,4-trimethylpentanediol-1,3-monoisobutyrate etc.) described in JP-A-2000-267226, paragraphs 0021–0025 can be added as required to control the film-forming temperature. Further, a hydrophilic polymer may be added to a polymer binder, and a water-miscible organic solvent may be added to a coating solution as described in JP-A-2000-267226, paragraphs 0027–0028.

First polymer latex introduced with functional groups, and a crosslinking agent and/or second polymer latex having a functional group that can react with the first polymer latex, which are described in JP-A-2000-19678, paragraphs 0023–0041, can also be added to each layer.

The aforementioned functional groups may be carboxyl group, hydroxyl group, isocyanate group, epoxy group, N-methylol group, oxazolinyl group or so forth. The crosslinking agent is selected from epoxy compounds, isocyanate compounds, blocked isocyanate compounds, methylolated compounds, hydroxy compounds, carboxyl compounds, amino compounds, ethylene-imine compounds, aldehyde compounds, halogen compounds and so forth. Specific examples of the crosslinking agent include, as isocyanate compounds, hexamethylene isocyanate, Duranate WB40-80D, WX-1741 (Asahi Chemical Industry Co., Ltd.), Bayhydur 3100 (Sumitomo Bayer Urethane Co.,Ltd.), Takenate WD725 (Takeda Chemical Industries, Ltd.), Aquanate 100, 200 (Nippon Polyurethane Industry Co., Ltd.), aqueous dispersion type polyisocyanates mentioned in JP-A-9-160172; as an amino compound, Sumitex Resin M-3 (Sumitomo Chemical Co., Ltd.); as an epoxy compound, Denacol EX-614B (Nagase Chemicals Ltd.); as a halogen compound, 2,4-dichloro-6-hydroxy-1,3,5-triazine sodium salt and so forth.

The total amount of the binder for the image-forming layer is preferably in the range of 0.2–30 g/m2, more preferably 1.0–15 g/m$^2$.

The total amount of the binder for the protective layer is preferably an amount providing a film thickness of 3 $\mu$m or more. Specifically, it is preferably in the range of 1–10.0 g/m$^2$, more preferably 2–6.0 g/m$^2$.

In the present invention, the thickness of the protective layer is preferably 3 $\mu$m or more, more preferably 4 $\mu$m or more. While the upper limit of the thickness of the protective layer is not particularly limited, it is preferably 10 $\mu$m or less, more preferably 8 $\mu$m or less, in view of coating and drying.

The total amount of the binder for the back layer is preferably in the range of 0.01–10.0 g/m$^2$, more preferably 0.05–5.0 g/m$^2$.

In the present invention, each of these layers may be provided as two or more layers. When the image-forming layer consists of two or more layers, it is preferred that polymer latex should be used as a binder for all of the layers. The protective layer is a layer provided on the image-forming layer, and it may consist of two or more layers. In such a case, it is preferred that polymer latex should be used for at least one of the layers, especially the outermost protective layer. Further, the back layer is a layer provided on an undercoat layer for the back surface of the support, and it may consist of two or more layers. In such a case, it is preferred that polymer latex should be used for at least one of the layers, especially the outermost back layer.

A lubricant may be added to the photothermographic material of the present invention. A lubricant referred to in the present specification means a compound which, when present on a surface of an object, reduces the friction coefficient of the surface compared with that observed when the compound is absent. The type of the lubricant is not particularly limited.

Examples of the lubricant that can be used in the present invention include the compounds described in JP-A-11-84573, paragraphs 0061–0064 and JP-A-2001-83679, paragraphs 0049–0062.

Preferred examples of the lubricant include Cellosol 524 (main component: carnauba wax), Polyron A, 393, H-481 (main component: polyethylene wax), Himicron G-110 (main component: ethylene bisstearic acid amide), Himicron G-270 (main component: stearic acid amide) (all produced by Chukyo Yushi Co., Ltd.), W-1: $C_{16}H_{33}$—O—$SO_3Na$
W-2: $C_{18}H_{37}$—O—$SO_3Na$
and so forth.

The amount of the lubricant is 0.1–50 weight %, preferably 0.5–30 weight %, of the amount of binder in a layer to which the lubricant is added.

When such a development apparatus as disclosed in JP-A-2000-171935 or JP-A-2001-83679 is used for the heat development of the photothermographic material of the present invention, in which a photothermographic material is transported in a pre-heating section by facing rollers, and the material is transported in a heat development section by driving force of rollers facing the side of the material having the image-forming layer, while the opposite back surface slides on a smooth surface, ratio of friction coefficients of the outermost surface layer of the side of the photothermographic material having the image-forming layer and the outermost surface layer of the back side is 1.5 or more at the heat development temperature. Although the ratio is not particularly limited as for its upper limit, it is preferably about 30 or less. The ratio of friction coefficients can be obtained in accordance with the following equation.

Ratio of friction coefficients=coefficient of dynamic friction between roller material of heat development apparatus and surface of image-forming layer side ($\mu e$)/coefficient of dynamic friction between material of smooth surface member of heat development apparatus and back surface ($\mu b$).

The value of $\mu b$ is preferably 1.0 or less, more preferably 0.05–0.8.

The lubricity between the materials of the heat development apparatus and the surface of image-forming layer side and/or the opposite back surface can be controlled by adding a lubricant to the outermost layers and adjusting its addition amount.

It is preferred that undercoat layers containing a vinylidene chloride copolymer comprising 70 weight % or more of repetition units of vinylidene chloride monomers should be provided on the both surface of the support. Such a vinylidene chloride copolymer is disclosed in JP-A-64-20544, JP-A-1-180537, JP-A-1-209443, JP-A-1-285939, JP-A-1-296243, JP-A-2-24649, JP-A-2-24648, JP-A-2-184844, JP-A-3-109545, JP-A-3-137637, JP-A-3-141346, JP-A-3-141347, JP-A-4-96055, U.S. Pat. No. 4,645,731, JP-A-4-68344, Japanese Patent No. 2,557,641, page 2, right column, line 20 to page 3, right column, line 30, JP-A-2000-39684, paragraphs 0020–0037, and JP-A-2001-83679, paragraphs 0063–0080.

If the vinylidene chloride monomer content is less than 70 weight %, sufficient moisture resistance cannot be obtained, and dimensional change with time after the heat development will become significant. The vinylidene chloride copolymer preferably contains repetition units of carboxyl group-containing vinyl monomers, besides the repetition units of vinylidene chloride monomer. A polymer consists solely of vinylidene chloride monomers crystallizes, and therefore it becomes difficult to form a uniform film when a moisture resistant layer is coated. Further, carboxyl group-containing vinyl monomers are indispensable for stabilizing the polymer. For these reasons, the repetition units of carboxyl group-containing vinyl monomers are added to the polymer.

The vinylidene chloride copolymer used in the present invention preferably has a molecular weight of 45,000 or less, more preferably 10,000–45,000, as a weight average molecular weight. When the molecular weight becomes large, adhesion between the vinylidene chloride copolymer layer and the support layer composed of polyester or the like tends to be degraded.

The content of the vinylidene chloride copolymer used in the present invention is such an amount that the undercoat layers should have a thickness of 0.3 $\mu$m or more, preferably 0.3 $\mu$m to 4 $\mu$m, as a total thickness of the undercoat layers containing the vinylidene chloride copolymer for one side.

The vinylidene chloride copolymer layer as an undercoat layer is preferably provided a first undercoat layer, which is directly coated on the support, and usually one vinylidene chloride copolymer layer is provided for each side. However, two or more of layers may be provided as the case may be. When multiple layers consisting of two or more layers are provided, the total amount of the vinylidene chloride copolymer is preferably within the range defined above.

Such layers may contain a crosslinking agent, matting agent or the like, in addition to the vinylidene chloride copolymer.

The support may be coated with an undercoat layer comprising SBR, polyester, gelatin or the like as a binder, in addition to the vinylidene chloride copolymer layer, as required. The undercoat layer may have a multilayer structure, and may be provided on one side or both sides of the support. The undercoat layer generally has a thickness (per layer) of 0.01–5 $\mu$m, more preferably 0.05–1 $\mu$m.

For the photothermographic material of the present invention, various kinds of supports can be used. Typical supports comprise polyester such as polyethylene terephthalate (PET) and polyethylene naphthalate, cellulose nitrate, cellulose ester, polyvinylacetal, syndiotactic polystyrene, polycarbonate, paper support of which both surfaces are coated with polyethylene or the like. Among these, biaxially stretched polyester, especially polyethylene terephthalate, is preferred in view of strength, dimensional stability, chemical resistance and so forth. The support preferably has a thickness of 90–180 $\mu$m as a base thickness except for the undercoat layers.

Preferably used as the support of the photothermographic material of the present invention is a polyester film, in particular polyethylene terephthalate film, subjected to a heat treatment in a temperature range of 130–185° C. in order to relax the internal distortion formed in the film during the biaxial stretching so that thermal shrinkage distortion occurring during the heat development should be eliminated. Such films are described in JP-A-10-48772, JP-A-10-10676, JP-A-10-10677, JP-A-11-65025 and JP-A-11-138648.

After such a heat treatment, the support preferably shows dimensional changes caused by heating at 120° C. for 30 seconds of −0.03% to +0.01% for the machine direction (MD) and 0 to 0.04% for the transverse direction (TD).

The photothermographic material of the present invention can be subjected to an antistatic treatment using the conductive metal oxides and/or fluorinated surfactants disclosed in JP-A-11-84573, paragraphs 0040–0051 for the purposes of reducing adhesion of dusts, preventing generation of static marks, preventing transportation failure during the automatic transportation and so forth. As the conductive metal oxides, the conductive acicular tin oxide doped with antimony disclosed in U.S. Pat. No. 5,575,957 and JP-A-11-223901, paragraphs 0012–0020 and the fibrous tin oxide doped with antimony disclosed in JP-A-4-29134 can be preferably used.

The layer containing a metal oxide should show a surface specific resistance (surface resistivity) of $10^{12}$ O or less, preferably $10^{11}$ O or less, in an atmosphere at 25° C. and 20% of relative humidity. Such a resistivity provides good antistatic property. Although the surface resistivity is not particularly limited as for the lower limit, it is usually about $10^{7}$ O.

The photothermographic material of the present invention preferably has a Beck's smoothness of 2000 seconds or less, more preferably 10 seconds to 2000 seconds, as for at least one of the outermost surfaces of the image-forming layer side and the opposite side, preferably as for the both sides.

Beck's smoothness referred to in the present invention can be easily determined according to Japanese Industrial Standard (JIS) P8119, "Test Method for Smoothness of Paper and Paperboard by Beck Test Device" and TAPPI Standard Method T479.

Beck's smoothness of the outermost surfaces of the image-forming layer side and the opposite side of the photothermographic material can be controlled by suitably selecting particle size and amount of matting agent to be contained in the layers constituting the surfaces as described in JP-A-11-84573, paragraphs 0052–0059.

In the present invention, water-soluble polymers are preferably used as a thickener for imparting coating property. The polymers may be either naturally occurring polymers or synthetic polymers, and types thereof are not particularly limited. Specifically, there are mentioned naturally occurring polymers such as starches (corn starch, starch etc.), seaweeds (agar, sodium arginate etc.), vegetable adhesive substances (gum arabic etc.), animal proteins (glue, casein, gelatin, egg white etc.) and adhesive fermentation products (pullulan, dextrin etc.), semi-synthetic polymers such as semi-synthetic starches (soluble starch, carboxyl starch, dextran etc.) and semi-synthetic celluloses (viscose, methyl cellulose, ethyl cellulose, carboxymethyl cellulose, hydroxyethyl cellulose, hydroxypropyl cellulose, hydroxypropylmethyl cellulose etc.), synthetic polymers such as polyvinyl alcohol, polyacrylamide, polyvinylpyrrolidone, polyethylene glycol, polypropylene glycol, polyvinyl ether, polyethylene-imine, polystyrenesulfonic acid or styrenesulfonic acid copolymer, polyvinylsulfinic acid or vinylsulfinic acid copolymer, polyacrylic acid or acrylic acid copolymer, acrylic acid or acrylic acid copolymer, maleic acid copolymer, maleic acid monoester copolymer and polyacryloyl methylpropanesulfonate or acryloyl methylpropanesulfonate copolymer and so forth.

Among these, water-soluble polymers preferably used are sodium arginate, gelatin, dextran, dextrin, methyl cellulose, carboxymethyl cellulose, hydroxyethyl cellulose, hydroxypropyl cellulose, polyvinyl alcohol, polyacrylamide, polyvinylpyrrolidone, polyethylene glycol, polypropylene glycol, polystyrenesulfonic acid or styrenesulfonic acid copolymer, polyacrylic acid or acrylic acid copolymer, maleic acid monoester copolymer, polyacryloylmethyl propanesulfonate or acryloylmethyl propanesulfonate copolymer, and they are particularly preferably used as a thickener.

Among these, particularly preferred thickeners are gelatin, dextran, methyl cellulose, carboxymethyl cellulose, hydroxyethyl cellulose, polyvinyl alcohol, polyacrylamide, polyvinylpyrrolidone, polystyrenesulfonate or styrenesulfonate copolymer, polyacrylic acid or acrylic acid copolymer, maleic acid monoester copolymer and so forth. These compounds are described in detail in "Shin Suiyosei Polymer no Oyo to Shijo (Applications and Market of Water-soluble Polymers, New Edition)", CMC Shuppan, Inc., Ed. by Shinji Nagatomo, Nov. 4, 1988.

The amount of the water-soluble polymers used as a thickener is not particularly limited so long as viscosity is increased when they are added to a coating solution. Their concentration in the solution is generally 0.01–30 weight %, preferably 0.05–20 weight %, particularly preferably 0.1–10 weight %. Viscosity to be increased by the polymers is preferably 1–200 mPa·s, more preferably 5–100 mPa·s, as increased degree of viscosity compared with the initial viscosity. The viscosity is represented by values measured at 25° C. by using B type rotational viscometer. Upon addition to a coating solution or the like, it is generally desirable that the thickener is added as a solution diluted as much as possible. It is also desirable to perform the addition with sufficient stirring.

Surfactants used in the present invention will be described below. The surfactants used in the present invention are classified into dispersing agents, coating agents, wetting agents, antistatic agents, photographic property controlling agents and so forth depending on the purposes of use thereof, and the purposes can be attained by suitably selecting the surfactants described below and using them. As the surfactants used in the present invention, any of nonionic or ionic (anionic, cationic, betaine) surfactants can be used. Further, fluorinated surfactants can also be preferably used.

Preferred examples of the nonionic surfactant include surfactants having polyoxyethylene, polyoxypropylene, polyoxybutylene, polyglycidyl, sorbitan or the like as the nonionic hydrophilic group. Specifically, there can be mentioned polyoxyethylene alkyl ethers, polyoxyethylene alkyl phenyl ethers, polyoxyethylene/polyoxypropylene glycols, polyhydric alcohol aliphatic acid partial esters, polyoxyethylene polyhydric alcohol aliphatic acid partial esters, polyoxyethylene aliphatic acid esters, polyglycerin aliphatic acid esters, aliphatic acid diethanolamides, triethanolamine aliphatic acid partial esters and so forth.

Examples of anionic surfactants include carboxylic acid salts, sulfuric acid salts, sulfonic acid salts and phosphoric acid salts. Typical examples thereof are aliphatic acid salts, alkylbenzenesulfonates, alkylnaphthalenesulfonates, alkylsulfonates, a-olefinsulfonates, dialkylsulfosuccinates, a-sulfonated aliphatic acid salts, N-methyl-N-oleyltaurine, petroleum sulfonates, alkylsulfates, sulfated fats and oils, polyoxyethylene alkyl ether sulfates, polyoxyethylene alkyl phenyl ether sulfates, polyoxyethylene styrenylphenyl ether sulfates, alkyl phosphates, polyoxyethylene alkyl ether phosphates, naphthalenesulfonate formaldehyde condensates and so forth.

Examples of the cationic surfactants include amine salts, quaternary ammonium salts, pyridinium salts and so forth, and primary to tertiary amine salts and quaternary ammonium salts (tetraalkylammonium salts, trialkylbenzylammonium salts, alkylpyridinium salts, alkylimidazolium salts etc.) can be mentioned.

Examples of betaine type surfactants include carboxybetaine, sulfobetaine and so forth, and N-trialkyl-N-carboxymethylammonium betaine, N-trialkyl-N-sulfoalkyleneammonium betaine and so forth can be mentioned.

These surfactants are described in Takao Kariyone, "Kaimen Kasseizai no Oyo (Applications of Surfactants", Saiwai Shobo, Sep. 1, 1980). In the present invention, amounts of the preferred surfactants are not particularly limited, and they can be used in an amount providing desired surface activating property. The coating amount of the fluorine-containing surfactants is preferably 0.01–250 mg per 1 $m^2$.

Specific examples of the surfactants are mentioned below. However, the surfactants are not limited to these (—$C_6H_4$— represents phenylene group in the following formulas).

WA-1: $C_{16}H_{33}(OCH_2CH_2)_{10}OH$
WA-2: $C_9H_{19}$—$C_6H_4$—$(OCH_2CH_2)_{12}OH$
WA-3: Sodium dodecylbenzenesulfonate
WA-4: Sodium tri(isopropyl)naphthalenesulfonate
WA-5: Sodium tri(isobutyl)naphthalenesulfonate
WA-6: Sodium dodecylsulfate
WA-7: a-Sulfasuccinic acid di(2-ethylhexyl) ester sodium salt
WA-8: $C_8H_{17}$—$C_6H_4$—$(CH_2CH_2O)_3(CH_2)_2SO_3K$
WA-10: Cetyltrimethylammonium chloride
WA-11: $C_{11}H_{23}CONHCH_2CH_2N^{(+)}(CH_3)_2$—$CH_2COO^{(-)}$
WA-12: $C_8F_{17}SO_2N(C_3H_7)(CH_2CH_2O)_{16}H$
WA-13: $C_8F_{17}SO_2N(C_3H_7)CH_2COOK$
WA-14: $C_8F_{17}SO_3K$
WA-15: $C_8F_{17}SO_2N(C_3H_7)(CH_2CH_2O)_4(CH_2)_4SO_3Na$
WA-16: $C_8F_{17}SO_2N(C_3H_7)(CH_2)_3OCH_2CH_2N^{(+)}(CH_3)_3$—$CH_3.C_6H_4$—$SO_3^{(-)}$

WA-17: $C^8F_{17}SO_2N(C_3H_7)CH_2CH_2CH_2N^{(+)}(CH_3)_2$—$CH_2COO^{(-)}$

In a preferred embodiment of the present invention, an intermediate layer may be provided as required in addition to the image-forming layer and the protective layer. To improve the productivity or the like, it is preferred that these multiple layers should be simultaneously coated as stacked layers by using aqueous systems. While extrusion coating, slide bead coating, curtain coating and so forth can be mentioned as the coating method, the slide bead coating method shown in JP-A-2000-2964, FIG. 1 is particularly preferred.

Silver halide photographic photosensitive materials utilizing gelatin as a main binder are rapidly cooled in a first drying zone, which is provided downstream from a coating dye. As a result, the gelatin gels and the coated film is solidified by cooling. The coated film that no longer flows as a result of the solidification by cooling is transferred to a second drying zone, and the solvent in the coating solution is evaporated in this drying zone and subsequent drying zones so that a film is formed. As drying method after the second drying zone, there can be mentioned the air loop method where a support supported by rollers is blown by air jet from a U-shaped duct, the helix method (air floating method) where the support is helically wound around a cylindrical duct and dried during transportation and so forth.

When the layers are formed by using coating solutions comprising polymer latex as a main component of binder, the flow of the coating solution cannot be stopped by rapid cooling. Therefore, the predrying may be insufficient only with the first drying zone. In such a case, if such a drying method as utilized for silver halide photographic photosensitive materials is used, uneven flow or uneven drying may occur, and therefore serious defects are likely to occur on the coated surface.

The preferred drying method for the present invention is such a method as described in JP-A-2000-2964, where the drying is attained in a horizontal drying zone irrespective of the drying zone, i.e., the first or second drying zone, at least until the constant rate drying is finished. The transportation of the support during the period immediately after the coating and before the support is introduced into the horizontal drying zone may be performed either horizontally or not horizontally, and the rising angle of the material with respect to the horizontal direction of the coating machine may be within the range of 0–70°. Further, in the horizontal drying zone used in the present invention, the support may be transported at an angle within ±15° with respect to the horizontal direction of the coating machine, and it does not mean exactly horizontal transportation.

The "constant rate drying" referred to in the present specification means a drying process in which all entering calorie is consumed for evaporation of solvent at a constant liquid film temperature. "Decreasing rate drying" referred to in the present specification means a drying process where the drying rate is reduced by various factors (for example, diffusion of moisture in the material for transfer becomes a rate-limiting factor, evaporation surface is recessed etc.) in an end period of the drying, and imparted calorie is also used for increase of liquid film temperature. The critical moisture content for the transition from the constant rate drying to the decreasing rate drying is 200–300%. When the constant rate drying is finished, the drying has sufficiently progressed so that the flowing should be stopped, and therefore such a drying method as used for silver halide photographic photosensitive materials may also be employable. In the present invention, however, it is preferred that the drying should be performed in a horizontal drying zone until the final drying degree is attained even after the constant rate drying.

As for the drying condition for forming the image-forming layer and/or protective layer, it is preferred that the liquid film surface temperature during the constant rate drying should be higher than minimum film forming temperature (MTF) of polymer latex (MTF is usually higher than glass transition temperature Tg of polymer by 3–5° C.). In many cases, it is usually selected from the range of 25–40° C., because of limitations imposed by production facilities. Further, the dry bulb temperature during the decreasing rate drying is preferably lower than Tg of the support (in the case of PET, usually 80° C. or lower). The "liquid film surface temperature" referred to in this specification means a solvent liquid film surface temperature of coated liquid film coated on a support, and the "dry bulb temperature" means a temperature of drying air blow in the drying zone.

If the constant rate drying is performed under a condition that lowers the liquid film surface temperature, the drying is likely to become insufficient. Therefore, the film-forming property of the protective layer is markedly degraded, and it becomes likely that cracks will be generated on the film surface. Further, film strength also becomes weak and thus it becomes likely that there arise serious problems, for example, the film becomes liable to suffer from scratches during transportation in a light exposure apparatus or heat development apparatus.

On the other hand, if the drying is performed under a condition that elevates the liquid film surface temperature, the protective layer mainly consisting of polymer latex rapidly becomes a film, but the under layers including the image-forming layer do not lose flowability, and hence it is likely that unevenness is formed on the surface. Furthermore, if the support (base) is subjected to a temperature higher than its Tg, dimensional stability and resistance to curl tendency tends to be degraded.

While the same is applied to the serial coating, in which an under layer is coated and then an upper layer is coated, as for properties of coating solutions, when an upper layer and a lower layer are coated as stacked layers by coating the upper layer before drying of the lower layer, in particular, a coating solution for the image-forming layer and a coating solution for protective layer preferably show a pH difference of 2.5 or less, and a smaller value of this pH difference is more preferred. If the pH difference becomes large, it becomes likely that microscopic aggregations are generated at the interface of the coating solutions and thus it becomes likely that serious defects of surface condition such as coating stripes occur during continuous coating for a long length.

The coating solution for the image-forming layer preferably has aviscosity of 15–100 mPa·S, more preferably 30–70 mPa·S, at 25° C. The coating solution for the protective layer preferably has a viscosity of 5–75 mPa·S, more preferably 20–50 mPa·S, at 25° C. These viscosities are measured by using a B-type viscometer.

The rolling up after the drying is preferably carried out under conditions of a temperature of 20–30° C. and a relative humidity of 45±20%. As for rolled shape, the material may be rolled so that the surface of the image-forming layer side may be toward the outside or inside of the roll according to a shape suitable for subsequent processing. Further, it is also preferred that, when the material is further processed in a rolled shape, the material should be rolled up into a shape of roll in which the sides are reversed compared with the original rolled shape during processing, in order to eliminate the curl generated while the material is in the original rolled shape. Relative humidity of the photosensitive material is preferably controlled to be in the range of 20–55% (measured at 25° C.).

In conventional coating solutions for photographic emulsions, which are viscous solutions containing silver halide and gelatin as a base, air bubbles are dissolved in the solutions and eliminated only by feeding the solution by pressurization, and air bubbles are scarcely formed even when the solutions are placed under atmospheric pressure again for coating. However, as for the coating solution for the image-forming layer containing dispersion of silver salt of organic acid, polymer latex and so forth preferably used in the present invention, only feeding of it by pressurization is likely to result in insufficient degassing. Therefore, it is preferably fed so that air/liquid interfaces should not be produced, while giving ultrasonic vibration to perform degassing.

Figure 2:
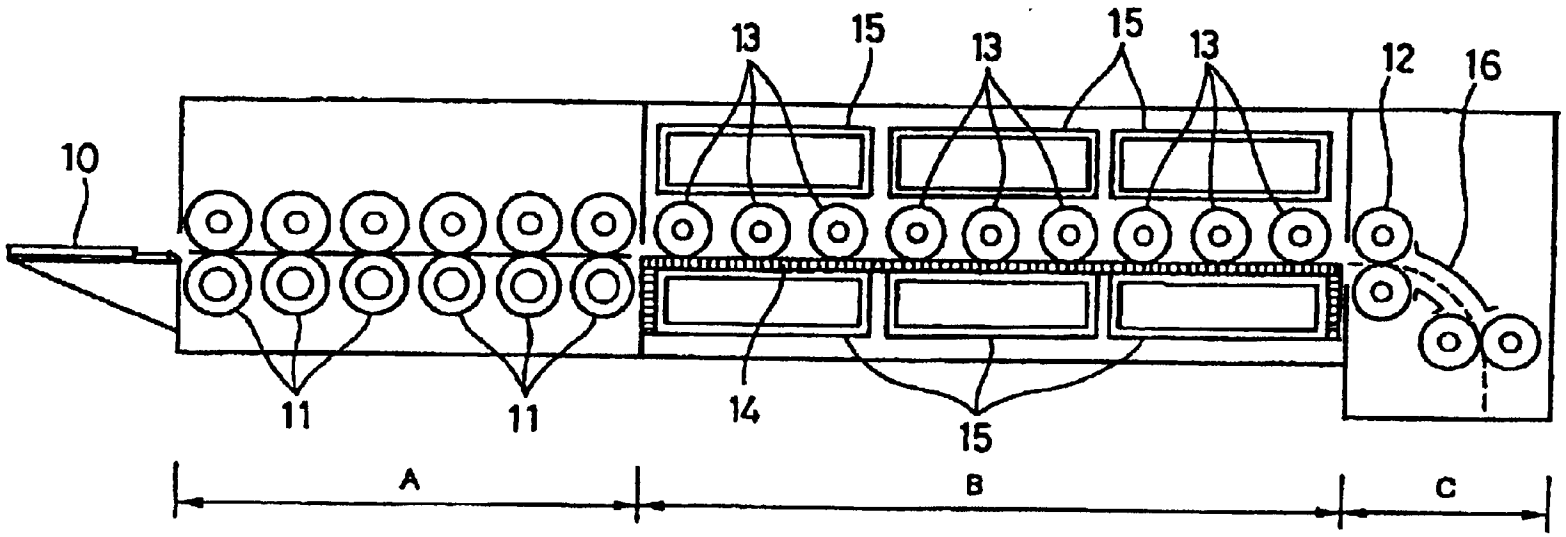
FIG. 2 is a side view of an exemplary heat developing apparatus used for heat development of the photothermographic material of the present invention. In the figure, there are shown a photothermographic material 10, carrying-in roller pairs 11, carrying-out roller pairs 12, rollers 13, a flat surface 14, heaters 15, and guide panels 16. The apparatus consists of a preheating section A, a heat development section B, and a gradual cooling section C.

In the present invention, the degassing of a coating solution is preferably performed by a method where the coating solution is degassed under reduced pressure before coating, and further the solution is maintained in a pressurized state at a pressure of 1.5 kg/cm$^2$ or more and continuously fed so that air/liquid interfaces should not be formed, while giving ultrasonic vibration to the solution. Specifically, the method disclosed in JP-B-55-6405 (from page 4, line 20 to page 7, line 11) is preferred. As an apparatus for performing such degassing, the apparatus disclosed in JP-A-2000-98534, examples and FIG. 2 is preferably used.

The pressurization condition is preferably 1.5 kg/cm$^2$ or more, more preferably 1.8 kg/cm$^2$ or more. While the pressure is not particularly limited as for its upper limit, it is usually about 5 kg/cm$^2$ or less. Ultrasonic wave given to the solution should have a sound pressure of 0.2 V or more, preferably 0.5 V to 3.0 V. Although a higher sound pressure is generally preferred, an unduly high sound pressure provides high temperature portions due to cavitation, which may cause fogging. While frequency of the ultrasonic wave is not particularly limited, it is usually 10 kHz or higher, preferably 20 kHz to 200 kHz. The degassing under reduced pressure means a process where a coating solution is placed in a sealed tank (usually a tank in which the solution is prepared or stored) under reduced pressure to increase diameters of air bubbles in the coating solution so that degassing should be attained by buoyancy imparted to the air bubbles. The reduced pressure condition for the degassing under reduced pressure is −200 mmHg or a pressure condition lower than that, preferably −250 mmHg or a pressure condition lower than that. Although the lower limit of the pressure condition is not particularly limited, it is usually about −800 mmHg or higher. Time under the reduced pressure is 30 minutes or more, preferably 45 minutes or more, and its upper limit is not particularly limited.

In the present invention, the image-forming layer, protective layer for the image-forming layer, undercoat layer and back layer may contain a dye in order to prevent halation and so forth as disclosed in JP-A-11-84573, paragraphs 0204–0208 and JP-A-2001-83679, paragraphs 0240–0241.

Various dyes and pigments can be used for the image-forming layer for improvement of color tone and prevention of irradiation. While arbitrary dyes and pigments may be used for the image-forming layer, the compounds disclosed in JP-A-11-119374, paragraphs 0297, for example, can be used. These dyes may be added in any form such as solution, emulsion, solid microparticle dispersion and macromolecule mordant mordanted with the dyes. Although the amount of these compounds is determined by the desired absorption, they are preferably used in an amount of $1\times1^{-6}$ g to 1 g per 1 m$^2$, in general.

When an antihalation dye is used in the present invention, the dye may be any compound so long as it shows intended absorption in a desired range and sufficiently low absorption in the visible region after development, and provides a preferred absorption spectrum pattern of the back layer. For example, the compounds disclosed in JP-A-11-119374, paragraph 0300 can be used. There can also be used a method of reducing density obtained with a dye by thermal decoloration as disclosed in Belgian Patent No. 733,706, a method of reducing the density by decoloration utilizing light irradiation as disclosed in JP-A-54-17833 and so forth.

When the photothermographic material of the present invention after heat development is used as a mask for the production of printing plate from a PS plate, the photothermographic material after heat development carries information for setting up light exposure conditions of platemaking machine for PS plates or information for setting up platemaking conditions including transportation conditions of mask originals and PS plates as image information. Therefore, in order to read such information, densities (amounts) of the aforementioned irradiation dye, halation dye and filter dye are limited. Because the information is read by LED or laser, Dmin (minimum density) in a wavelength region of the sensor must be low, i.e., the absorbance must be 0.3 or less. For example, a platemaking machine S-FNRIII produced by Fuji Photo Film Co., Ltd. uses a light source having a wavelength of 670 nm for a detector for detecting resister marks and a bar code reader. Further, platemaking machines of APML series produced by Shimizu Seisaku Co., Ltd. utilize a light source at 670 nm as a bar code reader. That is, if Dmin (minimum density) around 670 nm is high, the information on the film cannot be correctly detected, and thus operation errors such as transportation failure, light exposure failure and so forth are caused in platemaking machines. Therefore, in order to read information with a light source of 670 nm, Dmin around 670 nm must be low and the absorbance at 660–680 nm after the heat development must be 0.3 or less, more preferably 0.25 or less. Although the absorbance is not particularly limited as for its lower limit, it is usually about 0.10.

In the present invention, as the exposure apparatus used for the imagewise light exposing, any apparatus may be used so long as it is an exposure apparatus enabling light exposure with an exposure time of $10^{-7}$ second or shorter. However, a light exposure apparatus utilizing a laser diode (LD) or a light emitting diode (LED) as a light source is preferably used in general. In particular, LD is more preferred in view of high output and high resolution. Any of these light sources may be used so long as they can emit a light of electromagnetic wave spectrum of desired wavelength range. For example, as for LD, dye lasers, gas lasers, solid state lasers, semiconductor lasers and so forth can be used.

The light exposure in the present invention is performed with overlapped light beams of light sources. The term "overlapped" means that a vertical scanning pitch width is smaller than the diameter of the beams. For example, the overlap can be quantitatively expressed as FWHM/vertical-scanning pitch width (overlap coefficient), where the beam diameter is represented as a half width of beam strength (FWHM). In the present invention, it is preferred that this overlap coefficient is 0.2 or more.

The scanning method of the light source of the light exposure apparatus used in the present invention is not particularly limited, and the cylinder external surface scanning method, cylinder internal surface scanning method, flat surface scanning method and so forth can be used. Although the channel of light source may be either single channel or multichannel, a multichannel comprising two or more of laser heads is preferred, because it provides high output and shortens writing time. In particular, for the cylinder external surface scanning method, a multichannel carrying several to several tens of laser heads is preferably used.

The photothermographic material of the present invention shows low haze upon the light exposure, and therefore it is likely to generate interference fringes. As techniques for preventing such interference fringes, there are known a technique of obliquely irradiating a photosensitive material with a laser light as disclosed in JP-A-5-113548, a technique of utilizing a multimode laser disclosed in WO95/31754 and so forth, and these techniques are preferably used.

Although any method may be used as the heat development process of the image-forming method used for the present invention, the development is usually performed by heating a photothermographic material exposed imagewise. As preferred embodiments of heat development apparatus to be used, there are heat development apparatuses in which a photothermographic material is brought into contact with a heat source such as heat roller or heat drum as disclosed in JP-B-5-56499, JP-A-9-292695, JP-A-9-297385 and WO95/30934, and heat development apparatuses of non-contact type as disclosed in JP-A-7-13294, WO97/28489, WO97/28488 and WO97/28487. Particularly preferred embodiments are the heat development apparatuses of non-contact type. The temperature for the development is preferably 80° C. to 250° C., more preferably 100° C. to 140° C. The development time is preferably 1–180 seconds, more preferably 5–90 seconds. The line speed is preferably 140 cm/minute or more, more preferably 150 cm/minute or more.

As a method for preventing uneven development due to dimensional change of the photothermographic material during the heat development, it is effective to employ a method for forming images wherein the material is heated at a temperature of 80° C. or higher but lower than 115° C. for 5 seconds or more so as not to develop images, and then subjected to heat development at 110–140° C. to form images (so-called multi-step heating method).

Since the photothermographic material of the present invention is subjected to a high temperature of 110° C. or higher during the heat development, a part of the components contained in the material or a part of decomposition products produced by the heat development are volatilized. It is known that these volatilized components exert various bad influences, for example, they may cause uneven development, erode structural members of development apparatuses, deposit at low temperature portions as dusts to cause deformation of image surface, adhere to image surface as stains and so forth. As a method for eliminating these influences, it is known to provide a filter on the heat development apparatus, or suitably control air flows in the heat development apparatus. These methods may be effectively used in combination.

WO95/30933, WO97/21150 and International Patent Publication in Japanese (Kohyo) No. 10-500496 disclose use of a filter cartridge containing binding absorption particles and having a first vent for introducing volatilized components and a second vent for discharging them in heating means for heating a photothermographic material by contact. Further, WO96/12213 and International Patent Publication in Japanese (Kohyo) No. 10-507403 disclose use of a filter consisting of a combination of heat conductive condensation collector and a gas-absorptive microparticle filter. These can be preferably used in the present invention.

Further, U.S. Pat. No. 4,518,845 and JP-B-3-54331 disclose structures comprising means for eliminating vapor from a photothermographic material, pressing means for pressing a photothermographic material to a heat-conductive member and means for heating the heat-conductive member. Further, WO98/27458 discloses elimination of components volatilized from a photothermographic material and increasing fog from a surface of the photothermographic material. These techniques are also preferably used for the present invention.

An example of the structure of heat development apparatus used for the heat development of the photothermographic material of the present invention is shown in FIG. 2. FIG. 2 depicts a side view of a heat development apparatus. The heat development apparatus shown in FIG. 2 comprises carrying-in roller pairs 11 (upper rollers are silicone rubber rollers, and lower rollers are aluminum heating rollers), which carry a photothermographic material 10 into the heating section while making the material in a flat shape and preheating it, and carrying-out roller pairs 12, which carry out the photothermographic material 10 after heat development from the heating section while maintaining the material to be in a flat shape. The photothermographic material 10 is heat-developed while it is conveyed by the carrying-in roller pairs 11 and then by the carrying-out roller pairs 12. A conveying means for carrying the photothermographic material 10 under the heat development is provided with multiple rollers 13 so that they should be contacted with the surface of the image-forming layer side, and a flat surface 14 adhered with non-woven fabric (composed of, for example, aromatic polyamide, Teflon etc.) or the like is provided on the opposite side so that it should be contacted with the back surface. The photothermographic material 10 is conveyed by driving of the multiple rollers 13 contacted with the image-forming layer side, while the back surface slides on the flat surface 14. Heaters 15 are provided over the rollers 13 and under the flat surface 14 so that the photothermographic material 10 should be heated from the both sides. Examples of the heating means include panel heaters and so forth. While clearance between the rollers 13 and the flat surface 14 may vary depending on the material of the flat surface member, it is suitably adjusted to a clearance that allows the conveyance of the photothermographic material 10. The clearance is preferably 0–1 mm.

The materials of the surfaces of the rollers 13 and the member of the flat surface 14 may be composed of any materials so long as they have heat resistance and they should not cause any troubles in the conveyance of the photothermographic material 10. However, the material of the roller surface is preferably composed of silicone rubber, and the member of the flat surface is preferably composed of non-woven fabric made of aromatic polyamide or Teflon (PTFE). The heating means preferably comprises multiple heaters so that temperature of each heater can be adjusted freely.

The heating section is constituted by a preheating section A comprising the carrying-in roller pairs 11 and a heat development section B comprising the heaters 15. Temperature of the preheating section A locating upstream from the heat development section B is preferably controlled to be lower than the heat development temperature (for example, lower by about 10–30° C.), and temperature and heat development time are desirably adjusted so that they should be sufficient for evaporating moisture contained in the photothermographic material 10. The temperature is also adjusted to be higher than the glass transition temperature (Tg) of the support of the photothermographic material 10 so that uneven development should be prevented. Temperature distribution of the preheating section and the heat development section is preferably ±1° C. or less, more preferably ±0.5° C. or less.

Moreover, guide panels 16 are provided downstream from the heat development section B, and they constitute a gradual cooling section C together with the carrying-out roller pairs 12.

The guide panels 16 are preferably composed of a material of low heat conductivity, and it is preferred that the cooling is performed gradually so as not to cause deformation of the photothermographic material 10. The cooling rate is preferably 0.5–10° C./second.

The heat development apparatus was explained with reference to the example shown in the drawing. However, the apparatus is not limited to the example. For example, the heat development apparatus used for the present invention may have a variety of structures such as one disclosed in JP-A-7-13294. For the multi-stage heating method, which is preferably used for the present invention, the photothermographic material may be successively heated at different temperatures in such an apparatus as mentioned above, which is provided with two or more heat sources at different temperatures.

The present invention will be specifically explained with reference to the following examples. The materials, regents, ratios, procedures and so forth shown in the following examples can be optionally changed so long as such change does not depart from the spirit of the present invention. Therefore, the scope of the present invention is not limited by the following examples.

EXAMPLE 1-1

<<Preparation of Silver Halide Emulsion A (for Comparison)>>

In 700 mL of water, 11 g of alkali-treated gelatin (calcium content: 2700 ppm or less), 30 mg of potassium bromide and 1.3 g of sodium 4-methylbenzenesulfonate were dissolved. After the solution was adjusted to pH 6.5 at a temperature of 40° C., 159 mL of an aqueous solution containing 18.6 g of silver nitrate and an aqueous solution containing 1 mol/L of potassium bromide, $5\times10^{-6}$ mol/L of $(NH_4)_2RhCl_5(H_2O)$ and $2\times10^{-5}$ mol/L of $K_3IrCl_6$ were added by the control double jet method over 6 minutes and 30 seconds while pAg was maintained at 7.7. Then, 476 mL of an aqueous solution containing 55.5 g of silver nitrate and an aqueous solution of halide salt containing 1 mol/L of potassium bromide and $2\times10^{-5}$ mol/L of $K_3IrCl_6$ were added by the control double jet method over 28 minutes and 30 seconds while pAg was maintained at 7.7. Then, the pH was lowered to cause coagulation precipitation to effect desalting, 51.1 g of low molecular weight gelatin having an average molecular weight of 15,000 (calcium content: 20 ppm or less) was added, and pH and pAg were adjusted to 5.9 and 8.0, respectively. The grains obtained were cubic grains having a mean grain size of 0.08 μm, variation coefficient of 12% for projected area and a [100] face ratio of 92%.

The silver halide emulsion obtained as described above was divided into portions and temperature of one portion was raised to 60° C. It was added with 76 μmol per mole of silver of sodium benzenethiosulfonate. After 3 minutes, 71 μmol of triethylthiourea was further added, and the grains were ripened for 100 minutes, then added with $5\times10^{-4}$ mole of 4-hydroxy-6-methyl-1,3,3a,7-tetrazaindene and 0.17 g of Compound A, and cooled to 40° C.

Then, while the mixture was maintained at 40° C., it was added with potassium bromide (added as aqueous solution), the following Sensitizing Dye A (added as solution in ethanol) and Compound B (added as solution in methanol) in amounts of $4.7\times10^{-2}$ mole, $12.8\times10^{-4}$ mole and $6.4\times10^{-3}$ mole per mole of the silver halide with stirring. After 20 minutes, the emulsion was quenched to 30° C. to complete the preparation of Silver halide emulsion A.

<<Preparation of Silver Halide Emulsions B to E (D and E for the Invention and B and C for Comparison)>>

Temperature of each portion obtained in the above preparation of Silver halide emulsion A was raised to 60° C. Each was added with 76 μmol per mole of silver of sodium benzenethiosulfonate. It was further added with 71 μmol of triethylthiourea after 3 minutes and each compound shown in Table 16 after 5 minutes. Then, the grains were ripened for 100 minutes, added with $5\times10^{-4}$ mole of 4-hydroxy-6-methyl-1,3,3a,7-tetrazaindene and 0.17 g of Compound A, and cooled to 40° C.

Then, while the mixture was maintained at 40° C., it was added with potassium bromide (added as aqueous solution), the following Sensitizing Dye A (added as solution in ethanol) and Compound B (added as solution in methanol) in amounts of $4.7\times10^{-2}$ mole, $12.8\times10^{-4}$ mole and $6.4\times10^{-3}$ mole per mole of the silver halide with stirring. After 20 minutes, the emulsion was quenched to 30° C. to complete the preparation of Silver halide emulsions B to E.

<<Preparation of Silver Halide Emulsions F to H (F and G for the Invention and H for Comparison)>>

In the preparation of Silver halide emulsion A, the temperatures at which silver nitrate and potassium bromide were added were controlled to obtain silver halide grains having each mean grain size shown in Table 16 were obtained.

Temperature of the grains having each mean grain size was raised to 60° C. They were added with 76 μmol per mole of silver of sodium benzenethiosulfonate. They were further added with 71 μmol of triethylthiourea after 3 minutes and each compound shown in Table 16 after 5 minutes. Then, the grains were ripened for 100 minutes, added with $5\times10^{-4}$ mole of 4-hydroxy-6-methyl-1,3,3a,7-tetrazaindene and 0.17 g of Compound A, and cooled to 40° C.

Then, while the mixture was maintained at 40° C., it was added with potassium bromide (added as aqueous solution), the following Sensitizing Dye A (added as solution in ethanol) and Compound B (added as solution in methanol) in amounts of $4.7\times10^{-2}$ mole, $12.8\times10^{-4}$ mole and $6.4\times10^{-3}$ mole per mole of the silver halide with stirring. After 20 minutes, the emulsion was quenched to 30° C. to complete the preparation of Silver halide emulsions F to H.

<<Preparation of Silver Halide Emulsion I (for the Invention)>>

Temperature of one portion obtained in the above preparation of Silver halide emulsion A was raised to 55° C. It was added with 76 μmol per mole of silver of sodium benzenethiosulfonate. It was further added with 85 μmol of Compound SE after 3 minutes and the compound shown in Table 16 after 5 minutes. Then, the grains were ripened for 100 minutes, added with $5\times10^{-4}$ mole of 4-hydroxy-6-methyl-1,3,3a,7-tetrazaindene and 0.17 g of Compound A, and cooled to 40° C.

Then, while the mixture was maintained at 40° C., it was added with potassium bromide (added as aqueous solution), the following Sensitizing Dye A (added as solution in ethanol) and Compound B (added as solution in methanol) in amounts of $4.7\times10^{-2}$ mole, $12.8\times10^{-4}$ mole and $6.4\times10^{-3}$ mole per mole of the silver halide with stirring. After 20 minutes, the emulsion was quenched to 30° C. to complete the preparation of Silver halide emulsion I.

<<Preparation of Silver Halide Emulsion J (for the Invention)>>

Temperature of one portion obtained in the above preparation of Silver halide emulsion A was raised to 47° C. It was added with 76 μmol per mole of silver of sodium benzenethiosulfonate. It was further added with 72 μmol of Compound TE after 3 minutes and the compound shown in Table 16 after 5 minutes. Then, the grains were ripened for 100 minutes, added with $5\times10^{-4}$ mole of 4-hydroxy-6-methyl-1,3,3a,7-tetrazaindene and 0.17 g of Compound A, and cooled to 40° C.

Then, while the mixture was maintained at 40° C., it was added with potassium bromide (added as aqueous solution), the following Sensitizing Dye A (added as solution in ethanol) and Compound B (added as solution in methanol) in amounts of $4.7\times10^{-2}$ mole, $12.8\times10^{-4}$ mole and $6.4\times10^{-3}$ mole per mole of the silver halide with stirring. After 20 minutes, the emulsion was quenched to 30° C. to complete the preparation of Silver halide emulsion J.

TABLE 16

| Emulsion No. | Mean grain size (μm) | Added compound | Amount of the added compound (per 1 mole of Ag) |
|---|---|---|---|
| A | 0.08 | — | — |
| B | 0.08 | chloroauric acid | 14 μmol |
| C | 0.08 | chloroauric acid/ potassium thiocyanate | 62 μmol/ 500 μmol |
| D | 0.08 | (G) | 95 μmol |
| E | 0.08 | (S) | 84 μmol |
| F | 0.05 | (S) | 138 μmol |
| G | 0.11 | (S) | 60 μmol |
| H | 0.15 | (S) | 42 μmol |
| I | 0.08 | (U) | 50 μmol |
| J | 0.08 | (U) | 36 μmol |

Sensitizing dye A

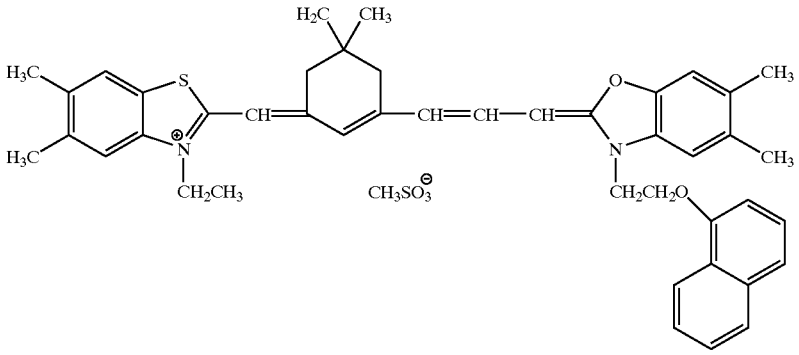

Compound A

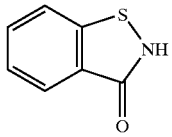

Compound B

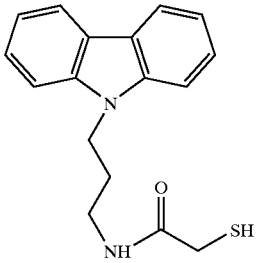

Compound SE

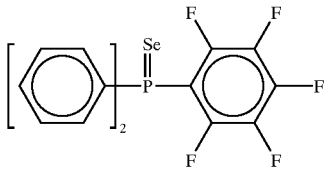

Compound TE

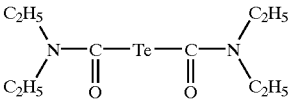

<<Preparation of Silver Behenate Dispersion A>>

In an amount of 87.6 kg of behenic acid (Edenor C22-85R, trade name, produced by Henkel Co.), 423 L of distilled water, 49.2 L of 5 mol/L aqueous solution of NaOH and 120 L of tert-butanol were mixed and allowed to react with-stirring at 75° C. for one hour to obtain a solution of sodium behenate. Separately, 206.2 L of an aqueous solution containing 40.4 kg of silver nitrate was prepared and kept at 10° C. A mixture of 635 L of distilled water and 30 L of tert-butanol contained in a reaction vessel kept at 30° C. was added with the whole amount of the aforementioned sodium behenate solution and the whole amount of the aqueous silver nitrate solution with stirring at constant flow rates over the periods of 62 minutes and 10 seconds, and 60 minutes, respectively. In this operation, the aqueous silver nitrate solution was added in such a manner that only the aqueous silver nitrate solution should be added for 7 minutes and 20 seconds after starting the addition of the aqueous silver nitrate solution, and then the addition of the aqueous solution of sodium behenate was started and added in such a manner that only the aqueous solution of sodium behenate should be added for 9 minutes and 30 seconds after finishing the addition of the aqueous silver nitrate solution. During the addition, the outside temperature was controlled so that the temperature in the reaction vessel should be 30° C. and the liquid temperature should not be raised. The piping of the addition system for the sodium behenate solution was warmed by steam trace and the steam opening was controlled such that the liquid temperature at the outlet orifice of the addition nozzle should be 75° C. The piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions were controlled to be at heights for not contacting with the reaction mixture.

After finishing the addition of the sodium behenate solution, the mixture was left with stirring for 20 minutes at the same temperature and then the temperature was decreased to 25° C. Thereafter, the solid content was recovered by suction filtration and the solid content was washed with water until electric conductivity of the filtrate became 30 μS/cm. The solid content obtained as described above was stored as a wet cake without being dried.

When the shape of the obtained silver behenate grains was evaluated by an electron microscopic photography, the grains were scaly crystals having a mean diameter of projected areas of 0.52 μm, mean thickness of 0.14 μm and variation coefficient of 15% for mean diameter as spheres.

Then, dispersion of silver behenate was prepared as follows. To the wet cake corresponding to 100 g of the dry solid content was added with 7.4 g of polyvinyl alcohol (PVA-217, trade name, average polymerization degree: about 1700) and water to make the total amount 385 g, and the mixture was pre-dispersed by a homomixer. Then, the pre-dispersed stock dispersion was treated three times by using a dispersing machine (Microfluidizer-M-110S-EH; trade name, produced by Microfluidex International Corporation, using G10Z interaction chamber) with a pressure controlled to be 1750 kg/cm$^2$ to obtain Silver behenate dispersion A. During the cooling operation, a desired dispersion temperature was achieved by providing coiled heat exchangers fixed before and after the interaction chamber and controlling the temperature of the refrigerant.

The silver behenate grains contained in Silver behenate dispersion A obtained as described above were grains having a volume weight mean diameter of 0.52 μm and variation coefficient of 15%. The measurement of the grain size was carried out by using Master Sizer X produced by Malvern Instruments Ltd. When the grains were evaluated by an electron microscopic photography, the ratio of the long side to the short side was 1.5, the grain thickness was 0.14 μm, and a mean aspect ratio (ratio of diameter as sphere of projected area of grain and grain thickness) was 5.1.

The obtained Silver behenate dispersion A was used for the preparation of the coating solution described below.

<<Preparation of Solid Microparticle Dispersion of Reducing>>Agent

In an amount of 10 kg of reducing agent [1,1-bis(2-hydroxy-3,5-dimethylphenyl)-3,5,5-trimethylhexane] and 10 kg of 20 weight % aqueous solution of denatured polyvinyl alcohol (Poval MP203, produced by Kuraray Co. Ltd.) were added with 400 g of Safinol 104E (Nisshin Kagaku Co.), 640 g of methanol and 16 kg of water, and mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 3 hours and 30 minutes. Then, the slurry was added with 4 g of benzothiazolinone sodium salt and water so that the concentration of the reducing agent should become 25 weight % to obtain a solid microparticle dispersion of reducing agent. The reducing agent particles contained in the dispersion obtained as described above had a median diameter of 0.44 μm, maximum particle diameter of 2.0 μm or less and variation coefficient of 19% for mean particle diameter. The obtained dispersion was filtered through a polypropylene filter having a pore size of 3.0 μm to remove dusts and so forth, and used for the preparation of the coating solution described below.

<<Preparation of Solid Microparticle Dispersion of Organic Polyhalogenated Compound A>>

In an amount of 10 kg of Organic polyhalogenated compound A [tribromomethyl(4-(2,4,6-trimethylphenylsulfonyl)phenyl)-sulfone], 10 kg of 20 weight % aqueous solution of denatured polyvinyl alcohol (Poval MP203, produced by Kuraray Co. Ltd.), 639 g of 20 weight % aqueous solution of sodium triisopropylnaphthalenesulfonate, 400 g of Safinol 104E (Nisshin Kagaku Co.), 640 g of methanol and 16 kg of water were mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 5 hours. Then, the slurry was added with water so that the concentration of Organic polyhalogenated compound A should become 25 weight % to obtain solid microparticle dispersion of Organic polyhalogenated compound A. The particles of the organic polyhalogenated compound contained in the dispersion obtained as described above had a median diameter of 0.36 μm, maximum particle diameter of 2.0 μm or less and variation coefficient of 18% for mean particle diameter. The obtained dispersion was filtered through a polypropylene filter having a pore size of 3.0 μm to remove dusts and so forth, and used for the preparation of the coating solution described below.

<<Preparation of Solid Microparticle Dispersion of Organic Polyhalogenated Compound B>>

In an amount of 5 kg of Organic polyhalogenated compound B [tribromomethylnaphthylsulfone], 2.5 kg of 20 weight % aqueous solution of denatured polyvinyl alcohol (Poval MP203, produced by Kuraray Co. Ltd.), 213 g of 20 weight % aqueous solution of sodium triisopropylnaphthalenesulfonate and 10 kg of water were mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 5 hours. Then, the slurry was added with 2.5 g of benzothiazolinone sodium salt and water so that the concentration of Organic polyhalogenated compound B should become 23.5 weight % to obtain solid microparticle dispersion of Organic polyhalogenated compound B. The particles of the organic polyhalogenated compound contained in the dispersion obtained as described above had a median diameter of 0.38 μm, maximum particle diameter of 2.0 μm or less and variation coefficient of 20% for mean particle diameter. The obtained dispersion was filtered through a polypropylene filter having a pore size of 3.0 μm to remove dusts and so forth, and used for the preparation of the coating solution described below.

<<Preparation of Aqueous Solution of Organic Polyhalogenated Compound C>>

In an amount of 75.0 mL of water, 8.6 mL of 20 weight % aqueous solution of sodium triisopropylnaphthalenesulfonate, 6.8 mL of 5 weight % aqueous solution of sodium dihydrogen-orthophosphate dihydrate and 9.5 mL of 1 mol/L aqueous solution of potassium hydroxide were successively added at room temperature with stirring, and the mixture was stirred for 5 minutes after the addition was completed. Further, the mixture was added with 4.0 g of Organic polyhalogenated compound C [3-tribromomethanesulfonylbenzoylaminoacetic acid] as powder and it was dissolved until the solution became transparent to obtain 100 mL of aqueous solution of Organic polyhalogenated compound C. The obtained aqueous solution was filtered through a polyester screen of 200 mesh to remove dusts and so forth, and used for the preparation of the coating solution described below.

<<Preparation of Emulsion Dispersion of Compound Z>>

In an amount of 10 kg of R-054 (Sanko Co., Ltd.) containing 85 weight % of Compound Z was mixed with 11.66 kg of MIBK and dissolved in the solvent at 80° C. for 1 hour in an atmosphere substituted with nitrogen. This solution was added with 25.52 kg of water, 12.76 kg of 20 weight % aqueous solution of MP polymer (MP-203, produced by Kuraray Co. Ltd.) and 0.44 kg of 20 weight % aqueous solution of sodium triisopropylnaphthalenesulfonate and subjected to emulsion dispersion at 20–40° C. and 3600 rpm for 60 minutes. The dispersion was further added with 0.08 kg of Safinol 104E (Nisshin Kagaku Co.) and 47.94 kg of water and distilled under reduced pressure to remove MIBK. Then, the concentration of Compound Z was adjusted to 10 weight %. The particles of Compound Z contained in the dispersion obtained as described above had a median diameter of 0.19 μm, maximum particle diameter of 1.5 μm or less and variation coefficient of 17% for mean particle diameter. The obtained dispersion was filtered through a polypropylene filter having a pore size of 3.0 μm to remove dusts and so forth and used for the preparation of the coating solution described below.

<<Preparation of Dispersion of 6-isopropylphthalazine Compound>>

In an amount of 62.35 g of water was added with 2.0 g of denatured polyvinyl alcohol (Poval MP203, produced by Kuraray Co., Ltd.) with stirring so that the denatured polyvinyl alcohol should not coagulate, and mixed by stirring for 10 minutes. Then, the mixture was heated until the internal temperature reached 50° C., and stirred for 90 minutes at an internal temperature in the range of 50–60° C. to attain uniform dissolution. The internal temperature was lowered to 40° C. or lower, and the mixture was added with 25.5 g of 10 weight % aqueous solution of polyvinyl alcohol (PVA-217, produced by Kuraray Co., Ltd.), 3.0 g of 20 weight % aqueous solution of sodium triisopropylnaphthalenesulfonate and 7.15 g of 6-isopropyl-phthalazine (70% aqueous solution) and stirred for 30 minutes to obtain 100 g of transparent dispersion. The obtained dispersion was filtered through a polypropylene filter having a pore size of 3.0 μm to remove dusts and so forth, and used for the preparation of the coating solution described below.

<<Preparation of Solid Microparticle Dispersion of the Compound of the Present Invention>>

In an amount of 4 kg of each compound of the present invention mentioned in Table 17 or Comparative Compound Y was added with 1 kg of polyvinyl alcohol (Poval PVA-217, produced by Kuraray Co., Ltd.) and 36 kg of water, and mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 12 hours. Then, the slurry was added with 4 g of benzothiazolinone sodium salt and water so that the concentration of the nucleating agent should become 10 weight % to obtain solid microparticle dispersion of the nucleating agent. The particles of the nucleating agent contained in the obtained dispersion had a median diameter of 0.34 μm, maximum particle diameter of 3.0 μm or less, and variation coefficient of 19% for the mean particle diameter. The obtained dispersion was filtered through a polypropylene filter having a pore size of 3.0 μm to remove dusts and so forth, and used for the preparation of the coating solution described below.

<<Preparation of Solid Microparticle Dispersion of Development Accelerator W>>

In an amount of 10 kg of Development accelerator W, 10 kg of 20 weight % aqueous solution of denatured polyvinyl alcohol (Poval MP203, produced by Kuraray Co., Ltd.) and 20 kg of water were mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 5 hours. Then, the slurry was added with water so that the concentration of Development accelerator W should become 20 weight % to obtain a microparticle dispersion of Development accelerator W. The particles of the development accelerator contained in the obtained dispersion had a median diameter of 0.5 μm, maximum particle diameter of 2.0 μm or less, and variation coefficient of 18% for the mean particle diameter. The obtained dispersion was filtered through a polypropylene filter having a pore size of 3.0 μm to remove dusts and so forth, and used for the preparation of the coating solution described below.

<<Preparation of Coating Solution for Image-Forming Layer>>

Silver behenate dispersion A prepared above was added with the following binder, components and silver halide emulsion in the indicated amounts per mole of silver in Silver behenate dispersion A, and added with water to prepare a coating solution for image-forming layer. After the completion, the solution was degassed under reduced pressure of 0.54 atm for 45 minutes. The coating solution showed pH of 7.7 and viscosity of 50 mPa·s at 25° C.

| | |
|---|---|
| Binder: SBR latex (St/Bu/AA = 68/29/3 (weight %), $Na_2S_2O_8$ was used as polymerization initiator) | 397 g as solid |
| 1,1-Bis(2-hydroxy-3,5-dimethyl-phenyl)-3,5,5-trimethylhexane | 149.5 g as solid |
| Organic polyhalogenated compound B | 36.3 g as solid |
| Organic polyhalogenated compound C | 2.34 g as solid |
| Sodium ethylthiosulfonate | 0.47 g |
| Benzotriazole | 1.02 g |
| Polyvinyl alcohol (PVA-235, produced by Kuraray Co., Ltd.) | 10.8 g |
| 6-Isopropylphthalazine | 16.0 g |
| Compound Z | 9.7 g as solid |
| Compound of the present invention shown in Table 17 | 12.7 g |
| Dye A (added as a mixture with low molecular weight gelatin having mean molecular weight of 15000) | Amount giving optical density of 0.3 at 783 nm (about 0.40 g as solid) |
| Silver halide emulsion shown in Table 17 | 0.06 mole as Ag |
| Compound A as preservative | 40 ppm in the coating solution (2.5 mg/m$^2$ as coated amount) |
| Methanol | 1 weight % as to total solvent amount in the coating solution |
| Ethanol | 2 weight % as to total solvent amount in the coating solution |

pH was adjusted by using NaOH as a pH adjusting agent. (The coated film showed a glass transition temperature of 17° C.)

Polyhalogenated compound A

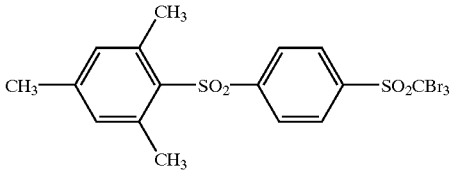

Polyhalogenated compound B

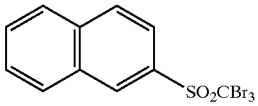

Compound Z

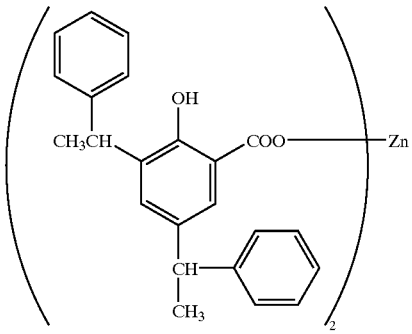

-continued

Polyhalogenated compound C

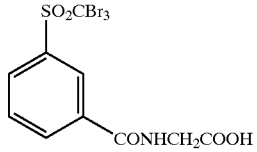

Dye A

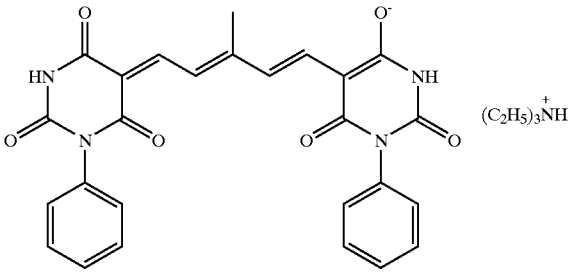

Development accelerator W

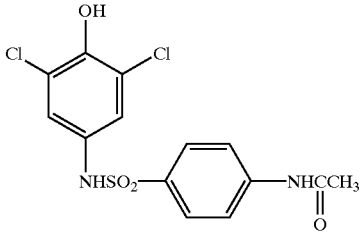

Compound Y

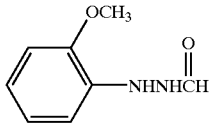

<<Preparation of Coating Solution for Protective Layer>>

In an amount of 943 g of a polymer latex solution of copolymer of methyl methacrylate/styrene/2-ethylhexyl acrylate/2-hydroxyethyl methacrylate/acrylic acid=58.9/8.6/25.4/5.1/2 (weight %) (glass transition temperature as copolymer: 46° C. (calculated value), solid content: 21.5 weight %, containing 100 ppm of Compound A and further containing Compound D as a film-forming aid in an amount of 15 weight % relative to solid content of the latex so that the glass transition temperature of the coating solution should become 24° C., mean particle diameter: 116 nm) was added with water, 1.62 g of Compound E, 114.8 g of the aqueous solution of Organic polyhalogenated compound C, 10.0 g as solid content of Organic polyhalogenated compound A, 0.69 g as solid content of sodium dihydrogenorthophosphate dihydrate, 11.55 g as solid content of Development accelerator A, 1.58 g of matting agent (polystyrene particles, mean particle diameter: 7 $\mu$m, variation coefficient of 8% for mean particle diameter) and 29.3 g of polyvinyl alcohol (PVA-235, Kuraray Co., Ltd.), and further added with water to form a coating solution (containing 0.8 weight % of methanol solvent). After the preparation, the solution was degassed under reduced pressure of 0.47 atm for 60 minutes. The coating solution showed pH of 5.5, and viscosity of 45 mPa·s at 25° C.

<<Preparation of Coating Solution for Lower Overcoat Layer>>

In an amount of 625 g of a polymer latex solution of copolymer of methyl methacrylate/styrene/2-ethylhexyl acrylate/2-hydroxyethyl methacrylate/acrylic acid=58.9/8.6/

25.4/5.1/2 (weight %) (glass transition temperature as copolymer: 46° C. (calculated value), solid content: 21.5 weight %, containing 100 ppm of Compound A and further containing Compound D as a film-forming aid in an amount of 15 weight % relative to solid content of the latex so that the glass transition temperature of the coating solution should become 24° C., mean particle diameter: 74 nm) was added with water, 0.23 g of Compound C, 0.13 g of Compound E, 11.7 g of Compound F, 2.7 g of Compound H and 11.5 g of polyvinyl alcohol (PVA-235, Kuraray Co., Ltd.), and further added with water to form a coating solution (containing 0.1 weight % of methanol solvent). After the preparation, the solution was degassed under reduced pressure of 0.47 atm for 60 minutes. The coating solution showed pH of 2.6, and viscosity of 30 mPa·s at 25° C.

<<Preparation of Coating Solution for Upper Overcoat Layer>>

In an amount of 649 g of polymer latex solution of copolymer of methyl methacrylate/styrene/2-ethylhexyl acrylate/2-hydroxyethyl methacrylate/acrylic acid=58.9/8.6/25.4/5.1/2 (weight %) (glass transition temperature of the copolymer: 46° C. (calculated value), solid content: 21.5 weight %, containing Compound A at a concentration of 100 ppm and further containing Compound D as a film-forming aid in an amount of 15 weight % relative to solid content of the latex so that the glass transition temperature of coating solution should become 24° C., mean particle diameter: 116 nm) was added with water, 18.4 g of 30 weight % solution of carnauba wax (Cellosol 524, Chukyo Yushi Co., Ltd., silicone content: less than 5 ppm), 0.23 g of Compound C, 1.85 g of Compound E, 1.0 g of Compound G, 3.45 g of matting agent (polystyrene particles, mean diameter: 7 μm, variation coefficient for mean particle diameter: 8%) and 26.5 g of polyvinyl alcohol (PVA-235, Kuraray Co., Ltd.) and further added with water to form a coating solution (containing 1.1 weight % of methanol solvent). After the preparation, the coating solution was degassed at a reduced pressure of 0.47 atm for 60 minutes. The coating solution showed pH of 5.3 and viscosity of 25 mPa·s at 25° C.

Compound C

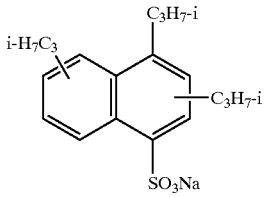

Compound D

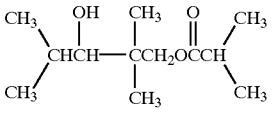

Compound E

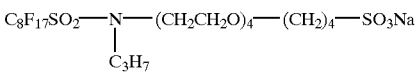

Compound F

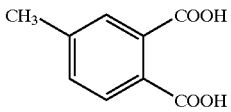

Compound G

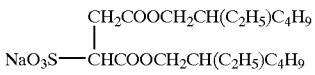

-continued

Compound H

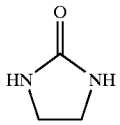

<<Preparation of Polyethylene Terephthalate (PET) Support with Back Layers and Undercoat Layers>>

(1) Preparation of PET Support

PET having IV (intrinsic viscosity) of 0.66 (measured in phenol/tetrachloroethane=6/4 (weight ratio) at 25° C.) was obtained in a conventional manner by using terephthalic acid and ethylene glycol. The product was pelletized, dried at 130° C. for 4 hours, melted at 300° C., then extruded from a T-die and rapidly cooled to form an unstretched film having such a thickness that the thickness should become 120 μm after thermal fixation.

The film was stretched along the longitudinal direction by 3.3 times at 110° C. using rollers of different peripheral speeds, and then stretched along the transverse direction by 4.5 times at 130° C. using a tenter. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4.8 kg/cm$^2$. Thus, a roll of a PET support having a width of 2.4 m, length of 3500 m, and thickness of 120 μm was obtained.

(2) Preparation of Undercoat Layers and Back Layers (i) First Undercoat Layer

The aforementioned PET support was subjected to a corona discharge treatment of 0.375 kV·A·minute/m$^2$, then coated with a coating solution having the following composition in an amount of 6.2 mL/m$^2$, and dried at 125° C. for 30 seconds, 150° C. for 30 seconds, and 185° C. for 30 seconds.

| | |
|---|---|
| Latex A | 280 g |
| KOH | 0.5 g |
| Polystyrene microparticles (mean particle diameter: 2 μm, variation coefficient of 7% for mean particle diameter) | 0.03 g |
| 2,4-Dichloro-6-hydroxy-s-triazine | 1.8 g |
| Compound Bc-C | 0.097 g |
| Distilled water | Amount giving total weight of 1000 g |

(ii) Second Undercoat Layer

A coating solution having the following composition was coated on the first undercoat layer in an amount of 5.5 mL/m$^2$ and dried at 125° C. for 30 seconds, 150° C. for 30 seconds, and 170° C. for 30 seconds.

| | |
|---|---|
| Deionized gelatin ($Ca^{2+}$ content: 0.6 ppm, jelly strength: 230 g) | 10.0 g |
| Acetic acid (20 weight % aqueous solution) | 10.0 g |
| Compound Bc-A | 0.04 g |
| Methyl cellulose (2 weight % aqueous solution) | 25.0 g |
| Polyethyleneoxy compound | 0.3 g |

-continued

| | |
|---|---|
| Distilled water | Amount giving total weight of 1000 g |

(iii) First Back Layer

The surface of the support opposite to the surface coated with the undercoat layers was subjected to a corona discharge treatment of 0.375 kV·A·minute/$m^2$, coated with a coating solution having the following composition in an amount of 13.8 mL/$m^2$, and dried at 125° C. for 30 seconds, 150° C. for 30 seconds, and 185° C. for 30 seconds.

| | |
|---|---|
| Julimer ET-410 (30 weight % aqueous dispersion Nihon Junyaku Co., Ltd.) | 23.0 g |
| Alkali-treated gelatin (molecular weight: about 10000, $Ca^{2+}$ content: 30 ppm) | 4.44 g |
| Deionized gelatin ($Ca^{2+}$ content: 0.6 ppm) | 0.84 g |
| Compound Bc-A | 0.02 g |
| Dye Bc-A | Amount giving optical density of 1.3–1.4 at 783 nm, about 0.88 g |
| Polyoxyethylene phenyl ether | 1.7 g |
| Water-soluble melamine compound (Sumitex Resin M-3, Sumitomo Chemical Co., Ltd., 8 weight % aqueous solution) | 15 g |
| Aqueous dispersion of Sb-doped $SbO_2$ acicular grains (FS-10D, Ishihara Sangyo Kaisha, Ltd.) | 24 g |
| Polystyrene microparticles (mean diameter: 2.0 μm, variation coefficient of 7% for mean particle diameter) | 0.03 g |
| Distilled water | Amount giving total weight of 1000 g |

(iv) Second Back Layer

A coating solution having the following composition was coated on the first back layer in an amount of 5.5 mL/$m^2$ and dried at 125° C. for 30 seconds, 150° C. for 30 seconds, and 170° C. for 30 seconds.

| | |
|---|---|
| Julimer ET-410 (30 weight % aqueous dispersion Nihon Junyaku Co., Ltd.) | 57.5 g |
| Polyoxyethylene phenyl ether | 1.7 g |
| Water-soluble melamine compound (Sumitex Resin M-3, Sumitomo Chemical Co., Ltd., 8 weight % aqueous solution) | 15 g |
| Cellosol 524 (30 weight % aqueous solution, Chukyo Yushi Co., Ltd.) | 6.6 g |
| Distilled water | Amount giving total weight of 1000 g |

(v) Third Back Layer

The same coating solution as the first undercoat layer was coated on the second back layer in an amount of 6.2 mL/$m^2$ and dried at 125° C. for 30 seconds, 150° C. for 30 seconds, and 185° C. for 30 seconds.

(vi) Fourth Back Layer

A coating solution having the following composition was coated on the third back layer in an amount of 13.8 mL/$m^2$ and dried at 125° C. for 30 seconds, 150° C. for 30 seconds, and 170° C. for 30 seconds.

| | |
|---|---|
| Latex B | 286 g |
| Compound Bc-B | 2.7 g |
| Compound Bc-C | 0.6 g |
| Compound Bc-D | 0.5 g |
| 2,4-Dichloro-6-hydroxy-s-triazine | 2.5 g |
| Polymethyl methacrylate (10 weight % aqueous dispersion, mean particle diameter: 5.0 μm, variation coefficient of 7% for mean particle diameter) | 7.7 g |
| Distilled water | Amount giving total weight of 1000 g |

Dye Bc-A

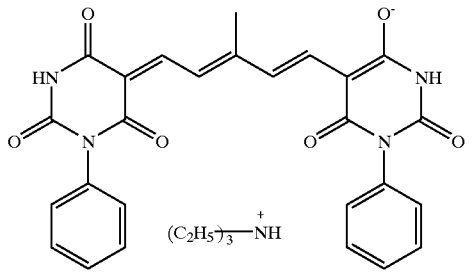

Compound Bc-A

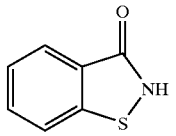

Compound Bc-B $C_{18}H_{37}OSO_3Na$

Compound Bc-C $C_8F_{17}SO_3Li$

Compound Bc-D $C_8F_{17}SO_2—N(C_3H_7)—(CH_2CH_2O)_4—(CH_2)_4—SO_3Na$

Latex A

Core/shell type latex comprising 90 weight % of core and 10 weight % of shell, core: vinylidene chloride/methyl acrylate/methyl methacrylate/acrylonitrile/acrylic acid=93/3/3/0.9/0.1 (weight %), shell: vinylidene chloride/methyl acrylate/methyl methacrylate/acrylonitrile/acrylic acid=88/3/3/3/3 (weight %), weight average molecular weight; 38000.

Latex B

Latex of copolymer of methyl methacrylate/styrene/2-ethylhexyl acrylate/2-hydroxyethyl methacrylate/acrylic acid=59/9/26/5/1 (weight %).

(3) Heat Treatment During Transportation (3-1) Heat Treatment

The PET support with back layers and undercoat layers prepared as described above was introduced into a heat treatment zone having a total length of 200 m set at 160° C., and transported at a tension of 2 kg/$cm^2$and a transportation speed of 20 m/minute.

(3-2) Post-Heat Treatment

Following the aforementioned heat treatment, the support was subjected to a post-heat treatment by passing it through a zone at 40° C. for 15 seconds, and rolled up. The rolling up tension for this operation was 10 kg/$cm^2$.

<<Preparation of Photothermographic Materials>>

On the undercoat layers of the side coated with the first and second undercoat layers of the PET support, the aforementioned coating solution for image-forming layer was coated so that the coated silver amount should become 1.5 $g/m^2$ by the slide bead method disclosed in JP-A-2000-2964, FIG. 1. On the image-forming layer, the aforementioned coating solution for protective layer was coated simultaneously with the coating solution for image-forming layer as stacked layers so that the coated solid content of the polymer latex should become 1.29 $g/m^2$. Then, the aforementioned coating solution for lower overcoat layer and coating solution for upper overcoat layer were simultaneously coated on the protective layer as stacked layers, so that the coated solid contents of the polymer latex should be 1.97 $g/m^2$ and 1.07 $g/m^2$, respectively, to prepare a photothermographic material.

After the coating, the layers were dried in a horizontal drying zone (the support was at an angle of 1. 5–3° to the horizontal direction of the coating machine) under the following conditions: dry-bulb temperature of 70–75° C., dew point of 14–25° C. and liquid film surface temperature of 35–40° C. for both of the constant rate drying process and the decreasing rate drying process until it reached a drying point where flow of coating solutions substantially ceased or a drying point where such a state was approximately observed. After the drying, the material was rolled up under the conditions of a temperature of 23±5° C. and relative humidity of 45±5%. The material was rolled up in such a rolled shape that the image-forming layer side should be exposed to the outside so as to conform to the subsequent processing (image-forming layer outside roll). The relative humidity in the package of the photothermographic material was 20–40% (measured at 25° C.). Each obtained photothermographic material showed a film surface pH of 5.1 and Beck's smoothness of 850 seconds for the image-forming layer side. The opposite surface showed a film surface pH of 5.9 and Beck's smoothness of 560 seconds.

<<Evaluation of Photographic Performance>>

Each of the obtained samples was subjected to light exposure through a step wedge using a xenon flash light through an interference filter having a peak at 785 nm for $10^{-6}$ second and then subjected to the heat development described below.

Sensitivity was represented with a reciprocal of exposure giving a density of 1.5 with S1.5–, and indicated as a relative value based on the value of Sample No. 1-1, which was taken as 100. A larger value means higher sensitivity.

<<Evaluation of Practice Density>>

The obtained photothermographic material was light exposed for $1.2\times10^{-8}$ second at a mirror revolution number of 60000 rpm by using a laser light-exposure apparatus of single channel cylindrical internal surface scanning type provided with a semiconductor laser with a beam diameter (½ of FWHM of beam intensity) of 12.56 μm, laser output of 50 mW and output wavelength of 783 nm. The overlap coefficient of the light exposure was 0.449, and the laser energy density on the photothermographic material surface was 75 $\mu J/cm^2$. A test step was output at 175 lines/inch with varying exposure by using the aforementioned laser exposure apparatus. Then, the material was subjected to the heat treatment explained below, and density of a portion showing Dmax (maximum density) obtained with exposure at such an LV value that intermediate dots should account for 50% was measured and used as a practice density.

Development humidity dependency was evaluated as a difference of line widths obtained for a photothermographic material that was left in an environment of 25° C. and relative humidity of 80% for 16 hours, exposed at a line width of 60 μm in the same manner as the aforementioned light exposure in the same environment and subjected to the heat development, and a photothermographic material that was left in an environment of 25° C. and relative humidity of 10% for 16 hours, similarly exposed at a line width of 60 μm in the same environment and subjected to the heat development (indicated as "variation of line width" in the tables). Further, Dmin (fog) and Dmax (maximum density) were also evaluated in an environment of 25° C. and relative humidity of 10%. The density measurement was performed by using a Macbeth TD904 densitometer (visible density).

As for storability, the photothermographic material was left at 50° C. and relative humidity of 75% for 3 days, subjected to the aforementioned light exposure and heat development, and evaluated in a similar manner.

<<Heat Development>>

Each light-exposed photothermographic material was heat-developed by using such a heat development apparatus as shown in FIG. 2. The roller surface material of the heat development section was composed of silicone rubber, and the flat surface consisted of Teflon non-woven fabric. The heat development was performed at a transportation line speed of 150 cm/minute in the preheating section for 12.2 seconds (driving units of the preheating section and the heat development section were independent from each other, and speed difference as to the heat development section was adjusted to −0.5% to −1%, temperatures of each of the metallic rollers and processing times in the preheating section were as follows: first roller, 67° C. for 2.0 seconds; second roller, 82° C. for 2.0 seconds; third roller, 98° C. for 2.0 seconds; fourth roller, 107° C. for 2.0 seconds; fifth roller, 115° C. for 2.0 seconds; and sixth roller, 120° C. for 2.0 seconds), in the heat development section at 120° C. (surface temperature of photothermographic material) for 17.2 seconds, and in the gradual cooling section for 13.6 seconds. The temperature precision as for the transverse direction was ±0.5° C. As for each roller temperature setting, the temperature precision was secured by using a length of rollers longer than the width of the photothermographic material (for example, width of 61 cm) by 5 cm for the both sides and also heating the protruding portions. Since the rollers showed marked temperature decrease at the both end portions, the temperature of the portions protruding by 5 cm from the ends of the photothermographic material was controlled to be higher than that of the roller center by 1–3° C., so that uniform image density of finished developed image should be obtained for the photothermographic material (for example, within a width of 61 cm).

The results of the above evaluations performed for each of the samples of photothermographic material (No. 1—1 to 1-10) are shown in Table 17.

TABLE 17

| Sample No. | Silver halide emulsion No. | Compound of the present invention | Developed silver grain density (%) | Covering power (%) | Sensitivity | Dmin Undeveloped | Dmin 50° C., 75% RH, 3 days | Dmax (25° C., 10% RH) | Variation of line width (μm) | Note |
|---|---|---|---|---|---|---|---|---|---|---|
| 1-1 | A | A-62 | 1800 | 320 | 100 | 0.12 | 0.13 | 4.0 | 11 | Comparative |
| 1-2 | B | A-62 | 2100 | 340 | 213 | 0.20 | 0.31 | 4.2 | 16 | Comparative |
| 1-3 | C | A-62 | 1800 | 320 | 228 | 0.16 | 0.20 | 4.1 | 13 | Comparative |
| 1-4 | D | A-62 | 1800 | 320 | 232 | 0.12 | 0.12 | 4.1 | 8 | Invention |
| 1-5 | D | Y | 1800 | 320 | 221 | 0.17 | 0.22 | 4.1 | 11 | Comparative |
| 1-6 | D | — | 100 | 100 | 34 | 0.13 | 0.14 | 1.3 | 11 | Comparative |
| 1-7 | E | A-62 | 1800 | 320 | 229 | 0.12 | 0.12 | 4.1 | 8 | Invention |
| 1-8 | F | A-62 | 2100 | 340 | 180 | 0.12 | 0.12 | 4.2 | 5 | Invention |
| 1-9 | G | A-62 | 1800 | 320 | 265 | 0.13 | 0.13 | 4.1 | 8 | Invention |
| 1-10 | H | A-62 | 1500 | 310 | 281 | 0.15 | 0.16 | 3.9 | 14 | Comparative |

As shown in Table 17, the photothermographic materials of the present invention showed high sensitivity, little increase of fog in the forced thermal treatment, which was for predicting photographic properties after storage for long period of time, high density even under a low temperature and low humidity conditions, and little temperature and humidity dependency for character line width during the development. Further, Sample No. 1-4, which used a compound of the present invention, showed less increase of fog even after the forced thermal treatment, which was for predicting photographic properties after storage for long period of time, compared with Sample No. 1-5 that used Comparative Compound Y, which was a hydrazine derivative, instead of the compound of the present invention.

EXAMPLE 1-2

<<Preparation of Coating Solution for Image-Forming Layer>>

Silver behenate dispersion A prepared in Example 1-1 was added with the following binder, components and Silver halide emulsion A in the indicated amounts per mole of silver in Silver behenate dispersion A, and added with water to prepare a coating solution for image-forming layer. After the preparation, the solution was degassed under reduced pressure of 0.54 atm for 45 minutes. The coating solution showed pH of 7.3–7.7 and viscosity of 40–50 mPa·s at 25° C.

| | |
|---|---|
| Binder: SBR latex (St/Bu/AA = 68/29/3 (weight %), $Na_2S_2O_8$ was used as polymerization initiator) | 397 g as solid |
| 1,1-Bis(2-hydroxy-3,5-dimethylphenyl)-3,5,5-trimethylhexane | 148.0 g as solid |
| Organic polyhalogenated compound A | 40.0 g as solid |
| Organic polyhalogenated compound B | 12.0 g as solid |
| Organic polyhalogenated compound C | 2.0 g as solid |
| Development accelerator W | 5.5 g as solid |
| Sodium ethylthiosulfonate | 0.3 g |
| Benzotriazole | 1.2 g |
| Polyvinyl alcohol (PVA-235, produced by Kuraray Co., Ltd.) | 10.8 g |
| 6-Isopropylphthalazine | 14.0 g |
| Compound Z | 9.6 g as solid |
| Compound C | 0.2 g |
| Compound of the present invention | 8.9 g |
| Dye A (added as a mixture with low molecular weight gelatin having mean molecular weight of 15000) | Amount giving optical density of 0.3 at 783 nm (about 0.40 g as solid) |

-continued

| | |
|---|---|
| Silver halide emulsion | 0.06 mole as Ag |
| Compound A as preservative | 40 ppm inthe coating solution (2.5 mg/m$^2$ as coated amount) |
| Methanol | 1 weight % as to total solvent amount in the coating solution |
| Ethanol | 2 weight % as to total solvent amount in the coating solution |

NaOH was used as a pH adjusting agent.

(The coated film showed a glass transition temperature of 17° C.)

<<Preparation of Coating Solution for Lower Protective Layer>>

In an amount of 900 g of a polymer latex solution containing copolymer of methyl acrylate/methyl methacrylate=70/30 (weight ratio, mean particle diameter: 110 nm, weight average molecular weight: 800,000, glass transition temperature of copolymer: 30° C., solid content: 28.0 weight %, containing 100 ppm of Compound A) was added with water, 0.2 g of Compound E and 35.0 g of polyvinyl alcohol (PVA-235, Kuraray Co., Ltd.) and further added with water to form a coating solution (containing 0.5 weight % of methanol solvent). After the preparation, the solution was degassed under reduced pressure of 0.47 atm for 60 minutes. The coating solution showed pH of 5.2, and viscosity of 35 mPa·s at 25° C.

<<Preparation of Coating Solution for Upper Protective Layer>>

In an amount of 900 g of a polymer latex solution containing copolymer of methyl acrylate/methyl methacrylate=70/30 (weight ratio, mean particle diameter: 110 nm, weight average molecular weight: 800,000, glass transition temperature of copolymer: 30° C., solid content: 28.0 weight %, containing 100 ppm of Compound A) was added with 10.0 g of 30 weight % solution of carnauba wax (Cellosol 524, silicone content: less than 5 ppm, Chukyo Yushi Co., Ltd.), 0.3 g of Compound C, 1.2 g of Compound E, 25.0 g of Compound F, 6.0 g of Compound H, 5.0 g of matting agent (polystyrene particles, mean particle diameter: 7 μm, variation coefficient of 8% for mean particle diameter) and 40.0 g of polyvinyl alcohol (PVA-235, Kuraray Co., Ltd.), and further added with water to form a coating solution (containing 1.5 weight % of methanol solvent). After the preparation, the solution was degassed under reduced pressure of 0.47 atm for 60 minutes. The coating solution showed pH of 2.4, and viscosity of 35 mPa·s at 25° C.

<<Preparation of Photothermographic Material>>

On undercoat layers of a PET support coated with the undercoat layers as described in Example 1-1, the aforementioned coating solution for image-forming layer, coating solution for lower protective layer and coating solution for upper protective layer were simultaneously coated as stacked layers in this order from the support by the slide bead method disclosed in JP-A-2000-2964, FIG. 1, so that the coated silver amount in the image-forming layer should become 1.5 g/m$^2$, the coated solid content of the polymer latex in the lower protective layer should become 1.0 g/m$^2$, and the coated solid content of the polymer latex in the upper protective layer should become 1.3 g/m$^2$.

As for drying conditions after the coating, the layers were dried in a first drying zone (low wind velocity drying region) at a dry-bulb temperature of 70–75° C., dew point of 9–23° C., wind velocity of 8–10 m/second at the support surface and liquid film surface temperature of 35–40° C., and in a second drying zone (high wind velocity drying region) at a dry-bulb temperature of 65–70° C., dew point of 20–23° C. and wind velocity of 20–25 m/second at the support surface. The drying was performed with the residence time in the first drying zone corresponding to 2/3 of the period of the constant ratio drying in this zone, and thereafter the material was transferred to the second drying zone and dried. The first drying zone was a horizontal drying zone (the support was at an angle of 1.5–3° to the horizontal direction of the coating machine). The coating speed was 60 m/minute. After the drying, the material was rolled up under the conditions of a temperature of 25±5° C. and relative humidity of 45±10%. The material was rolled up in such a rolled shape that the image-forming layer side should be exposed to the outside so as to conform to the subsequent processing (image-forming layer outside roll). The humidity in the package of the photothermographic material was 20–40% of relative humidity (measured at 25° C.). The obtained photothermographic material showed a film surface pH of 5.0 and Beck's smoothness of 5000 seconds for the image-forming layer side. The opposite surface showed a film surface pH of 5.9 and Beck's smoothness of 500 seconds.

Samples were prepared and evaluated in the same manner as in Example 1—1 by using the same silver halide emulsions as Example 1—1, except that the coating method was changed and P-3, A-8 and A-19 were used as the compounds of the present invention. As a result, the samples having the characteristics of the present invention showed good performance as in Example 1—1.

EXAMPLE 1-3

Coating solutions for image-forming layer were prepared in the same manner as in Example 1-2 by using the silver halide emulsions and compounds of the present invention shown in Table 18 in the indicated amounts with respect to 1 mol of silver in Silver behenate dispersion A prepared in Example 1—1. At this time, 11.5 g each of the compounds of the present invention were added. After the preparation, the solutions were degassed under reduced pressure of 0.54 atm for 45 minutes. Each coating solution showed pH of 7.3–7.7 and viscosity of 40–50 mPa·s at 25° C.

Further, in the same manner as in Example 1-2, a coating solution for lower protective layer was prepared. A coating solution for upper protective layer was prepared in the same manner as in Example 1-2 except that 21.0 g of Compound F was used.

Further, on undercoat layers of a PET support coated with the undercoat layers as described in Example 1—1, each of the aforementioned coating solutions for image-forming layer, coating solution for lower protective layer and coating solution for upper protective layer were simultaneously coated as stacked layers in this order from the support by the slide bead method disclosed in JP-A-2000-2964, FIG. 1, so that the coated silver amount in the image-forming layer should become 1.5 g/m$^2$, the coated solid content of the polymer latex in the lower protective layer should become 1.2 g/m$^2$, and the coated solid content of the polymer latex in the upper protective layer should become 1.4 g/m$^2$.

The drying conditions after the coating and the rolled shape were the same as those used in Example 1-2, i.e., the material was rolled up in such a rolled shape that the image-forming layer side should be exposed to the outside so as to conform to the subsequent processing (image-forming layer outside roll). The relative humidity in the package of the photosensitive material was 20–40% (measured at 25° C.). The obtained photothermographic material showed a film surface pH of 5.2 for the image-forming layer side. The opposite surface showed a film surface pH of 5.9.

Samples No. 3-1 to 3-10 obtained as described above were evaluated by the same methods as those used in Example 1—1.

TABLE 18

| Sample No. | Silver halide emulsion No. | Compound of the present invention | Developed silver grain density (%) | Covering power (%) | Sensitivity | Dmin: Undeveloped | Dmin: 50° C., 75% RH, 3 days | Dmax (25° C., 10% RH) | Variation of line width (μm) | Note |
|---|---|---|---|---|---|---|---|---|---|---|
| 3-1 | I | A-84 | 2100 | 335 | 238 | 0.12 | 0.12 | 4.2 | 5 | Invention |
| 3-2 | I | A-38 | 2100 | 340 | 232 | 0.12 | 0.12 | 4.2 | 7 | Invention |
| 3-3 | I | 2D | 1800 | 325 | 212 | 0.12 | 0.12 | 4.1 | 6 | Invention |
| 3-4 | I | 36a | 1800 | 320 | 218 | 0.12 | 0.12 | 4.1 | 7 | Invention |
| 3-5 | I | 84 | 1600 | 310 | 220 | 0.12 | 0.12 | 4.0 | 6 | Invention |
| 3-6 | J | A-63 | 2100 | 340 | 253 | 0.12 | 0.12 | 4.2 | 6 | Invention |
| 3-7 | J | A-107 | 2100 | 340 | 253 | 0.12 | 0.12 | 4.2 | 5 | Invention |
| 3-8 | J | 6a | 1800 | 325 | 228 | 0.12 | 0.12 | 4.1 | 5 | Invention |
| 3-9 | J | 35e | 1600 | 310 | 218 | 0.12 | 0.13 | 4.0 | 6 | Invention |
| 3-10 | J | 91 | 1600 | 310 | 211 | 0.12 | 0.12 | 4.0 | 7 | Invention |

As shown in Table 18, it was found that the photothermographic materials of the present invention showed high sensitivity, little increase of fog in the forced thermal treatment, which was for predicting photographic properties after storage for long period of time, high sensitivity even under a low temperature and low humidity condition, and little temperature and humidity dependency for character line width, like the results of Example 1—1.

EXAMPLE 1-4

Samples were prepared in the same manners as in Examples 1—1 to 1-3, except that silver halide emulsion was prepared by adding an equimolar amount of carboxymethyltrimethylthiourea instead of the triethylthiourea in the preparation of silver halide emulsions in Examples 1—1 to 1-3, and subjected to heat development in the same manner as in Example 1—1. As a result, the photothermographic materials of the present invention substantially reproduced the results of Examples 1—1 to 1-3, and thus the advantage of the present invention was clearly demonstrated.

EXAMPLE 1-5

The samples used in Examples 1—1 to 1-4 were exposed by using a cylinder external surface scanning type multichannel exposure apparatus (provided with 30 of 50 mW semiconductor laser heads, laser energy density on the photothermographic material surface: 75 $\mu J/cm^2$), and subjected to heat development in the same manner as in Example 1—1. As a result, the photothermographic materials of the present invention substantially reproduced the results of Examples 1—1 to 1-4, and thus the advantages of the present invention were clearly demonstrated.

EXAMPLE 1-6

The samples used in Examples 1—1 to 1-4 were subjected to a heat development by using DRY SYSTEM PROCESSOR FDS-6100X produced by Fuji Photo Film Co., Ltd., and similar evaluation was performed. As a result, results similar to those of Examples 1—1 to 1-5 were obtained, and thus the advantages of the present invention were clearly demonstrated.

EXAMPLE 2-1

Samples 1-1' to 1-10' were prepared in the same manner as in Example 1—1. However, in Example 2-1, the following Compound SE' and Compound TE' were used instead of Compound SE and Compound TE used in Example 1—1, and the samples were prepared according to Tables 19 and 20 instead of Tables 16 and 17. In addition, during the preparation of Emulsions B' to J', Compound II-D (150 $\mu$m) was also added when the additive compounds mentioned in Table 19 were added. Further, 9.9 g of a compound of the present invention was added to each coating solution for image-forming layer.

The results of the same tests as in Example 1—1 performed for the prepared Samples 1-1' to 1-10' are shown in Table 20. The samples having the characteristics of the present invention showed good performance as in Example 1—1.

Compound SE'

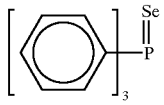

Compound TE'

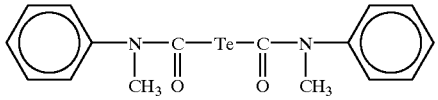

TABLE 19

| Emulsion No. | Mean grain size ($\mu$m) | Added compound | Amount of the added compound (per 1 mole of Ag) |
|---|---|---|---|
| A' | 0.08 | — | — |
| B' | 0.06 | chlorcauric acid | 17 $\mu$mol |
| C' | 0.08 | chloroauric acid<br>potassium thiocyanate | 66 $\mu$mol/<br>500 $\mu$mol |
| D' | 0.08 | I-1 | 105 $\mu$mol |
| E' | 0.08 | I-11 | 89 $\mu$mol |
| F' | 0.05 | I-11 | 142 $\mu$mol |
| G' | 0.11 | I-11 | 65 $\mu$mol |
| H' | 0.15 | I-11 | 47 $\mu$mol |
| I' | 0.08 | 1-13 | 53 $\mu$mol |
| J' | 0.08 | 1-13 | 38 $\mu$mol |

TABLE 20

| Sample No. | Silver halide emulsion No. | Compound of the present invention or comparison | Developed silver grain density (%) | Covering power (%) | Sensitivity | Dmin: Undeveloped | Dmin: 50° C., 75% RH, 3 days | Dmax (25° C., 10% RH) | Variation of line width ($\mu$m) | Note |
|---|---|---|---|---|---|---|---|---|---|---|
| 1-1' | A' | A-62 | 1800 | 320 | 100 | 0.12 | 0.13 | 4.0 | 10 | Comparative |
| 1-2' | B' | A-62 | 2100 | 340 | 210 | 0.20 | 0.31 | 4.2 | 15 | Comparative |
| 1-3' | C' | A-62 | 1800 | 320 | 223 | 0.16 | 0.20 | 4.1 | 12 | Comparative |
| 1-4' | D' | A-62 | 1800 | 320 | 227 | 0.12 | 0.12 | 4.1 | 9 | Invention |
| 1-5' | D' | Y | 1800 | 320 | 219 | 0.17 | 0.22 | 4.1 | 10 | Comparative |
| 1-6' | D' | — | 100 | 100 | 33 | 0.13 | 0.14 | 1.3 | 11 | Comparative |
| 1-7' | E' | A-62 | 1800 | 320 | 225 | 0.12 | 0.12 | 4.1 | 8 | Invention |
| 1-8' | F' | A-62 | 2100 | 340 | 177 | 0.12 | 0.12 | 4.2 | 5 | Invention |
| 1-9' | G' | A-62 | 1800 | 320 | 250 | 0.13 | 0.13 | 4.1 | 9 | Invention |
| 1-10' | H' | A-62 | 1500 | 310 | 275 | 0.15 | 0.16 | 3.9 | 15 | Comparative |

EXAMPLE 2—2

Samples were prepared in the same manner as in Example 2-1, provided that the samples were prepared with the modifications mentioned in Example 1-2. When the same tests as in Example 1—1 were performed for the prepared samples, the samples having the characteristics of the present invention showed good performance as in Example 2-1.

EXAMPLE 2-3

Samples No. 3-1' to 3-10' were prepared in the same manner as in Example 2-1, provided that the samples were prepared with the modifications mentioned in Example 1-3 under the conditions shown in Table 21 instead of the conditions shown in Table 18. When the same tests as in Example 1—1 were performed for the prepared samples, the samples having the characteristics of the present invention showed good performance as shown in Table 21.

TABLE 21

| Sample No. | Silver halide emulsion No. | Compound of the present invention or comparison | Developed silver grain density (%) | Covering power (%) | Sensitivity | Dmin Undeveloped | Dmin 50° C., 75% RH, 3 days | Dmax (25° C., 10% RH) | Variation of line width (μm) | Note |
|---|---|---|---|---|---|---|---|---|---|---|
| 3-1' | I' | A-84 | 2100 | 335 | 243 | 0.12 | 0.12 | 4.2 | 6 | Invention |
| 3-2' | I' | A-38 | 2100 | 340 | 238 | 0.12 | 0.12 | 4.2 | 7 | Invention |
| 3-3' | I' | 2d | 1800 | 325 | 219 | 0.12 | 0.12 | 4.1 | 8 | Invention |
| 3-4' | I' | 36a | 1800 | 320 | 214 | 0.12 | 0.12 | 4.1 | 8 | Invention |
| 3-5' | I' | 84 | 1600 | 310 | 223 | 0.12 | 0.12 | 4.0 | 7 | Invention |
| 3-6' | J' | A-63 | 2100 | 340 | 261 | 0.12 | 0.12 | 4.2 | 5 | Invention |
| 3-7' | J' | A-107 | 2100 | 340 | 258 | 0.12 | 0.12 | 4.2 | 6 | Invention |
| 3-8' | J' | 6a | 1800 | 325 | 231 | 0.12 | 0.12 | 4.1 | 6 | Invention |
| 3-9' | J' | 35e | 1600 | 310 | 222 | 0.12 | 0.13 | 4.0 | 7 | Invention |
| 3-10' | J' | 91 | 1600 | 310 | 219 | 0.12 | 0.12 | 4.0 | 8 | Invention |

EXAMPLE 2-4

Samples were prepared in the same manner as in Example 2-1, provided that the samples were prepared with the modifications mentioned in Example 1-4. When the same tests as in Example 1—1 were performed for the prepared samples, the samples having the characteristics of the present invention showed good performance as in Examples 2-1 to 2-3.

EXAMPLE 2-5

Samples were prepared in the same manner as in Example 2-1, provided that the samples were prepared with the modifications mentioned in Example 1-5. When the same tests as in Example 1—1 were performed for the prepared samples, the samples having the characteristics of the present invention showed good performance as in Examples 2-1 to 2-4.

EXAMPLE 2-6

Samples were prepared in the same manner as in Example 2-1, provided that the samples were prepared with the modifications mentioned in Example 1-6. When the same tests as in Example 1—1 were performed for the prepared samples, the samples having the characteristics of the present invention showed good performance as in Examples 2-1 to 2-5.

What is claimed is:

1. A photothermographic material comprising a photosensitive silver halide, a non-photosensitive silver salt of an organic acid, a reducing agent for silver ions and a binder on one surface of a support, wherein the material comprises at least one compound satisfying (iv) and that said compound also satisfying at least one of (i) to (iii) below and an organic gold compound, but does not contain hydrazine derivatives, and the photosensitive silver halide has a mean grain size of 0.12 μm or less:

(i) a compound producing imagewise a chemical species that can form development initiation points on and in the vicinity of the non-photosensitive silver salt of an organic acid (except for hydrazine derivatives)

(ii) a compound that provides increase of developed silver grain density to a level of 200–5000% when it is added in an amount of 0.01 mol/mol of silver (except for hydrazine derivatives);

(iii) a compound that provides increase of covering power to a level of 120–1000% when it is added in an amount of 0.01 mol/mol of silver (except for hydrazine derivatives);

(iv) a compound represented by any one of the following formulas (1) to (3):

Formula (1)

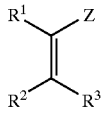

wherein, $R^1$, $R^2$ and $R^3$ each independently represents a hydrogen atom or a substituent, Z represents an electron-withdrawing group, and $R^1$ and Z, $R^2$ and $R^3$, $R^1$ and $R^2$, or $R^3$ and Z may be combined with each other to form a ring structure, Formula (2)

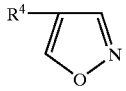

wherein, $R^4$ represents a substituent,

Formula (3)

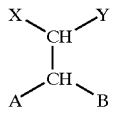

wherein, X and Y each independently represent a hydrogen atom or a substituent, A and B each independently represents an alkoxy group, an alkylthio group, an alkylamino group, an aryloxy group, an arylthio group, an anilino group, a heterocyclyloxy group, a heterocyclylthio group or a heterocyclylamino group, and X and Y or A and B may be combined with each other to form a ring structure.

2. The photothermographic material according to claim 1, which contains at least one compound of (i).

3. The photothermographic material according to claim 1, which contains at least one compound of (ii).

4. The photothermographic material according to claim 1, which contains at least one compound of (iii).

5. The photothermographic material according to claim 1, wherein the organic gold compound consists of at least one compound represented by the following formula (4):

$$[Au(L)_2]^+X^- \qquad \text{Formula (4)}$$

wherein L represents a ligand, two of L may be identical to or different from each other, at least one of L represents a mesoion ligand, and $X^-$ represents an anion.

6. The photothermographic material according to claim 1, wherein the organic gold compound consists of at least one compound represented by the following formula (5):

$$[L\text{-}Au\text{-}L]M \qquad \text{Formula (5)}$$

wherein L represents an organic mercapto ligand and M represents a cationic counter ion, provided that this complex has a symmetrical form.

7. The photothermographic material according to claim 1, wherein the organic gold compound consists of at least one compound represented by the following formula (6):

$$[(M\text{-}R^{sol})_n\text{-}A\text{-}S\text{—}Au\text{—}S\text{-}A\text{-}(R^{sol}\text{-}M)_n]M \qquad \text{Formula (6)}$$

wherein M represents a cationic counter ion, $R^{sol}$ represents a hydrophilic group, A represents a substituted or unsubstituted divalent organic bridging group, n represents any of 1–4, and when n is 2 or larger, n of ($R^{sol}$-M) may be identical to or different from each other or one another, provided that the compound has a symmetrical form.

8. The photothermographic material according to claim 1, wherein the photo sensitive silver halide consists of at least one compound represented by the following formula (7):

Formula (7)

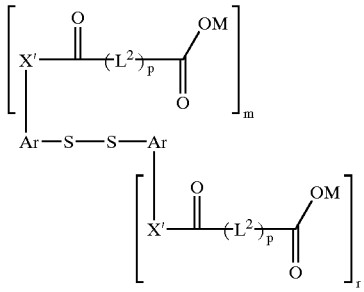

wherein,in the formula, X' each independently represents —O—, —NH— or —NR—, R represents an alkyl group, a fluoroalkyl group, an aryl group or a sulfonyl group, m and r each represent 0, 1 or 2, provided that m and r do not simultaneously represent 0, M represents hydrogen or a cationic species, Ar represents an aromatic group, $L^2$ represents a bridging group, p represents 0 or 1, and (m+r) of X', M, $L^2$ or p as well as two of Ar may be identical to or different from each other or one another.

9. An image formation method comprising subjecting the photothermographic material according to claim 1 to light exposure for $10^{-6}$ second or less and heat development to form an image.

10. An image formation method comprising subjecting the photothermographic material according to claim 1 to light exposure utilizing a multi-beam heat development apparatus provided with two or more laser heads and heat development to form an image.

* * * * *